US010639775B2

(12) United States Patent
Tilley et al.

(10) Patent No.: US 10,639,775 B2
(45) Date of Patent: May 5, 2020

(54) SYSTEMS, APPARATUS AND METHODS FOR MANIPULATING A GROUND COVER ATTACHMENT PIN

(71) Applicant: NEWPARK MATS & INTEGRATED SERVICES LLC, The Woodlands, TX (US)

(72) Inventors: David Jon Tilley, Franklin, LA (US); Randy Paul Bordelon, Opelousas, LA (US); Matthew Stephen James Lanigan, The Woodlands, TX (US); James Kerwin McDowell, Lafayette, LA (US)

(73) Assignee: NEWPARK MATS & INTEGRATED SERVICES LLC, The Woodlands, TX (US)

( * ) Notice: Subject to any disclaimer, the term of this patent is extended or adjusted under 35 U.S.C. 154(b) by 0 days.

(21) Appl. No.: 16/141,650

(22) Filed: Sep. 25, 2018

(65) Prior Publication Data

US 2019/0099869 A1 Apr. 4, 2019

Related U.S. Application Data

(60) Provisional application No. 62/565,906, filed on Sep. 29, 2017.

(51) Int. Cl.
*B25B 28/00* (2006.01)
*B25B 23/10* (2006.01)
(Continued)

(52) U.S. Cl.
CPC ..... *B25B 28/00* (2013.01); *B25B 23/10* (2013.01); *E01C 9/08* (2013.01); *E01C 11/02* (2013.01)

(58) Field of Classification Search
CPC ..... B25B 27/14; B25B 27/20; B25B 27/28; B25B 28/00; B25B 31/00; B25C 11/00
See application file for complete search history.

(56) References Cited

U.S. PATENT DOCUMENTS 358,016 A * 2/1887 Clark ..... B25B 23/0085 81/13
627,669 A * 6/1899 Jenkins ..... G04D 1/08 29/232

(Continued)

FOREIGN PATENT DOCUMENTS

CA 2685346 A1 * 4/2011 ..... B25B 23/08
CN 105881449 A 8/2016

OTHER PUBLICATIONS

Stanley Spike Pullers, 2017, 2 pp., http://www.stanleyhydraulics.com/products/spike-pullers.

*Primary Examiner* — Tyrone V Hall, Jr.
(74) *Attorney, Agent, or Firm* — Cantor Colburn LLP

(57) ABSTRACT

A power tool for unlocking a releasable attachment pin from at least two ground covers includes at least one gripper carried by a carrier and selectively moveable relative to the carrier to grip a first portion of the attachment pin. At least one rotator also carried by the carrier is selectively rotatable relative to the first portion of the attachment pin to rotate a second portion of the attachment pin to unlock the attachment pin from the ground covers. A power-driven actuator associated with the carrier is operatively coupled to the rotator(s) and configured to selectively rotate the rotator(s).

30 Claims, 40 Drawing Sheets

(51) Int. Cl.
*E01C 9/08* (2006.01)
*E01C 11/02* (2006.01)

(56) References Cited

U.S. PATENT DOCUMENTS 986,133 A * 3/1911 Butsch ..... B25B 7/02 29/261
1,962,814 A * 6/1934 Gilstrap ..... B25B 27/005 29/246
2,277,587 A * 3/1942 Gustafson ..... G04D 1/08 254/28
2,302,691 A * 11/1942 Green ..... B25B 23/10 294/100
2,470,327 A * 5/1949 Tener ..... B25B 27/02 251/337
3,995,363 A * 12/1976 Medina, Jr. ..... B25B 27/14 29/280
4,459,728 A 7/1984 Gaquere
4,941,252 A * 7/1990 Haisch ..... B25B 27/023 29/261
5,208,958 A 5/1993 Wilcox
5,787,561 A 8/1998 Harmand
6,367,139 B2 4/2002 Wille
6,685,388 B2 2/2004 Webster et al.
6,722,831 B2 4/2004 Rogers et al.
6,755,392 B1 * 6/2004 Phillips ..... B25C 11/00 254/18
6,857,343 B1 * 2/2005 Easterbrooks ..... B25B 23/101 606/104
7,331,147 B2 2/2008 Kalisiak et al.
7,544,010 B2 6/2009 Restrepo et al.
8,375,544 B1 2/2013 Wilson
9,068,584 B2 6/2015 McDowell et al.
9,206,559 B2 12/2015 Bach et al.
2002/0078652 A1 6/2002 Hawkes
2007/0266667 A1 11/2007 Rapaz
2012/0297933 A1 11/2012 Lavalley et al.
2013/0240806 A1 9/2013 Crover
2014/0189985 A1 7/2014 McDowell et al.
2015/0323377 A1 11/2015 Oberg
2016/0312490 A1 10/2016 McDowell et al.
2017/0073904 A1 3/2017 McDowell et al.

* cited by examiner

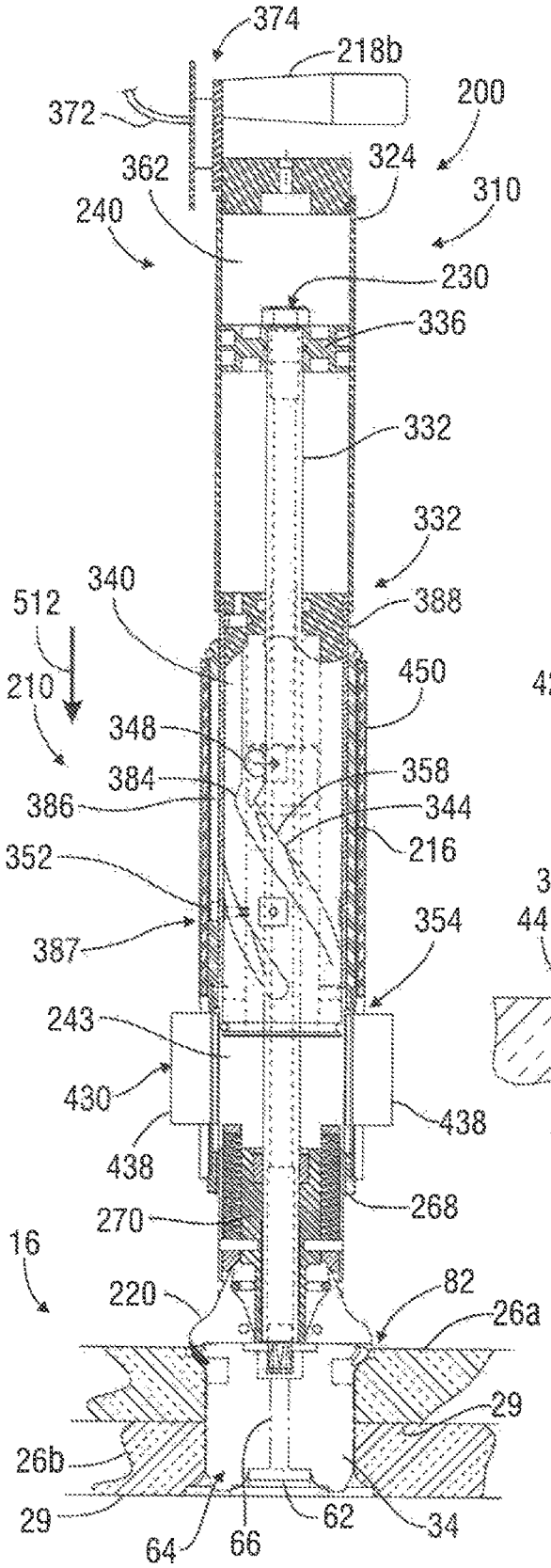
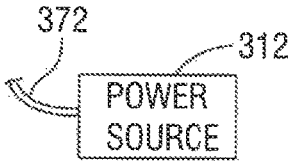
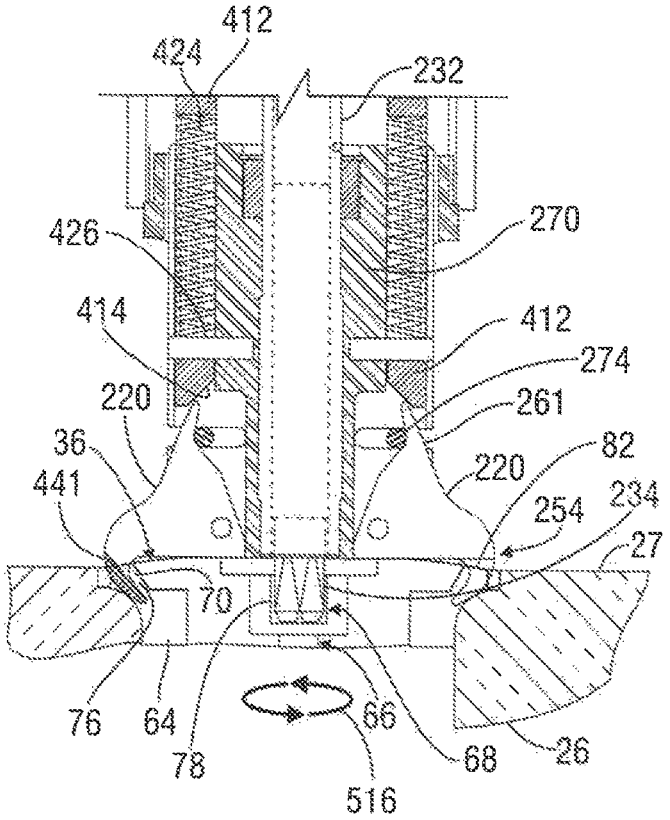
FIG.31B
FIG. 31A

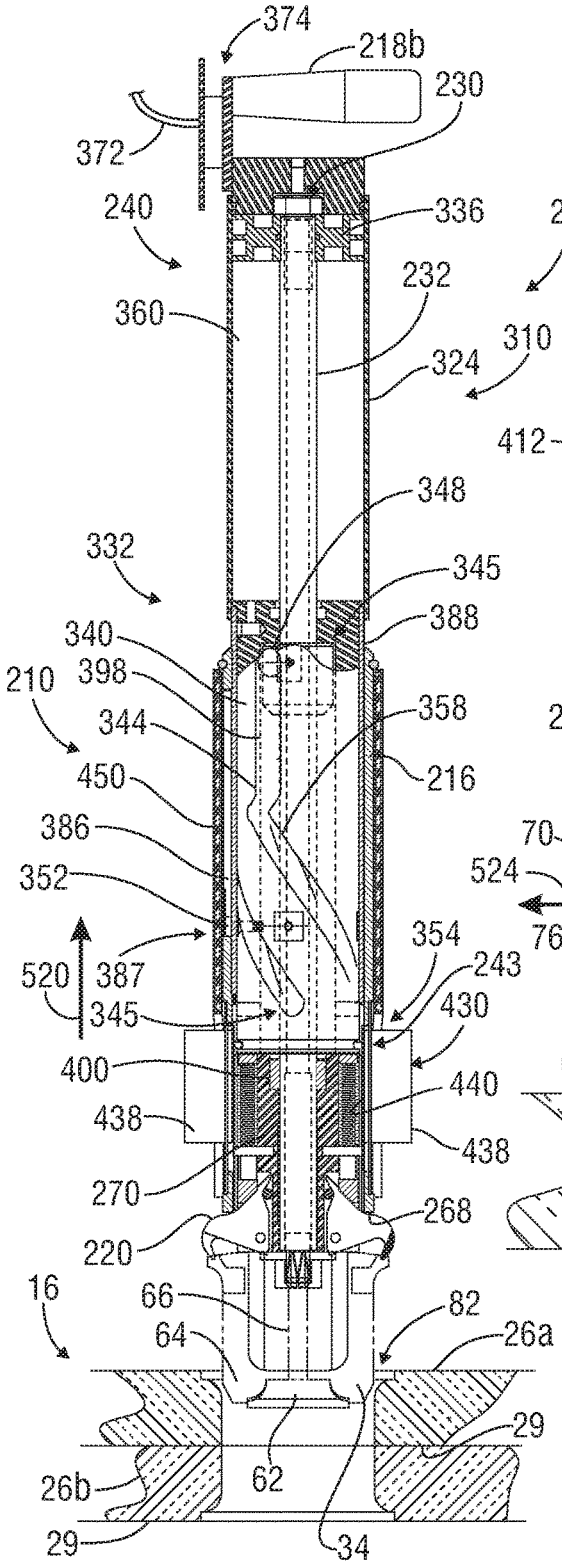
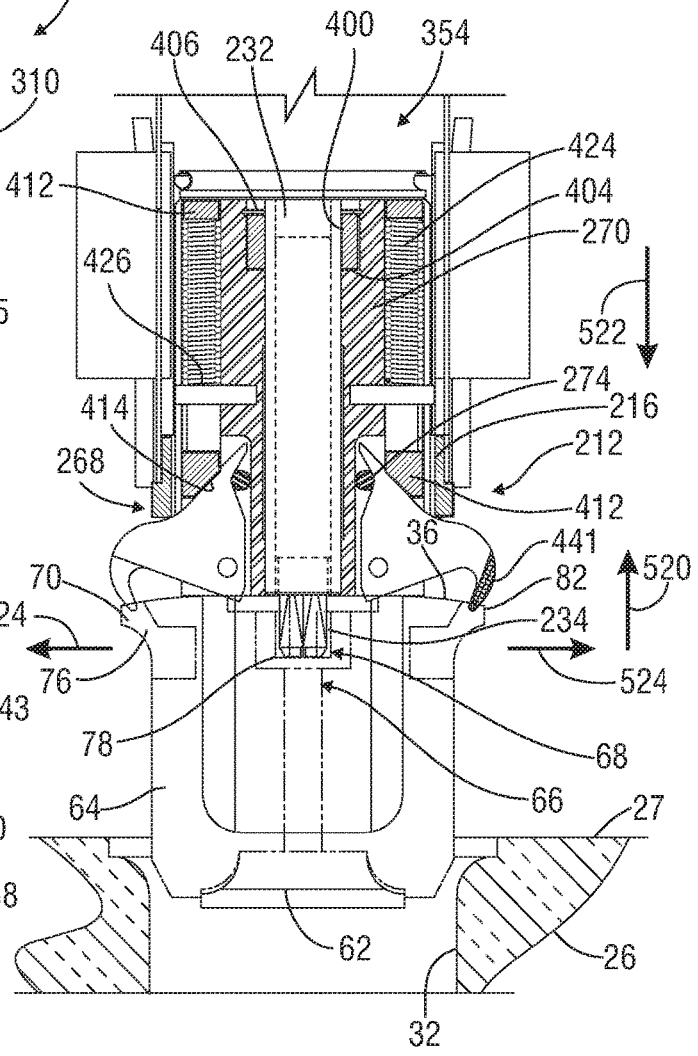
FIG. 32B
FIG. 32A

SYSTEMS, APPARATUS AND METHODS FOR MANIPULATING A GROUND COVER ATTACHMENT PIN

The present application claims priority to U.S. Provisional Patent Application Ser. No. 62/565,906 filed on Sep. 29, 2017 and entitled "Power Tool for Manipulating a Ground Cover Attachment Pin and Related Methods", which is hereby incorporated by reference herein in its entirety.

FIELD OF THE DISCLOSURE

The present disclosure relates generally to apparatus, systems and methods for manipulating a ground cover attachment pin and, in some embodiments, to a power tool for unlocking a ground cover attachment pin from a support surface and related methods. Some embodiments involve locking a ground cover attachment pin to a support surface and some embodiments involve extracting a ground cover attachment pin from a support surface.

BACKGROUND

Support surfaces are commonly used for roadways, remote jobsites, industrial staging areas, spill containment areas and/or other purposes in an ever-increasing myriad of industries, such as construction, military, energy (e.g. pipeline, oilfield, etc.), mining, chemical, transportation, disaster response, utilities and entertainment. The support surfaces are often formed with multiple, releasably interconnectable components, such as ground covers. For example, many versions of support surfaces involve the use of removable connectors (sometimes called attachment, or locking, pins), inserted into aligned holes formed in the respective interconnectable components to connect them together. Frequently, a large quantity (e.g. dozens) of attachment pins are used in a support surface having multiple interconnected components.

In many instances, the ground covers and related components may be heavy duty, used in heavy weight-bearing scenarios (e.g. supporting the weight and movement of tracked and/or wheeled vehicles and heavy equipment), subject to any among a variety of stresses and/or outdoor weather conditions (e.g. hot, wet, cold or freezing climates, uneven underling ground surfaces), or a combination thereof. When attachment pins are utilized, one or more of these factors, the shear quantity of attachment pins needed in a particular situation and/or other variables may impact the effectiveness and efficiency of manipulating (e.g. locking, unlocking, extracting or a combination thereof) the attachment pins. For example, in some scenarios, substantial torque or effort may be required to secure the attachment pins into or out of engagement with the support surface (e.g. due to uneven underlying surfaces, warping, imperfect, uneven or differing geometries of connected components, misaligned attachment pin holes, freezing weather conditions, frozen, iced-over, jammed, damaged or deformed attachment pins, etc.).

Various presently known existing tools and techniques for manipulating attachment pins may be difficult to use or implement, ineffective, inefficient, time-consuming, require manually-generated torque and/or operator bending, or a combination thereof. For other examples, various prior art tools and techniques are not fully or nearly fully automated, easy to maintain, largely or entirely self-lubricating, reliable, useful in severe weather conditions and circumstances, easily used for both locking and unlocking attachment pins with minimal tool reconfiguration, capable of extracting attachments pins from ground covers or a combination thereof.

It should be understood that the above-described examples, disadvantages, features and capabilities are provided for illustrative purposes only and are not intended to limit the scope or subject matter of this disclosure or the appended claims. Thus, none of the appended claims should be limited by the above discussion or construed to address, include or exclude each or any of the above-cited examples, disadvantages, features and capabilities merely because of the mention thereof herein.

Accordingly, there exists a need for improved systems, articles and methods useful for manipulating ground cover attachment pins having one or more of the attributes or capabilities described or shown in, or as may be apparent from, the various parts of this patent.

BRIEF SUMMARY OF THE DISCLOSURE

The present disclosure includes embodiments of a power tool useful for securing an attachment pin into and out of locking engagement with at least first and second ground covers. The attachment pin is extendable at least partially through aligned holes in the first and second ground covers and includes at least first and second portions. The second portion of the attachment pin is selectively rotatable relative to the first portion between at least one locked position and at least one unlocked position relative to the ground covers to lock and unlock the attachment pin from the ground covers, respectively. The power tool includes a carrier having an upper end and a lower end and being selectively positionable over the attachment pin and ground covers. At least one gripper is carried by the carrier and positioned proximate to the lower end of the carrier. At least one of the grippers is selectively moveable relative to the carrier between at least one engaged position and at least one disengaged position. In at least one engaged position, such gripper(s) grip at least the first portion of the attachment pin and, in at least one disengaged position, do not grip the attachment pin.

The exemplary power tool also includes at least one rotator carried by the carrier and positioned proximate to the lower end of the carrier. The rotator(s) is/are engageable with the second portion of the attachment pin and selectively rotatable relative to the carrier, gripper(s), first portion of the attachment pin and ground covers to rotate the second portion of the pin from at least one unlocked position to at least one locked position relative to the ground covers to releasably couple the ground covers together; and from at least one locked position to at least one unlocked position relative to the ground covers to unlock the attachment pin from the ground covers. At least one power-driven actuator is associated with the carrier, operatively coupled to the at least one rotator and configured to selectively rotate the at least one rotator.

In various embodiments, the present disclosure involves a power tool useful for unlocking a releasable attachment pin from at least first and second ground covers. The attachment pin is extendable at least partially through aligned holes in the first and second ground covers and includes at least first and second portions. The second portion of the attachment pin is selectively rotatable relative to the first portion from at least one locked position to at least one unlocked position relative to the ground covers to unlock the attachment pin from the ground covers. The power tool includes a carrier having upper and lower ends and being selectively positionable over the attachment pin and ground covers. At least one gripper is carried by the carrier and positioned proximate to the lower end of the carrier. At least one of the grippers is selectively moveable relative to the carrier between at least one engaged position and at least one disengaged position. The at least one gripper in at least one engaged position grips at least the first portion of the attachment pin and in at least one disengaged position does not grip the attachment pin.

In these embodiments, the tool also includes at least one rotator carried by the carrier and positioned proximate to the lower end of the carrier. The at least one rotator is distinct from the gripper(s), engageable with the second portion of the attachment pin and selectively rotatable relative to the carrier, gripper(s), first portion of the pin and ground covers to rotate the second portion of the attachment pin from at least one locked position to at least one unlocked position relative to the ground covers to unlock the attachment pin from the ground covers. At least one power-driven actuator is associated with the carrier, operatively coupled to the at least one rotator and configured to selectively rotate the at least one rotator.

In some embodiments, the present disclosure involves a power tool useful for securing an attachment pin into locking engagement with at least first and second ground covers. The attachment pin is extendable at least partially through aligned holes in the first and second ground covers and includes at least first and second portions. The second portion of the attachment pin is selectively rotatable relative to the first portion from at least one unlocked position to at least one locked position relative to the ground covers to secure the attachment pin into locking engagement with the ground covers and thereby releasably couple the ground covers together. The power tool includes a carrier having an upper end and a lower end and being selectively positionable over the attachment pin. At least one rotator is carried by the carrier and positioned proximate to the lower end of the carrier. The at least one rotator is engageable with the second portion of the attachment pin and selectively rotatable relative to the carrier, first portion of the pin and first and second ground covers to rotate the second portion of the pin from at least one unlocked position to at least one locked position relative to the ground covers and releasably couple the ground covers together.

In these embodiments, at least one gripper is carried by the carrier and positioned proximate to the lower end of the carrier. At least one of the grippers is selectively moveable into engagement with at least the first portion of the attachment pin to retain the first portion of the attachment pin in a substantially fixed position relative to the second portion of the pin during rotation of the second portion of the pin by the at least one rotator. At least one power-driven actuator is associated with the carrier, operatively coupled to the at least one rotator and configured to selectively rotate the at least one rotator.

The present disclosure also includes embodiments of a power tool useful for securing an attachment pin into and out of locking engagement with at least first and second ground covers and extracting the attachment pin from the ground covers. The attachment pin is extendable at least partially through aligned holes in the first and second ground covers and is selectively rotatable relative to the ground covers between at least one locked position and at least one unlocked position to respectively couple and uncouple the ground covers together. The power tool includes a carrier having upper and lower ends and being selectively positionable over the attachment pin. At least one gripper is carried by the carrier and positioned proximate to the lower end of the carrier. At least one of the grippers is selectively moveable into and out of gripping engagement with the attachment pin, rotatable relative to the first and second ground covers and moveable away from the first and second ground covers. When the at least one gripper is in gripping engagement with the attachment pin, the at least one gripper is rotatable to rotate the attachment pin between locked and unlocked positions. When the at least one gripper is in gripping engagement with the attachment pin and the attachment pin is in an unlocked position, the at least one gripper is moveable axially away from the ground covers to remove the attachment pin therefrom. The tool also includes at least one power-driven actuator carried by the carrier and operatively coupled to at least one of the grippers. The at least one power-driven actuator is configured to selectively rotate the at least one gripper relative to the first and second ground covers and selectively move the at least one gripper up and away from the ground covers.

BRIEF DESCRIPTION OF THE DRAWINGS

The following figures are part of the present specification, included to demonstrate certain aspects of various embodiments of this disclosure and referenced in the detailed description herein:

FIG. 31A is a front, partial cross-sectional view of the exemplary power tool of FIG. 27A showing the exemplary rotator counter-rotating the second portion of the illustrated attachment pin in accordance with one or more embodiments of the present disclosure;

FIG. 31B is an exploded view of part of the exemplary power tool shown in FIG. 31A;

FIG. 32A is a front, partial cross-sectional view of the exemplary power tool of FIG. 27A showing the tool extracting and disengaging from the illustrated unlocked attachment pin in accordance with one or more embodiments of the present disclosure;

FIG. 32B is an exploded view of part of the exemplary power tool shown in FIG. 32A;

DETAILED DESCRIPTION OF PRESENTLY PREFERRED EMBODIMENTS

Figure 2:
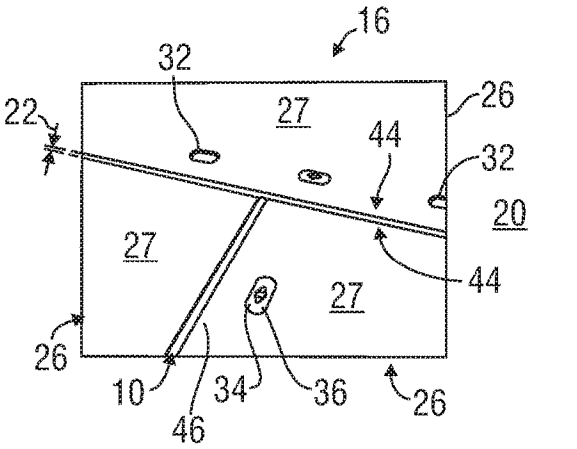
FIG. 2 is a top view of a portion of an exemplary support surface useful in accordance with one or more embodiments of the present disclosure.

Characteristics and advantages of the present disclosure and additional features and benefits will be readily apparent to those skilled in the art upon consideration of the following detailed description of exemplary embodiments and/or referring to the accompanying figures. It should be understood that the description herein and appended drawings, being of example embodiments, are not intended to limit the claims of this patent or any patent or patent application claiming priority hereto. On the contrary, the intention is to cover all modifications, equivalents and alternatives falling within the spirit and scope of this disclosure or any appended claims. Many changes may be made to the particular embodiments and details disclosed herein without departing from such spirit and scope.

In showing and describing preferred embodiments in the appended figures, common or similar elements are referenced with like or identical reference numerals or are apparent from the figures and/or the description herein. The figures are not necessarily to scale and certain features and certain views of the figures may be shown exaggerated in scale or in schematic in the interest of clarity and conciseness.

As used herein and throughout various portions (and headings) of this patent (including the claims), the terms "invention", "present invention" and variations thereof are not intended to mean every possible embodiment encompassed by this disclosure or any particular claim(s). Thus, the subject matter of each such reference should not be considered as necessary for, or part of, every embodiment hereof or of any particular claim(s) merely because of such reference. The terms "coupled", "connected", "engaged" and the like, and variations thereof, as used herein and in the appended claims mean either an indirect or direct connection or engagement, except and only to the extent as may be expressly recited and explicitly required in a particular claim hereof and only for such claim(s) and any claim(s) depending therefrom. Thus, if a first device couples to a second device, that connection may be through a direct connection, or through an indirect connection via other devices and connections, except and only to the extent as may be expressly recited and explicitly required in a particular claim hereof and only for such claim(s) and any claim(s) depending therefrom. The terms "rigidly coupled to" and variations thereof as used herein and in the appended claims mean the referenced components are coupled in a manner that prevents at least substantial, and in some cases any, movement of the components relative to one another during normal or expected operations. As used herein and in the appended claims, the terms "substantially", "generally" and variations thereof mean and includes (i) completely, or 100%, of the referenced parameter, variable or value, and (ii) a range of values less than 100% based upon the typical, normal or expected degree of variation or error for the referenced parameter, variable or value in the context of the particular embodiment or use thereof, such as, for example, 90-100%, 95-100% or 98-100%.

Certain terms are used herein and in the appended claims to refer to particular components. As one skilled in the art will appreciate, different persons may refer to a component by different names. The use of a particular or known term of art as the name of a component herein is not intended to limit that component to only the known or defined meaning of such term (e.g. bar, rod, cover, panel, bolt). Further, this document does not intend to distinguish between components that differ in name but not function. Also, the terms "including" and "comprising" are used herein and in the appended claims in an open-ended fashion, and thus should be interpreted to mean "including, but not limited to . . . ." Further, reference herein and in the appended claims to components and aspects in a singular tense does not necessarily limit the present disclosure or appended claims to only one such component or aspect, but should be interpreted generally to mean one or more, as may be suitable and desirable in each particular instance.

Figure 1:
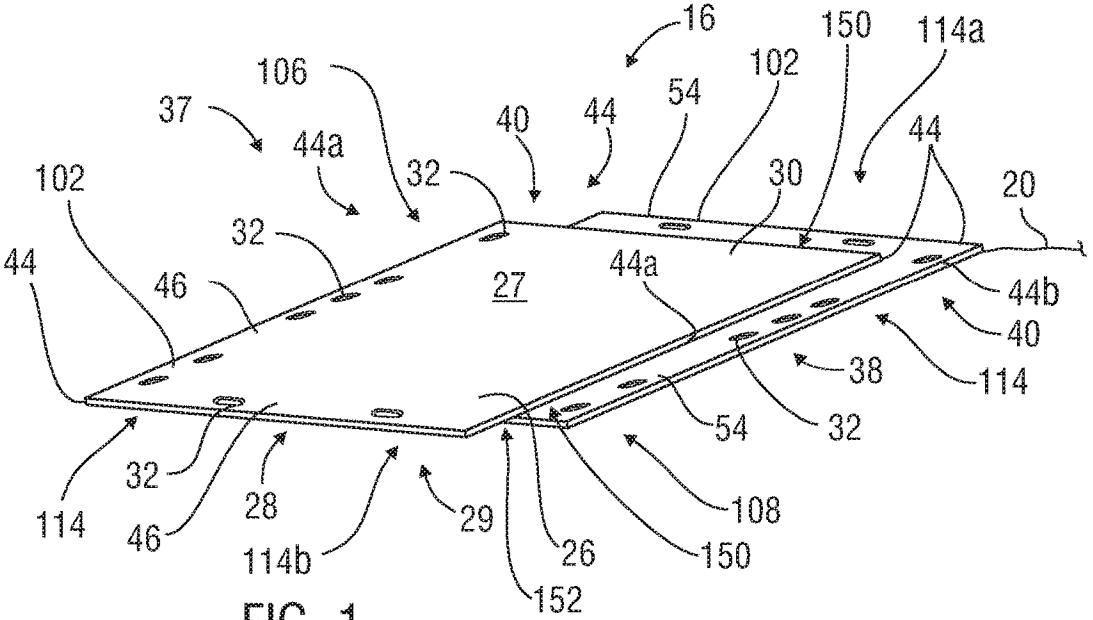
FIG. 1 is a perspective view of an exemplary ground cover useful in a support surface in accordance with one or more embodiments of the present disclosure.

Referring initially to FIGS. 1 & 2, an exemplary support surface 16 having at least one ground cover 26 configured to be deployed on or near the ground 20 is shown. As used herein and in the appended claims, the terms "ground" and variations thereof mean the earth's surface, material or liquid on or near the earth's surface (including waterways and bodies of water) and/or one or more other surfaces, structures or areas on, near or associated with the earth's surface. As used herein and in the appended claims and understood by persons of ordinary skill in the art, the term "ground cover" is the name for and refers to a section of material that is useful to at least partially cover an area (on the ground or other surface), constructed of any desired material and capable of supporting a desired load. Some examples of ground covers 26 are mats, sheets, panels and the like, which may be constructed of thermoplastic material, rubber, plastic, fiberglass, fiber-reinforced plastic, recycled rubber or other material, wood, steel, steel-framed wood, aluminum, or any other desired material or combination thereof.

The support surface 16 and ground covers 26 may have any suitable form, construction, components, configuration and operation. In the illustrated embodiment, the support surface 16 includes at least two reusable, interconnectable, adjacent ground covers 26. However, the support surface 16 may include ground covers 26 which are not reusable, interconnectable or adjacent. In some instances, the support surface 16 may include only one ground cover 26.

If desired, the exemplary support surface(s) 16 and ground cover(s) 26 may be capable of supporting the weight of vehicles, equipment, other structures, multiple personnel or a combination thereof thereupon and moving thereacross over a variety of types of underling terrain and conditions (e.g. standing water, swamps, sand, clay, marsh, wetlands, bog, uneven underling ground or surfaces) to provide a foundation or platform for work sites, roadways and the like, to protect the environment (e.g. the ground below the ground covers 26) from damage and/or contamination due to the activities performed thereupon, for other purpose(s) or a combination thereof. In some embodiments, the ground covers 26 may be heavy-duty, durable, all-weather and capable of supporting and withstanding substantial weight and forces placed thereupon in harsh outdoor environments, such as below freezing (e.g. −30° F. or less) to tropical/desert temperatures (115° F. or more) and harsh conditions, such as snow, ice, mud and rain. For example, the ground covers 26 may be configured to support heavy equipment, wheeled and/or tracked vehicles and trailers, (e.g. bulldozers, bucket-loaders, water or fuel tanker trucks, semi-trailer trucks, etc.), equipment typically used at remote oilfield or hydrocarbon production, storage, and/or transportation sites (e.g. all the types of vehicles and equipment used for hydraulic fracturing), pipeline locations, construction, military, transportation, disaster response, utilities or entertainment sites and the like. In many instances, the ground covers 26 can support vehicles rated as H-20, HS-20, H-25 and HS-25 by the American Association of State Highway & Transportation Officials (AASHTO). In various embodiments, the ground cover 26 may weight up to or more than approximately 1,000 lbs., be designed to withstand up to, or in some cases more than, 600 psi in pure crush pressure placed thereupon, reduced point-to-point ground pressure on the ground below it that may be caused by wheeled and/or tracked vehicles on or moving across the ground cover 26, or a combination thereof. In various embodiments, the ground covers 26 may be 14'×8' perimeter-welded DURA-BASE® mats sold by the Assignee of this patent. A ground cover 26 and/or support surface 16 including multiple interconnected ground covers 26 having any of the features or capabilities mentioned in this paragraph is sometimes referred to as a "heavy load supporting" ground cover or support surface.

Under certain circumstances and conditions, the ground cover 26 (or support surface 16 including multiple ground covers 26) may be sufficiently buoyant to be used as a floating or partially floating foundation or platform, work site, roadway, support surface and the like for supporting equipment, vehicles and/or multiple personnel thereupon. In at least some embodiments and configurations, the ground covers 26 may be sufficiently buoyant to float over or across a waterway (e.g. creek, river) or body of water (e.g. pond, lake) or be used in other water scenarios (e.g. standing water, swamp) to serve as a floating or at least partially floating heavy load supporting ground cover 26 or as part of a heavy load supporting support surface 16. Various scenarios may require multiple stacked ground covers 26 and/or multiple side-by-side ground covers 26. For example, some exemplary ground cover(s) 26 (e.g. perimeter-welded DURA-BASE® mats), each having a weight of approximately 1,010 lbs., may each have a buoyancy reserve of approximately 800 lbs. in water having a density of approximately 62.43 lbs/cu.ft. with a ground cover displacing volume of 1800 cu.ft. and be used to create a heavy load supporting support surface 16. Such support surface 16, for example, having multiple (e.g. 3, 4 or more) stacked layers of multiple (e.g. 2, 3 or more) side-by-side interconnected ground covers 26 may be formed to create a bridge at least partially across a body of water or waterway to support the passage there-over of vehicles having 10,000 lbs. per axle loading. Depending upon the circumstances, the ends of the support surface 16 may need to be anchored to the earth or other stable structure, such as to prevent shifting or migration of the ground covers 26 and/or for any other purpose.

Figure 12A:
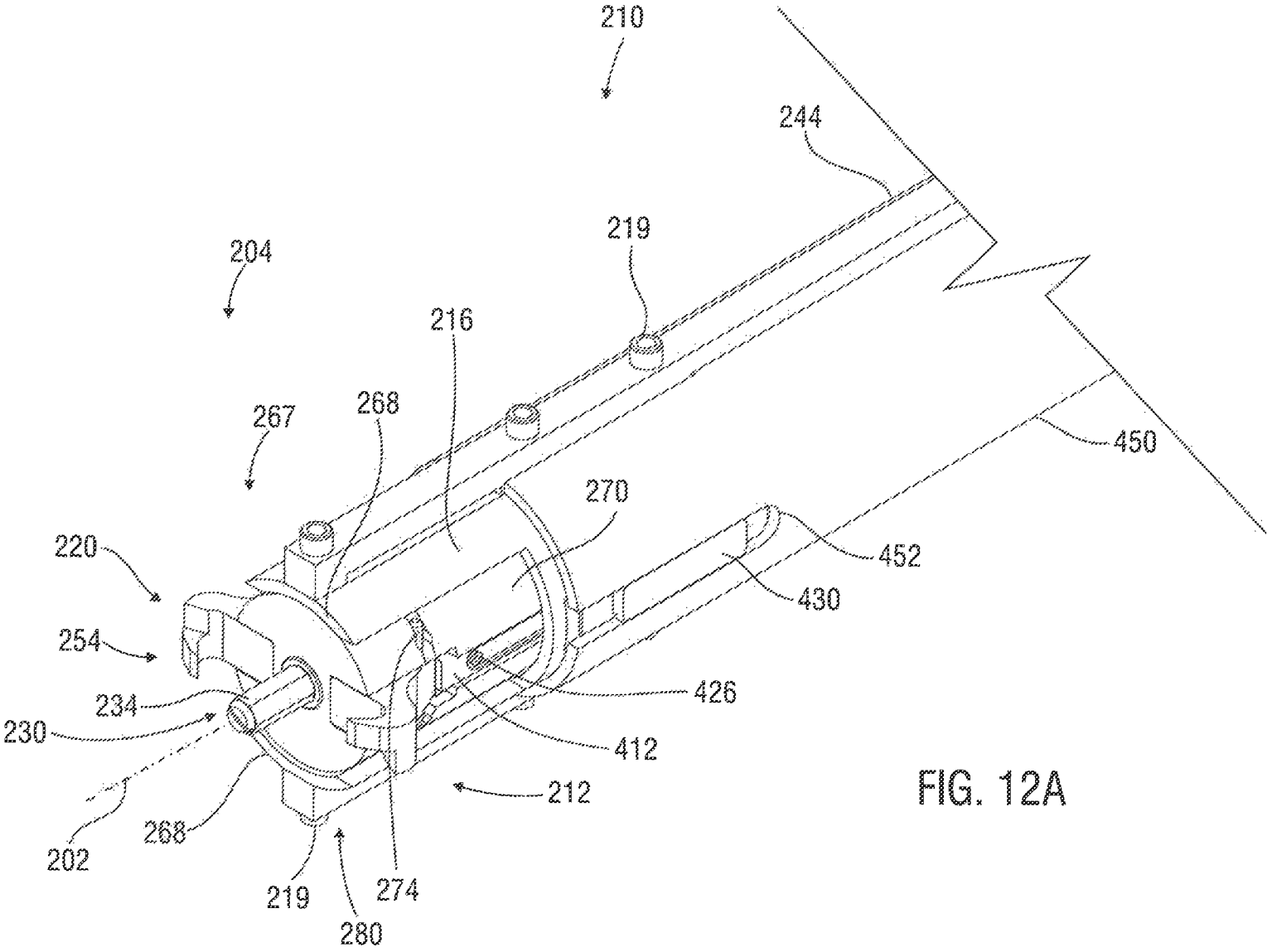
FIGS. 12A-B show a perspective view of an embodiment of an attachment pin manipulation power tool in accordance with the present disclosure.
Figure 12B:
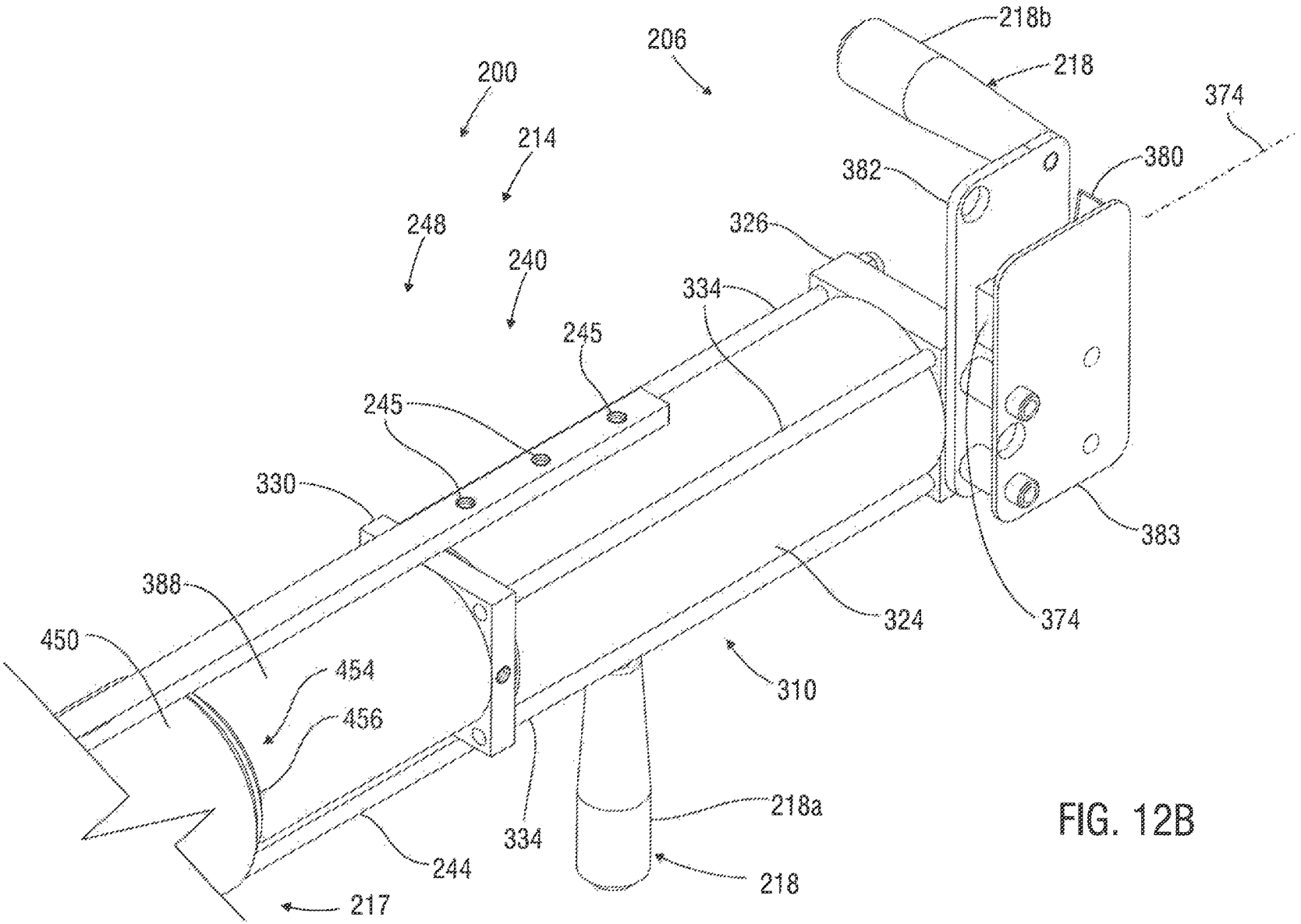
Figure 13:
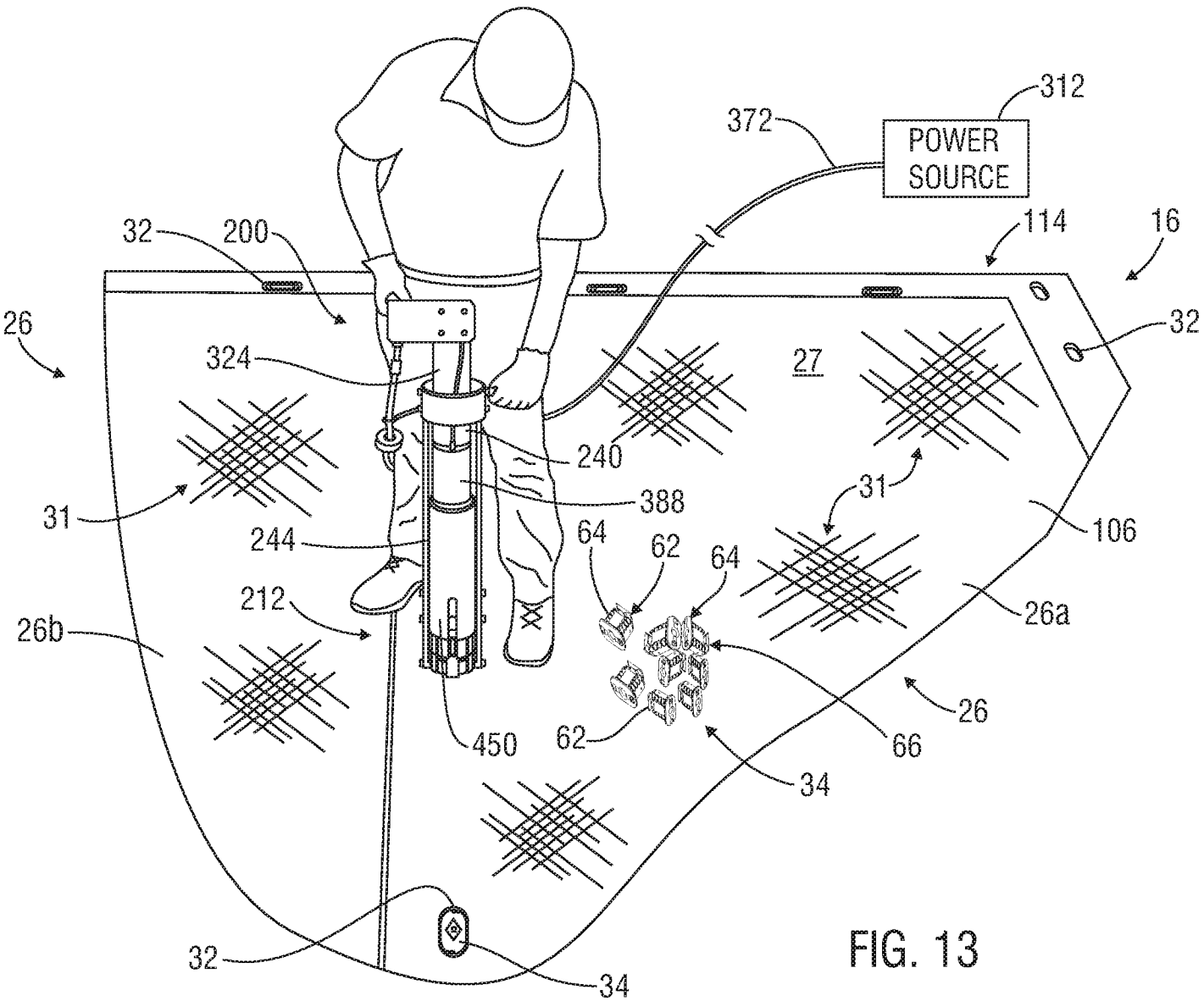
FIG. 13 is a partial top view of a human operator using the exemplary power tool of FIGS. 12A-B.
Figure 14:
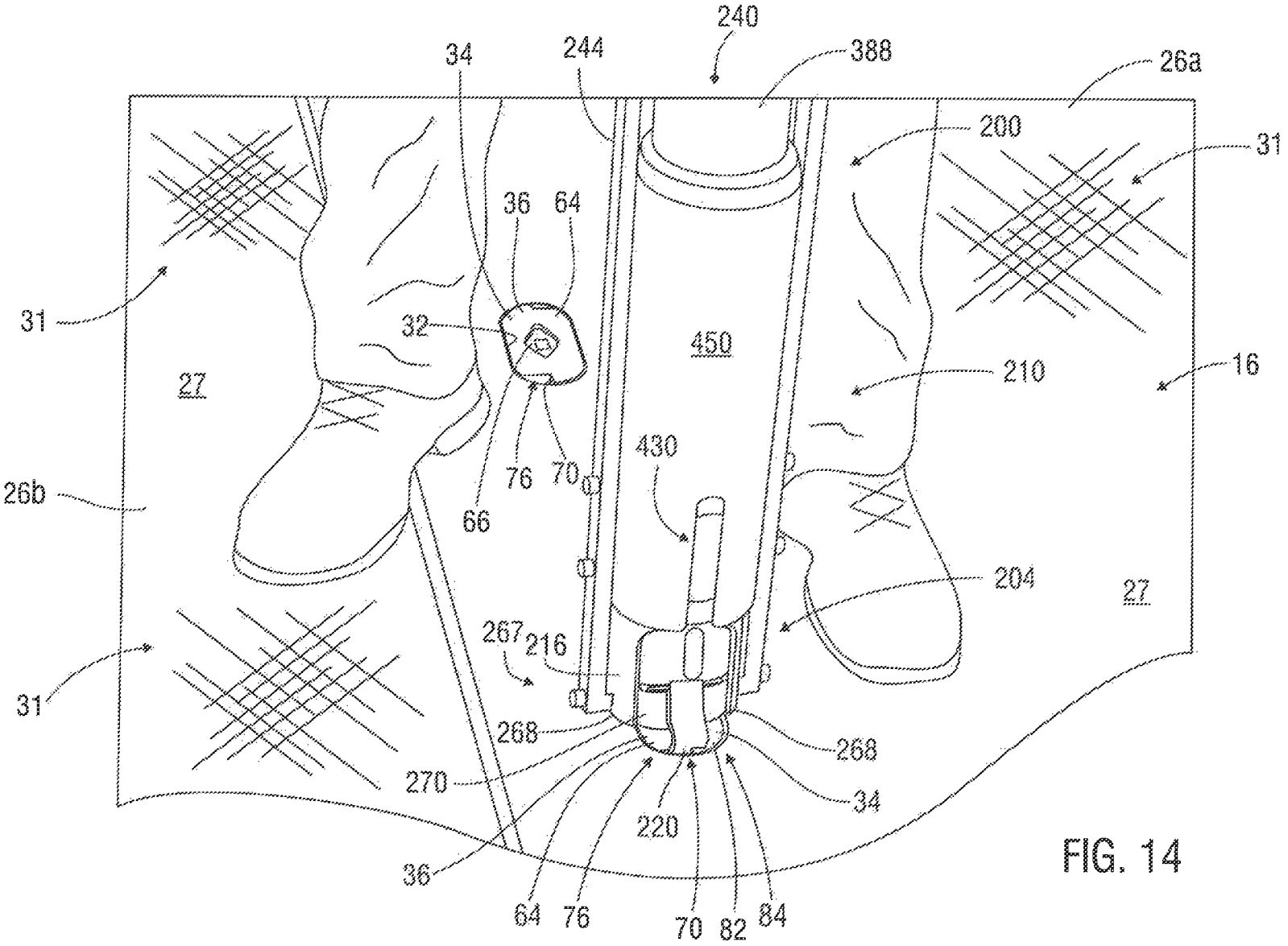
FIG. 14 is a partially exploded view of FIG. 13.

Some examples of ground covers 26 which may be used in various embodiments of the present disclosure are shown and described in U.S. Pat. No. 5,653,551 to Seaux, entitled "System for Construction of Roadways and Support Surfaces" and issued on Aug. 5, 1997, and U.S. Pat. No. 6,511,257 to Seaux et al., entitled "Interlocking Mat System for Construction of Load Supporting Surfaces" and issued on Jan. 28, 2003, both of which have a common Assignee as the present patent and the contents of which are hereby incorporated by reference herein in their entireties. However, the present disclosure and attachment pin manipulation power tools 200 and methods as will be shown (e.g. FIGS. 12A-B), described and claimed herein may be used with ground covers 26 not having one or more of the capabilities, specifications or features described herein or as provided in the above-referenced patents. For example, the ground covers 26 may not be heavy-duty, durable, all-weather, buoyant, capable of supporting the weight of personnel, vehicles, equipment and/or other structures thereupon or a combination thereof, and may be used in indoor locations. Thus, the type of ground cover 26 is not limiting upon the present disclosure and appended claims, except and only to the extent as may be expressly recited and explicitly required in a particular claim hereof and only for such claim(s) and any claim(s) depending therefrom.

If desired, the support surface 16 or ground cover(s) 26 may be used in connection with any of the components and features described and shown in U.S. Pat. No. 9,132,996 issued on Sep. 15, 2015 to Robertson and entitled "Crane-Mounted Grab Head", U.S. Pat. No. 7,370,452 issued on May 13, 2008 to Rogers and entitled "Mat Assembly for Heavy Equipment Transit and Support", U.S. Pat. No. 9,039,325 issued on May 26, 2015 to McDowell and entitled "Liquid Containment System for Use with Load Supporting Surfaces", U.S. Pat. No. 9,745,124 issued on Aug. 29, 2017 to McDowell and entitled "Liquid Containment System", U.S. patent application Ser. No. 15/685,407 filed on Aug. 24, 2017 and entitled "Liquid Containment System that Accommodates Vehicle Ingress & Egress", U.S. Pat. No. 9,430,943 issued on Aug. 30, 2016 and entitled "Apparatus and Methods for Providing Illuminated Signals from a Support Surface", U.S. Pat. No. 9,337,586 issued on May 10, 2016 and entitled "Apparatus & Methods for Electrically Grounding a Load-Supporting Surface", U.S. Pat. No. 9,368,918 issued on Jun. 14, 2016 and entitled "Apparatus and Methods for Electrically Grounding a Load-Supporting Surface", U.S. Pat. No. 9,735,510 issued on Aug. 15, 2017 and entitled "Apparatus and Methods for Electrically Grounding at Least one Mat in a Load-Supporting Surface", U.S. Pat. No.

9,985,390 issued on May 29, 2018 and entitled "Apparatus for Electrically Grounding at Least one Mat", U.S. Pat. No. 9,972,942 issued on May 15, 2018 to Bordelon et. al and entitled "Apparatus and Methods for Insulating a Support Mat Having an Electrically-Conductive Cover", U.S. Pat. No. 9,297,124 issued on Mar. 29, 2016 and entitled "Methods of Moving at Least One Mat With a Crane-Mounted Grab Head", U.S. Pat. No. 10,024,075 issued on Jul. 17, 2018 to McDowell et al. and entitled "Apparatus & Methods for Supporting One or More Upright Items from a Support Surface", U.S. patent application Ser. No. 15/484,857 filed on Apr. 11, 2017 and entitled "Apparatus, System and Methods for Providing Accessories on a Support Surface", as well as all related patents issuing from each of the applications mentioned above, each of which has a common Assignee as the present patent and all the contents of which are hereby incorporated by reference herein in their entireties.

Still referring to FIGS. 1 & 2, in the illustrated embodiment, each ground cover 26 has a top, or upper surface, 27, a bottom, or lower surface, 29 and four sides 28, 30, 37 and 38. The exemplary upper and lower surfaces 27, 29 are substantially planar (flat). In other embodiments, the ground cover 26 may have more or less than four sides (e.g. two, three, five, six, seven, etc.) and the upper and/or lower surfaces 27, 29 may not be planar. At least one outer, or side, edge 44 (e.g. edge 44*a*) extends along each side and around a perimeter 114 (e.g. perimeter 114*a*) of the exemplary ground cover 26. As used herein and in the appended claims, the terms "edge" and variations thereof means a surface extending in a straight line, or along a path having curves, turns or breaks at least partially along a side of the subject component.

In this example, the ground cover 26 is rectangular, formed of two sections, or panels, 102 (an upper panel 106 and lower panel 108), and has an opposing pair of short sides 28, 30 and an opposing pair of long sides 37, 38. The illustrated ground cover 26 thus has a first, upper, set of aligned edges 44*a* extending around an "upper" perimeter 114*a* (formed around the upper panel 106), and a second, lower, set of aligned edges 44*b* extending around a "lower" perimeter 114*b* (formed around the lower panel 108).

Still referring to FIGS. 1 & 2, in this embodiment, the ground cover 26 has a stepped-configuration with one or more protruding lips 40. As used herein and in the appended claims, the terms "stepped-configuration" and variations thereof mean the ground cover 26 has at least one portion, or protruding lip, 40 that extends at least partially on a different plane than at least one other portion, and the planes are at least substantially parallel. The exemplary first short side 28 and first long side 37 of the ground cover 26 each have an upper lip 46 extending horizontally outwardly therefrom, which will typically be spaced above the ground 20. The illustrated second short side 30 and second long side 38 of the ground cover 26 each have a lower lip 54 extending horizontally outwardly therefrom, and which will typically rest on the ground 20. Thus, in this embodiment, two sets of aligned edges 44*a*, 44*b* are formed around the sides 28, 30, 37 and 38 of the ground cover 26. In other embodiments, the ground cover 26 may have a different stepped-configuration or may not have a stepped-configuration. Further, the present disclosure and the attachment pin manipulation power tools 200 and methods as will be shown, described and claimed herein are not limited to use with ground covers having planar upper and lower surfaces 27, 29, upper and lower lips 46, 54 or other features as described above, and may thus be used with ground covers 26 not having a stepped-configuration and/or upper and lower lips 46, 54, as well as ground covers having less or more than four lips (e.g. 1, 2, 3, 5, 6, etc.), except and only to the extent as may be expressly recited and explicitly required in a particular claim hereof and only for such claim(s) and any claim(s) depending therefrom.

Referring again to FIG. 1, in many embodiments, the multiple sections, or panels, 102 forming the ground cover 26 may be interconnected. In this example, the panels 102 form the stepped-configuration and protruding lips 40 of the ground cover 26. The illustrated ground cover 26 includes upper and lower engaged, at least partially overlapping and offset, rectangular-shaped panels 106, 108 of substantially identical dimensions. As used herein and in the appended claims, the terms "overlapping" and variations thereof mean that one of the referenced items rests upon and covers at least part of the other item(s). As used herein and in the appended claims, the terms "offset" and variations thereof mean that the referenced items are not perfectly aligned one over the other so that one or more portions of each item are aligned over the other item, while and one or more other portions of each item extend beyond the other item. In this example, the overlapping, offset panels 102 are also geometrically-aligned so that the outer edges 44*a* of the ground cover 26 extending along each respective side of the upper panel 106 are at least substantially parallel to the outer edges 44*b* of ground cover 26 extending along the respective corresponding sides of the lower panel 108. As used herein and in the appended claims, the terms "geometrically-aligned" and variations thereof mean that that the outer edges extending along each respective side of one item are at least substantially parallel to the outer edges of the respective corresponding sides of the other item(s).

In other embodiments, any quantity of panels 102 (e.g. 3, 4, 5 or more) used to form the ground cover 26 may have differing shapes (e.g. a first panel 102 being rectangular and a second panel 102 being square), sizes and/or dimensions (e.g. the second panel being smaller than the first panel 102). The panels 106, 108 may not be offset relative to one another (e.g. perfectly overlapping one another; see e.g. FIG. 5) or geometrically-aligned, may form only one, two, three or more than four protruding lips 40 or other non-overlapping portions, or a combination thereof. The ground cover 26 may be formed of two or more panels 102 having the same shape (e.g. rectangular, square, hexagonal) but different sizes. Thus, the panels 102, if included, may have any desired shape and configuration, and the multiple panels 102 used to form a single ground cover 26 may differ in shape, size, dimensions, configuration and any other characteristics.

Still referring to FIG. 1, the panels 102 may be constructed of any suitable material and interconnected in any desired manner. The exemplary panels 102 are constructed of impermeable material, such as thermoplastic material, and are coupled together by a process known as hot-plate welding. Other example panels 102 may be constructed entirely or partially of rubber, plastic, fiberglass, fiber reinforced plastic, recycled rubber or other material, wood, steel, steel-framed wood, aluminum, or any other desired material or combination thereof, and may be interconnected by other forms of welding, bolts or other mechanical connectors or other methods, etc.

In some embodiments, one or more welds 150*a* (e.g. FIG. 5) of weld-forming material (e.g. thermoplastic or other material) may be provided over and/or adjacent to one or more of the seams 150 formed between the panels 102 on the top and bottom 27, 29 of the exemplary ground cover 26. For stepped-configuration ground covers 26, one or more welds (not shown) may also be formed on the transition surfaces 152 (parts of the outer edges 44) of the exemplary ground cover 26 that extend between the seams 150 on the top and bottom 27, 29 of the ground cover 26 along the sides 28, 30, 37, 38 thereof. A weld 150*a* extending around one or more perimeters 114 (e.g. perimeters 114*a*, 114*b*) of a ground cover 26 is sometimes referred to herein as a "perimeter weld". The use of welds 150*a*, or one or more perimeter welds, may be desirable, for example, to strengthen the ground cover 26 at the reinforced location, enhance the overall strength and integrity of the ground cover 26, provide a substantially, or entirely, fluid-tight seal at the reinforced location (e.g. to prevent liquid seepage between the panels 102), provide or improve the aesthetic appearance of the ground cover 26 at the reinforced location, provide a consistent or other desired weld geometry, a combination thereof or any other purpose. Further exemplary details about providing welds over or adjacent to panel seams and other parts of ground covers 26 and embodiments of welding techniques and systems are shown and described in U.S. patent application Ser. No. 15/658,665 filed on Jul. 25, 2017 and entitled "Methods for Reinforcing a Multi-Panel Support Mat" and U.S. patent application Ser. No. 15/658,586 filed on Jul. 25, 2017 and entitled "Systems for Reinforcing a Multi-Panel Support Mat", both of which have a common Assignee as the present patent and the contents of which are hereby incorporated by reference herein in their entireties. However, the present disclosure and attachment pin manipulation power tools 200 and methods as will be shown, described and claimed herein may be used with ground covers 26 not reflecting the weld features or techniques provided in the above-referenced patent applications or described above. Further, the present disclosure is not limited by the material construction and methods of interconnecting or reinforcing the panels 102 of a ground cover 26, except and only to the extent as may be explicitly required in a particular claim hereof or in a patent claiming priority hereto and only for such claim(s) and any claim(s) depending therefrom.

In some embodiments, the ground cover 26 may be a single unitary item (e.g. panel) or a combination of more than two component parts (e.g. panels), may have only one, or more than two, perimeters 114 and/or any different overall shape (square, triangular, hexagonal, other geometric arrangement, etc.), or any desired combination thereof. Further, different shaped ground covers 26 may be interconnected in the support surface 16.

The exemplary ground cover 26 is also reversible. In other words, the top 27 and bottom 29 of the illustrated ground cover 26 are essentially mirror images of one another, so either the top 27 or bottom 29 can be facing up or down. In other embodiments, the ground covers 26 may not be reversible.

Figure 3B:
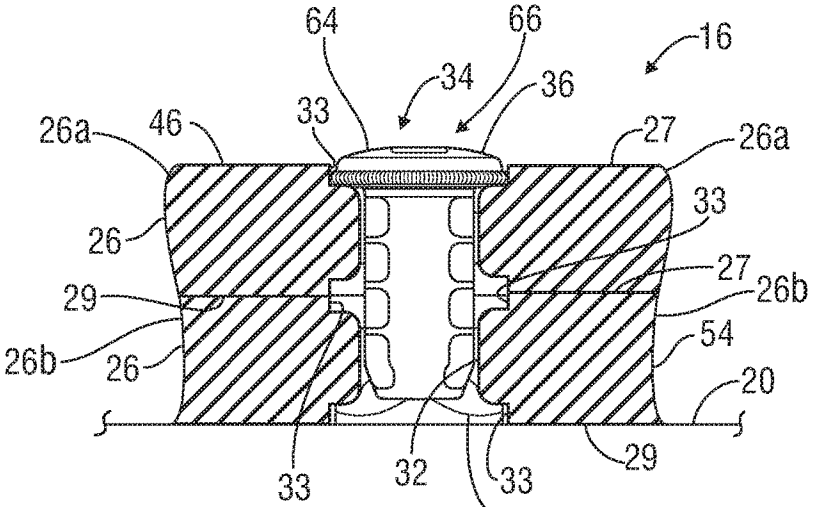
FIG. 3B is a partial cross-sectional view of an exemplary attachment pin shown engaged with two ground covers.
Figure 3A:
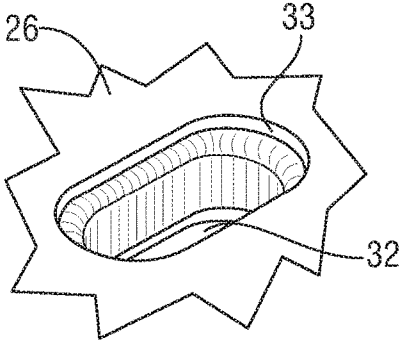
FIG. 3A is a perspective view of an exemplary attachment pin hole in an exemplary ground cover.

Referring again to FIGS. 1 & 2, the ground covers 26 (and/or other components of the support surface 16) may be secured, or connected, together with releasable attachment pins 34 (sometimes referred to as locking pins, mat clips and the like). For example, as shown in FIG. 3B, the attachment pins 34 may be selectively coupled between two or more (e.g. adjacent and at least partially overlapping) ground covers 26*a*, 26*b* to releasably secure the ground covers 26 together. Various types of attachment pins 34 are moveable between at least one position that secures the attachment pin 34 to the associated ground covers 26 and secures the ground covers 26 together as intended, and at least one position in which the attachment pin 34 is not (at least fully) secured to the associated ground covers 26 and consequently does not secure the ground covers 26 together. For the reader's sake, the first position just described will sometimes be referred to as the "locked" position and the second position as the "unlocked" position. Thus, as used herein and in the appended claims, the terms "locked", "locking", "locking engagement" and variations thereof generally refers to the secured relationship of one or more attachment pins 34 and subject ground covers 26 when the attachment pin(s) 34 (or one or more portions thereof) are positioned to secure the ground covers 26 together as intended, and/or the desired secured relationship of two or more ground covers 26 relative to each other (e.g. by one or more attachment pins 34 (or one or more portions thereof)). Likewise, as used herein and in the appended claims, the terms "unlocked" and variations thereof generally refers to the unsecured relationship of at least one attachment pin 34 and the subject ground covers 26 when the attachment pin(s) 34 (or one or more portions thereof) are not in a position that secures the ground covers 26 together as intended, and/or an unsecured relationship of the ground covers 26 relative to each other. As such, the terms "lock", "unlocked" and variations thereof as used herein and in the appended claims do not mean locked and unlocked in the most literal sense, but essentially respectively mean secured or not secured together as intended and expected during normal operating conditions.

As shown in FIGS. 1-3B, the ground covers 26 (and/or other components) may include holes 32 that can be aligned over or under those of one or more other (e.g. adjacent) ground covers and through which removable attachment pins 34 are inserted for connecting the ground covers 26 together. These sorts of holes 32 are sometimes referred to herein as "attachment pin" holes, "locking pin holes" and the like.

The attachment pins 34 may have any suitable form, shape, location, configuration, orientation, form and operation. In the exemplary embodiment, the respective upper and lower lips 46, 54 of different ground covers 26 are releasably interconnectable with attachment pins 34 releasably securable through corresponding attachment pin holes 32 formed therein. The illustrated ground cover 26 includes a plurality of attachment pin holes 32, each configured to accept a releasable attachment pin 34 therethrough. In some embodiments, each ground cover 26 may include, for example, a total of sixteen attachment pin holes 32, eight attachment pin holes 32 formed in each set of upper and lower lips 46, 54. However, the present disclosure is not limited to this configuration of attachment pin holes 32; any quantity of attachment pin holes 32 (e.g. 1-16, 17-30 or more) may be provided at any locations in the ground covers 26.

Some examples of attachment pins 34 which may be used in connection with various embodiments of the present disclosure are shown and described in U.S. Pat. No. 6,722,831 to Rogers et al., entitled "Fastening Device" and issued on Apr. 20, 2004, U.S. Pat. No. 8,388,291 to Rogers, entitled "Mat Lock Pin" and issued on Mar. 5, 2013, U.S. Pat. No. 9,068,584 to McDowell et al., entitled and "Apparatus & Methods for Connecting Mats" and issued on Jun. 30, 2015 and U.S. patent application Ser. No. 15/259,407 entitled "Apparatus and Methods for Connecting Components of a Support Surface" and filed on Sep. 8, 2016, as well as all related patents issuing from each of the applications mentioned above, each of which has a common Assignee as the present patent and the entire contents of which are hereby incorporated by reference herein in its entirety. In some embodiments, the attachment pins 34 may form a fluid-tight seal around, or in, the holes 32 within which they are engaged, such as the exemplary attachment pin 34 illustrated and described in U.S. Pat. No. 9,068,584 and U.S. patent application Ser. No. 15/259,407.

Figure 9B:
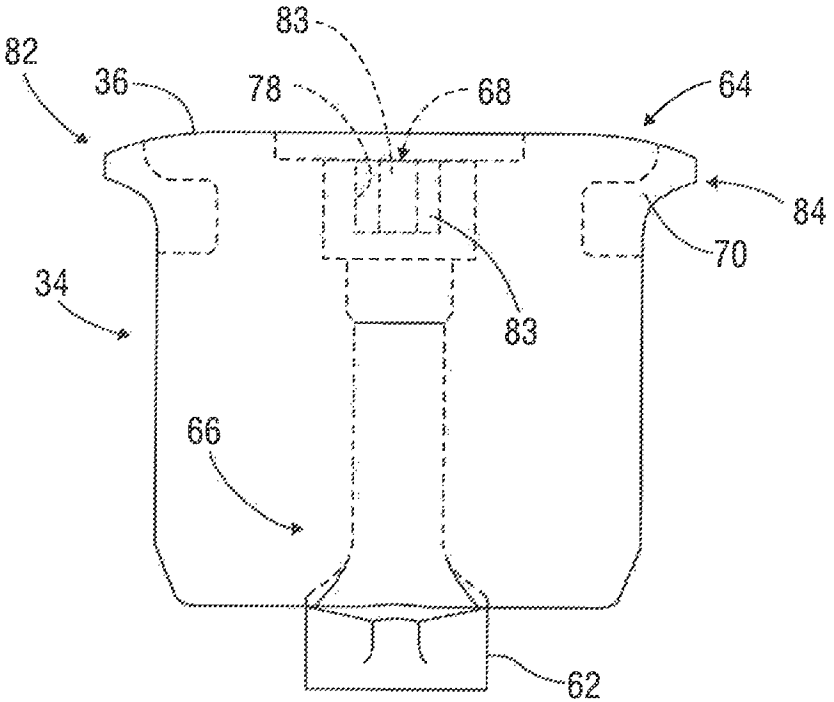
FIG. 9B is a side view of the exemplary attachment pin of FIG. 9A.
Figure 9A:
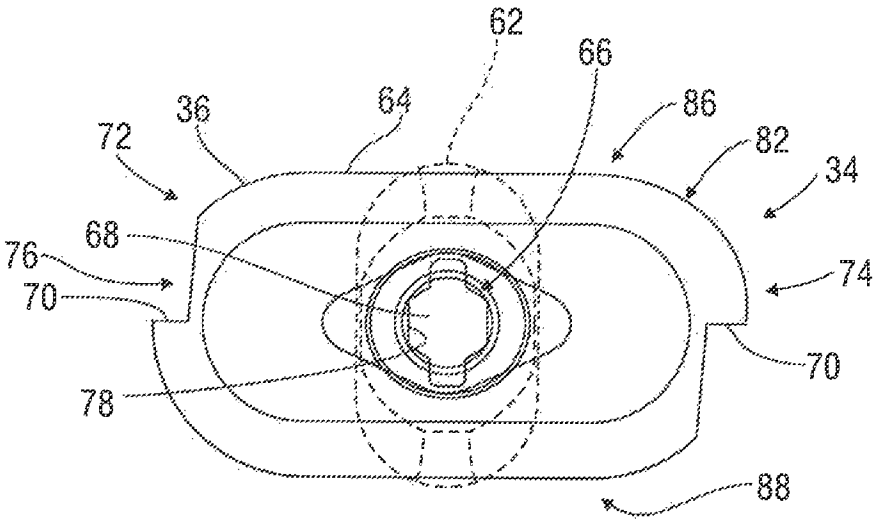
FIG. 9A is a top view of the exemplary attachment pin of FIG. 8A shown in a locked position.

Referring to FIG. 3B, in some embodiments, the attachment pin 34 may rotatably engage one or more ground covers 26 to secure them together. In such instances, the attachment pin 34 may rotatably engage one or more ground covers 26 to secure them together in any suitable manner. For example, the attachment pin 34 may include at least one foot 62 (or other component or part) that is selectively rotatable to secure the subject (e.g. adjacent) ground covers 26 and/or other components together (See e.g. FIGS. 8B, 9B, 10A & 11). In the illustrated embodiment, the attachment pin 34 extends through the hole(s) 32 in the uppermost ground cover(s) 26*a* and into the aligned hole(s) 32 of the lowermost ground cover 26*b* so that the foot 62 is engageable with the bottom surface 29 of the lowermost ground cover 26*b* to secure the attachment pin 34 and ground covers 26 in locking engagement. Various embodiments of rotatable attachment pins 34 (and the feet 62 thereof) are shown in an unlocked position, such as in FIGS. 8A-B, 10A & 11. In this position, the exemplary attachment pins 34 are removable up through the aligned holes 32 of the corresponding ground covers 26. Some exemplary rotatable attachment pins 34 (and the feet 62 thereof) are shown in a locked position, such as in FIGS. 3B, 9A-B. In this position, the exemplary attachment pins 34 are not removable up through the aligned holes 32 of the corresponding ground covers 26. However, the attachment pin 34 may instead rotatably engage a different portion of one or more ground covers 26, may secure the ground covers 26 together into and out of locking engagement in a different manner (e.g. rotation of multiple parts or components, non-rotational, by sliding engagement, clamping engagement, other movement, etc.), have more than one foot 62 which could be at a different location on the pin 34 as shown above, or a combination thereof. Other versions of attachment pins 34 may not have any feet 62. Thus, the present disclosure and attachment pin manipulation power tools 200 and methods as will be shown, described and claimed herein may be used with any suitable type of attachment pin 34, and the present disclosure is not limited to any of the details of the attachment pins 34 provided herein, except and only to the extent as may be expressly recited and explicitly required in a particular claim hereof and only for such claim(s) and any claim(s) depending therefrom.

As shown in FIGS. 8A-11, each exemplary attachment pin 34 includes at least first and second portions 64, 66 that extend into the aligned holes 32 and are at least partially accessible from above the uppermost ground cover 26*a* (e.g. FIG. 3B). In this embodiment, the second portion 66 includes, or is coupled, to the foot (or feet) 62. When seated in the aligned holes 32, the exemplary first portion 64 is not at least substantially rotatable, relative to the ground covers 26*a*, 26*b*, while the second portion 66 is selectively rotatable relative to the first portion 64 and ground covers 26*a*, 26*b* in order to rotate the foot 62 into and out of locking engagement with the lowermost ground cover 26*b* and thus the support surface 16. However, the first and second portions 64, 66 may have any other configuration, components and operation or may not be included.

Referring specifically to FIGS. 8A-9B, in this embodiment, the second portion 66 of the attachment pin 34 is rotatable ninety degrees (90°) in the same direction between (fully) locked and unlocked position. In other words, the foot 62 and second portion 66 of the illustrated attachment pin 34 are rotated ninety degrees (90°) from a locked position to an unlocked position, then rotated another ninety degrees (90°) in the same direction to a locked position, and so on. In this embodiment, the direction of rotation is clockwise, but could similarly be counterclockwise. Furthermore, the exemplary attachment pin 34 may be configured so the second portion 66 or foot 62 is rotatable any other amount (e.g. 30°, 45°, 120°, 180° degrees or more or less) in the same direction or opposite directions between locked and unlocked positions.

Still referring to FIGS. 8A-9B, the second portion 66 of the exemplary attachment pin 34 may be rotatable in any suitable manner. For example, the second portion 66 may include at least one mateable portion 68 that can be releasably mated with an external tool or device from above for rotating the foot 62. The mateable portion 68 may have any desired configuration, form and operation to allow rotational force to be applied to the foot 62 as desired. In this embodiment, the mateable portion 68 includes a hex-shaped, socket-like recess 78 for engagement and rotation by a hex-shaped pin, tool or other device. However, the mateable portion 68 may have a different shape/configuration (square, octagonal, slotted, rectangular, etc.), or instead or also include one or more male mateable portion (e.g. pin 79 (FIGS. 10A-B), blade, spade) of any shape (e.g. hexagonal, square, octagonal, rectangular). Likewise, any other desirable form of mating or rotating mechanism may be used.

In other embodiments, the entire attachment pin 34 may be rotatable (in any desire manner) for releasably securing the adjacent ground covers 26 into and out of locking engagement. During use of such embodiments, the attachment pin 34 (or one or more portions thereof) may be rotated for releasably securing the adjacent ground covers 26 and/or other components in locking engagement in any suitable manner and with any suitable mating or non-mating mechanisms, components or other forms of devices. Accordingly, the present disclosure and attachment pin manipulation power tools 200 and methods as will be shown, described and claimed herein are not limited by the type of attachment pin 34 or the type and configuration of mating mechanisms (if any) used for rotating or otherwise moving the attachment pin 34 or a portion thereof into and out of locking engagement with adjacent ground cover(s) 26, except and only to the extent as may be expressly recited and explicitly required in a particular claim hereof and only for such claim(s) and any claim(s) depending therefrom.

Referring still to FIGS. 8A-9B, the first portion 64 of the attachment pin 34 may have any desired configuration and operation and be formed in any desired shape (e.g. circular, rectangular, square, octagonal, hexagonal, etc.) For example, the first portion 64 may include an enlarged section, or head, 36 at the upper end 84 thereof and which is at least partially accessible from above. In this embodiment, the first portion 64 has a non-circular (e.g. substantially oval) shape. The illustrated head 36 includes an upper outer lip, or flange, 82, a pair of opposing shorts sides, 72, 74 and a pair of opposing long sides 86, 88. At least one shoulder 70 is shown formed in the flange 82 of the illustrated head 36 on opposing sides thereof. For example, each shoulder 70 may be provided at a depression 76 (e.g. notch, cut-out, etc.) formed or provided in the head 36 at the short sides 72, 74 thereof.

Figure 10B:
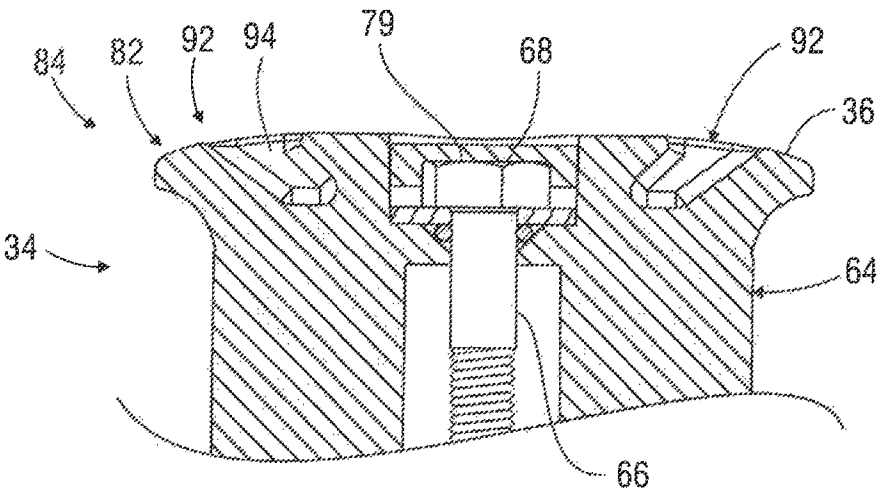
FIG. 10B is a partial cross-sectional view of the exemplary attachment pin of FIG. 10A.
Figure 10A:
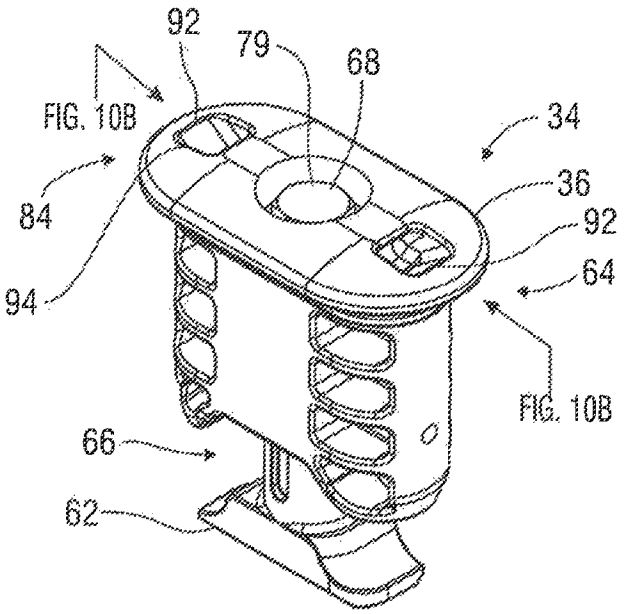
FIG. 10A is a perspective view of another embodiment of an exemplary attachment pin.
Figure 11:
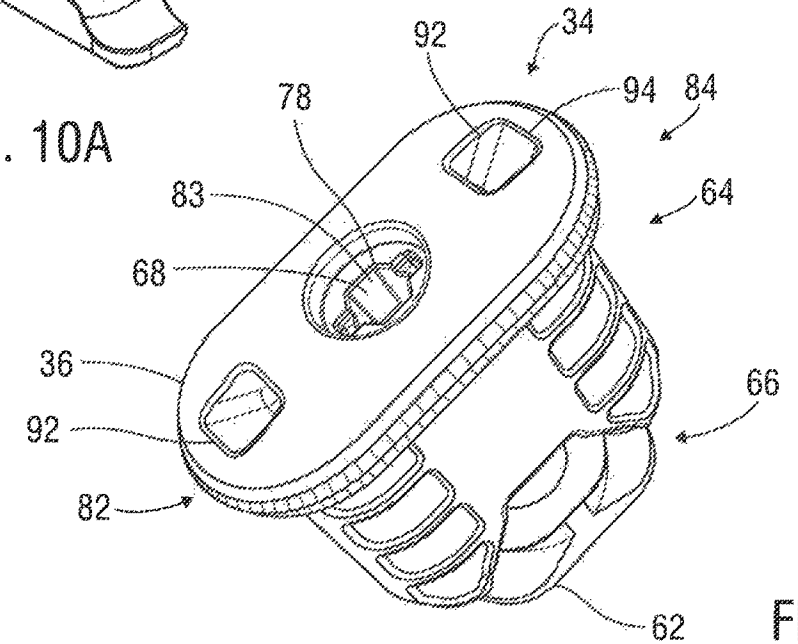
FIG. 11 is a perspective view of another embodiment of an exemplary attachment pin.

Referring now to FIGS. 10A-11, in some embodiments, the attachment pin 34 may include one or more extraction tool receivers 92 extending into the head 36 (or other portion) thereof and engageable by an extraction tool (e.g. fork, gripper, etc.) or other device to remove the attachment pin 34 from the support surface, for any other purpose(s) or a combination thereof. The extraction tool receivers 92 may have any suitable form, configuration, location and operation. In this embodiment, for example, the extraction tool receivers 92 include a pair of angularly oriented extractor recesses 94.

Referring back to FIGS. 3A & 3B, the hole(s) 32 of the exemplary ground covers 26 may have any suitable form, configuration, dimensions and location. For example, each hole 32 may include one or more orifices, notches, openings, cut-outs, cavities or other formations having any desired shape and orientation and within which the attachment pins 34 may be inserted. In this embodiment, the holes 32 have a substantially oval cross-sectional shape, such as to accept the oval-shaped first portion 64 of the illustrated attachment pin 34. Further, an oval-shaped recess, or indentation, 33 is formed in the upper and lower surfaces 27, 29 of each exemplary ground cover 26 around the holes 32 formed therein and configured to at last partially seat the (e.g. oval-shaped) head 36 of the illustrated attachment pin 34. However, the holes 32 may have any other desired cross-sectional shape (e.g. circular, rectangular, hexagonal, square, octagonal, etc.). Further, the present disclosure and attachment pin manipulation power tools 200 and methods as will be shown, described and claimed herein are not limited by the nature of the holes 32 within which the attachment pins 34 are insertable.

Figure 4A:
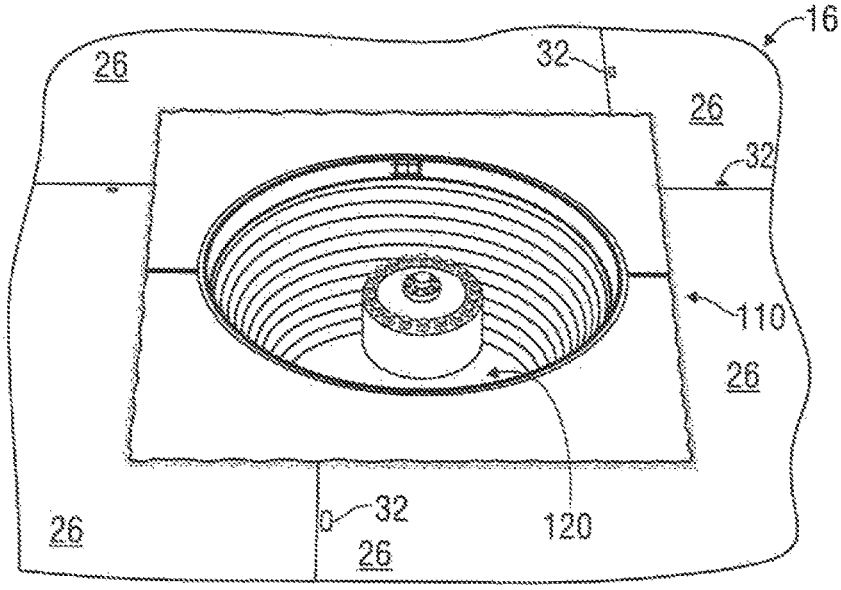
FIG. 4A is a perspective view of a borehole equipped with an embodiment of a borehole edge (e.g. cellar) seal system.
Figure 4B:
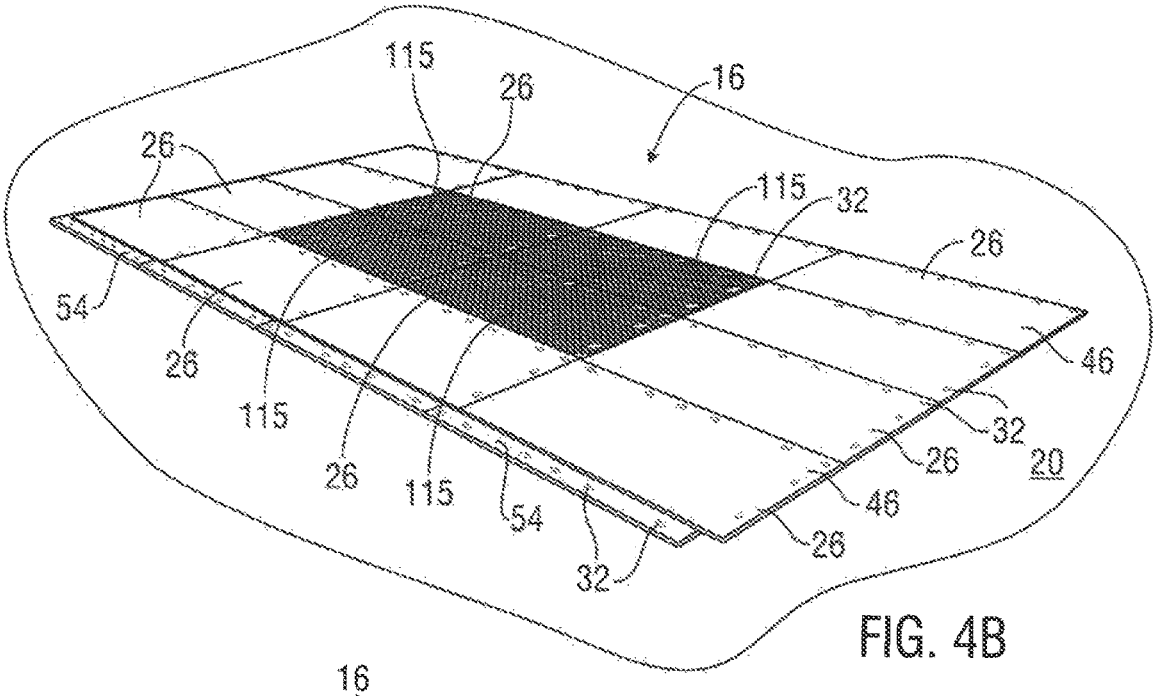
FIG. 4B is a perspective view of an exemplary support surface having multiple mechanically interconnected ground covers, some of which are equipped with an embodiment of an electrically-conductive cover and are electrically coupled together.
Figure 4C:
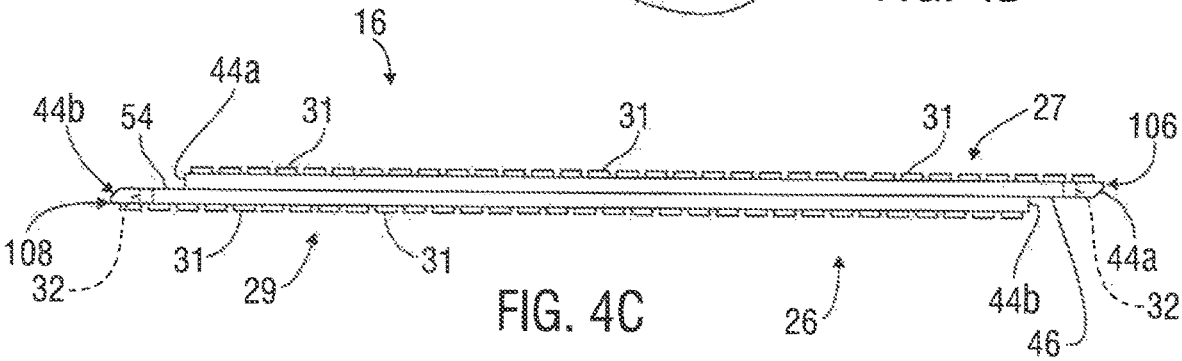
FIG. 4C is a side view of an exemplary ground cover useful in accordance with one or more embodiments of the present disclosure.

As shown in FIG. 4C, in some embodiments, the upper and lower surfaces 27, 29 of the ground cover 26 may include raised traction promoting elements, such as the treads, 31 formed in or extending from the ground cover 26. In some embodiments, the treads 31 may not be included on the underside of each panel 106, 108 of the ground cover 26 that extends beyond the other respective panel 106, 108. In other words, in the illustrated ground cover 26, the upper surface 27 of the ground cover 26 that forms the lower lip 54 (which is the portion of panel 108 that extends beyond panel 106) is absent the treads 31. Thus, the holes 32 on the exemplary upper lips 46 are surrounded by treads 31, while the holes 32 on the illustrated lower lips 54 are not surrounded by treads 31. Of course, when the same ground cover 26 is turned over, the former lower lip 54 (absent treads 31) becomes an upper lip 46 having treads 31. Some exemplary raised traction promoting elements that may be used on the ground covers 26 in some embodiments are shown and described in U.S. Pat. No. 6,511,257. However, the treads 31 may have any other desired form, configuration, location and operation and, in various embodiments, may not be included.

Figure 6:
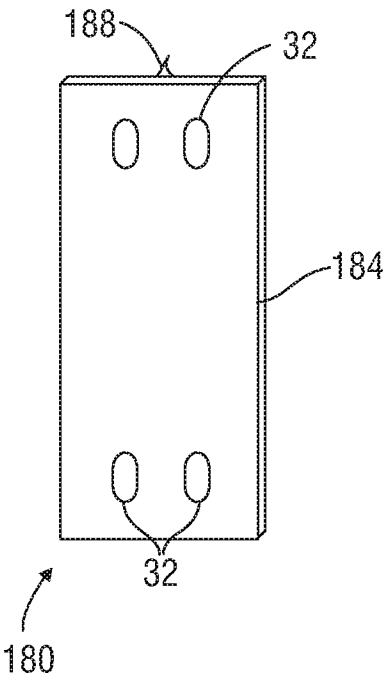
FIG. 6 is a perspective view of an exemplary mating plate useful for connecting various embodiments of ground covers in accordance with one or more embodiments of the present disclosure.
Figure 5:
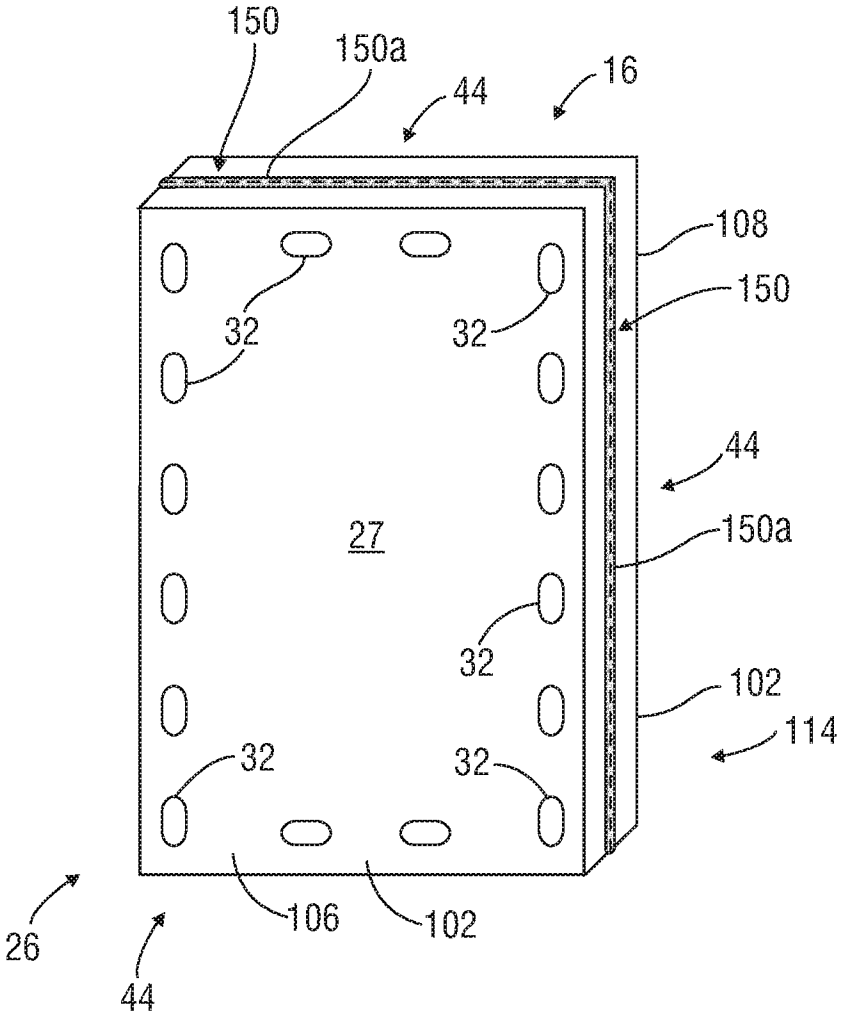
FIG. 5 is a perspective view of yet another embodiment of an exemplary ground cover useful in accordance with one or more embodiments of the present disclosure.
Figure 7:
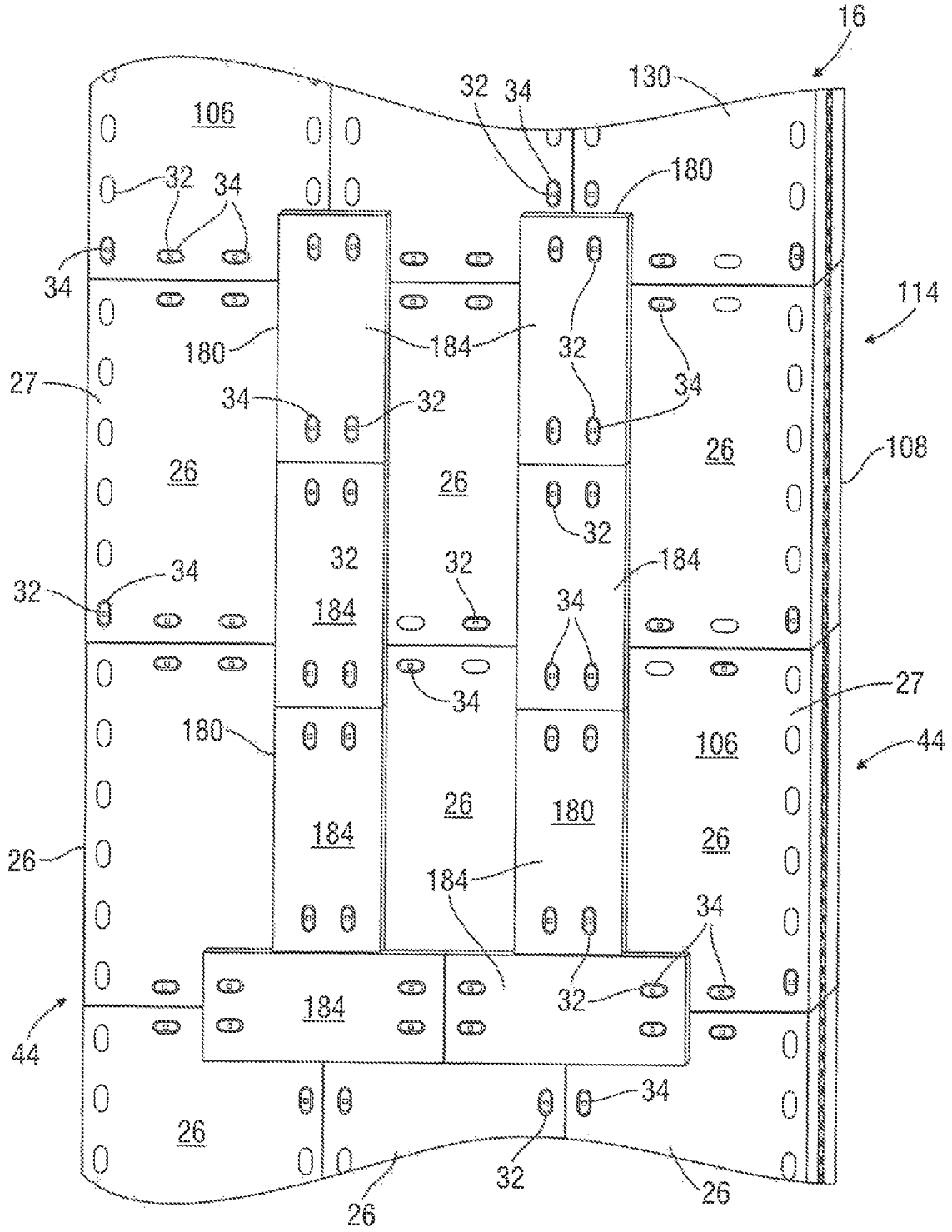
FIG. 7 is an exemplary support surface that includes numerous of the exemplary ground covers of FIG. 5 and exemplary mating plates of FIG. 6 in accordance with one or more embodiments of the present disclosure.
Figure 8B:
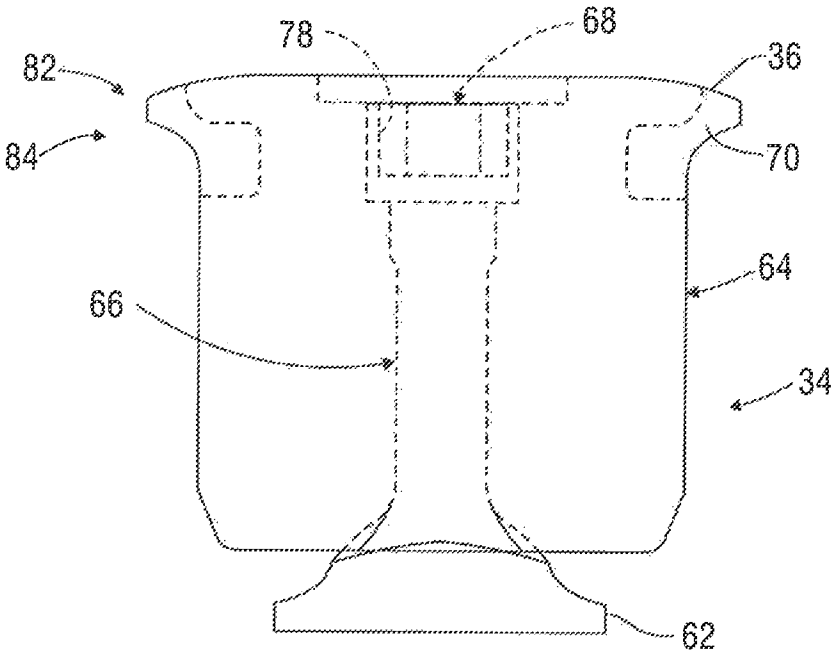
FIG. 8B is a side view of the exemplary attachment pin of FIG. 8A.
Figure 8A:
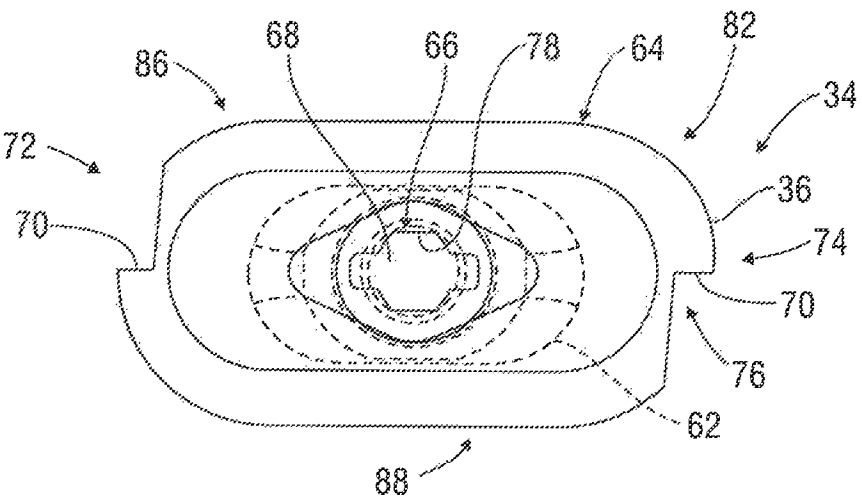
FIG. 8A is a top view of an embodiment of an exemplary attachment pin shown in an unlocked position.

Referring now to FIGS. 5-7, one example of another form of component with which attachment pins 34 and the attachment pin manipulation power tools 200 and methods (as will be shown, described and claimed herein) may be used is the illustrated ground cover connector 180. The exemplary ground cover connectors 180 are useful to interconnect the ground covers 26, or couple one or more ground covers 26 with one or more other components. For example, the ground cover connectors 180 may be particularly useful with ground covers 26 lacking protruding lips 40 (e.g. non-stepped-configuration ground covers 26; see e.g. FIG. 5).

When included, the ground cover connectors 180 may have any suitable form, configuration, construction and operation. In this embodiment, the ground cover connectors 180 are mating plates 184. The mating plates 184 may be constructed of the same material as the ground covers 26 (e.g. thermoplastic material, rubber, plastic, fiberglass, fiber-reinforced plastic, recycled rubber or other material, wood, steel, steel-framed wood, aluminum or combination thereof) or any other suitable material. In this example, the mating plates 184 are steel, have dimensions (e.g. length, width, thickness) smaller than the ground covers 26 and include holes (e.g. attachment pin holes) 32 for receiving attachment pins 34, similarly as described above with respect to the ground covers 26.

As shown in FIG. 7, the exemplary mating plates 184 are configured to be placed atop adjacent ground covers 26 in the support surface 16 and releasably interconnected therewith with attachment pins 34. In this example, the mating plates 184 may be positioned lengthwise or widthwise. If desired, the ground cover connectors 180 may include protruding alignment tabs, or fins, 188, such as to extend between adjacent ground covers 26 and assist in aligning the connectors 180 relative to the ground covers 26 (e.g. FIG. 6). However, the ground cover connectors 180 are not required and, in many embodiments, may not be included.

Referring back to FIG. 2, in some embodiments, a gap 22 may be formed between adjacent edges 44 of adjacent interconnected ground covers 26 in the support surface 16, and one or more seal members 10 may be included therein. For example, the seal member(s) 10 may provide a liquid-tight seal in the gap 22 between adjacent ground covers 26 to prevent liquid introduced onto the support surface 16 from seeping or flowing between ground covers 26 and/or other components and/or below the support surface 16. Some embodiments of seal members 10 that may be used in the gaps 22 are disclosed in U.S. Pat. No. 9,212,746 to McDowell, issued on Dec. 15, 2015 and entitled "Apparatus and Methods for Sealing Between Adjacent Components of a Load-Supporting Surface", U.S. Pat. No. 9,499,946 issued on Nov. 22, 2016 and entitled "Method of Sealing Between Adjacent Components of a Load-Supporting Surface With at Least One Closed-Cell Compressible Rubber Seal", U.S. Pat. No. 9,637,871 issued on May 2, 2017 and entitled "Load-Supporting Surface with Actively Connected Gap Seals and Related Apparatus and Methods" and U.S. Pat. No. 9,404,227 issued on Aug. 2, 2016 and entitled "Load-Supporting Surface with Interfacing Gap Seal Members and Related Apparatus and Methods", as well as related patents and patent applications, all of which have a common Assignee as the present patent and the entire contents of which are hereby incorporated by reference herein in their entireties. However, seal members 10 are not required and, in many embodiments, may not be included.

The support surface 16 may include or be associated with other components, and the seal member(s) 10 may also or instead be used between any combination of ground covers 26 and other components associated with the support surface 16. Some examples of such additional components that may be useful in connection with support surfaces 16, such as berm members, spacers, drive-over barriers, liquid drain assemblies, etc., are shown and disclosed in U.S. Pat. No. 9,039,325.

In some instances, such as shown in FIG. 4A, the support surface 16 may be used around an underground borehole 120 (e.g. a cellar), such as with the use of a borehole edge seal system 110. Various embodiments of exemplary borehole edge (e.g. cellar) seal systems 110 are shown and described in U.S. Pat. No. 9,745,815 entitled "Apparatus and Methods for Sealing Around the Opening to a Cellar Formed Around a Hydrocarbon Exploration or Production Well" to McDowell et al. and issued on Aug. 29, 2017 and U.S. Pat. No. 9,790,758 entitled "Apparatus and Methods for Mechanically Coupling a Sealing System Around the Opening to an Underground Borehole" to McDowell et al. and issued on Oct. 17, 2017, as well as related patents and patent applications, all of which have a common Assignee as the present patent and the entire contents of which are hereby incorporated by reference herein in their entireties.

In various embodiments, such as shown in FIG. 4B, one or more electrically-conductive covers 115 may be used in connection with the support surface 16. Various embodiments of electrically-conductive covers are shown and described in U.S. Pat. Nos. 9,337,586, 9,368,918, 9,735,510 and 9,972,942.

It should be understood that none of the particular embodiments or features described or shown in FIGS. 1-11, or in the above-referenced patents and patent applications, are required for, or limiting upon, the present disclosure or the appended claims, except and only to the extent as may be expressly recited and explicitly required in a particular claim hereof and only for such claim(s) and any claim(s) depending therefrom. Moreover, the type, configuration, construction and operation of support surface 16, ground cover(s) 26, attachment pin(s) 34 and related components are not limiting upon present disclosure and the appended claims, unless and only to the extent as may be expressly recited in a particular claim and only for that claim and its dependent claims. Moreover, the attachment pin manipulation power tools 200 and methods provided herein may be used with other components. Thus, any suitable or desired support surface 16, ground covers 26, attachment pins 34 and/or other components may be used with the attachment pin manipulation power tools 200 and methods provided herein.

Referring now to FIGS. 12A-14, embodiments of systems, apparatus and methods for manipulating an attachment pin 34 used in connection with a support surface 16 (and/or other components) will now be described. In this embodiment, the illustrated attachment pin manipulation power tool 200 is useful for unlocking a releasable attachment pin 34 by disengaging it from at least first and second ground covers 26*a*, 26*b* (and/or other components) of the support surface 16. The illustrated power tool 200 has a front (lower) end 204 and a rear (upper) end 206 and includes at least one carrier 210, at least one gripper 220, at least one rotator 230 and at least one power-driven actuator 240. However, some embodiments may include only gripper(s) 220 or rotator(s) 230 and may not include a power-driven actuator 240. As used herein and in the appended claims and understood by persons of ordinary skill in the art, the term "gripper" is the name for and refers to a tool or component that grasps, holds or retains one or more subject items or one or more portions thereof. As used herein and in the appended claims and understood by persons of ordinary skill in the art, the term "rotator" is the name for and refers to a tool or component that rotates one or more subject items or one or more portions thereof.

The exemplary carrier 210 includes a front end 212 and a rear end 214 (e.g. FIG. 16A) and is selectively positionable over the support surface 16 and attachment pin 34. The exemplary gripper(s) 220 and rotator(s) 230 are coupled to, or carried by, the carrier 210 proximate to the front end 212 thereof. In this embodiment, at least one gripper 220 is selectively moveable relative to the carrier 210 between at least one engaged position and at least one disengaged position relative to the attachment pin 34. In the engaged position(s), the exemplary gripper(s) 220 are configured to grip at least the first portion(s) 64 of the attachment pin 34 (e.g. FIGS. 10A-11), and in the disengaged position(s) the gripper(s) 220 are configured to be disengaged from the attachment pin 34. However, one or more grippers 220 may be configured to engage a different part of the attachment pin 34. Thus, the present disclosure is not limited to grippers 220 that grip only the first portion 64 of the attachment pin 34. Moreover, in other embodiments, the gripper(s) 220 may engage the pin 34 in a different manner.

Still referring to FIGS. 12A-14, the exemplary rotator 230 is distinct from the illustrated gripper(s) 220 and engageable with at least the second portion 66 of the attachment pin 34 (e.g. FIG. 10A-11). In this embodiment, the rotator(s) 230 are selectively rotatable relative to the carrier 210, the gripper(s) 220, the first portion 64 of the attachment pin 34 and the ground covers 26*a*, 26*b* in order to rotate the second portion 66 of the attachment pin 34 from a locked to an unlocked position (e.g. 90°) relative to the first and second ground covers 26*a*, 26*b* (and, in some embodiments, from an unlocked to a locked position relative to the ground covers 26*a*, 26*b*). However, in other embodiments, one or more rotators 230 may rotate a different part of the attachment pin 34, one or more rotators 230 may not be distinct from one or more grippers 220 and/or may not be rotatable relative to any among the gripper(s) 220, the carrier 210, the first portion 64 of the attachment pin 34 and the ground covers 26*a*, 26*b*, or a combination thereof. For a few examples, the tool 200 may include one or more rotators 230 coupled to or integral with one or more grippers 220, one or more grippers 220 may rotate along with the rotator(s) 230, one or more grippers 220 may both grip and rotate the attachment pin 34 without the use of any separate rotators 230, one or more rotators 230 may grip and rotate the attachment pin 34 without the use of any separate grippers 220, the rotators and/or grippers 220 may be integral with the carrier 210 and move concurrently therewith, or a combination thereof.

The illustrated power-driven actuator 240 is associated with the carrier 210, operatively coupled to the rotator(s) 230 and configured to cause selective rotation of the rotator(s) 230. In some embodiments, the exemplary power-driven actuator 240 may also or instead be operatively coupled to at least one gripper 220 to (i) selectively move one or more grippers 220 from at least one engaged position to at least one disengaged position and/or vice versa, (ii) selectively move the gripper(s) 220 axially relative to the carrier 210 toward the rear end 206 of the tool 200, such as to extract the attachment pin 34 from the first and second ground covers 26*a*, 26*b* when the grippers 220 are gripping the pin 34 and the pin 34 has been unlocked, (iii) for any other desired purpose(s), or (iv) a combination thereof. As used herein and in the appended claims, the terms "axial", "axially" and variations thereof mean generally longitudinally relative to the tool 200, along or relative to the longitudinal axis 202 of the tool 200 or along or relative to an axis that is parallel or substantially parallel to the longitudinal axis 202 of the tool 200.

Still referring to FIGS. 12A-14, the power tool 200 of this embodiment is also useful for selectively, releasably locking the attachment pin 34 by securing it into locking engagement with at least the first and second ground covers 26*a*, 26*b* (and/or other components) of the support surface 16. For example, the rotator(s) 240 may be configured to selectively rotate at least the second portion 66 of the attachment pin 34 (e.g. 90°) from at least one unlocked position to at least one locked position relative to the ground covers 26*a*, 26*b* and thereby releasably couple the ground covers 26*a*, 26*b* together. While the present embodiment will be described herein as providing both of the above-mentioned attachment pin 34 manipulation capabilities (locking and unlocking the pin 34 relative to the ground covers 26), this embodiment, as well as variations thereof and other embodiments may be configured for only one or the other of these capabilities, may include additional capabilities (e.g. picking up the attachment pin 34 and/or inserting it into the attachment pin holes 32, such as before locking the attachment pin 34) or a combination thereof. For example, the illustrated tool 200 (as well as other embodiments of the tool 200) may be configured for only securing the attachment pin 34 into, or out of, locking engagement with at least the first and second ground covers 26*a*, 26*b* or other components. Thus, the present disclosure and appended claims should not be limited to an attachment pin manipulation power tool 200 capable of both locking and unlocking an attachment pin 34 merely because the illustrated embodiment possesses both capabilities, unless and only to the extent as may be expressly recited and explicitly required in a particular claim hereof and only for such claim(s) and any claims depending therefrom.

Figure 15:
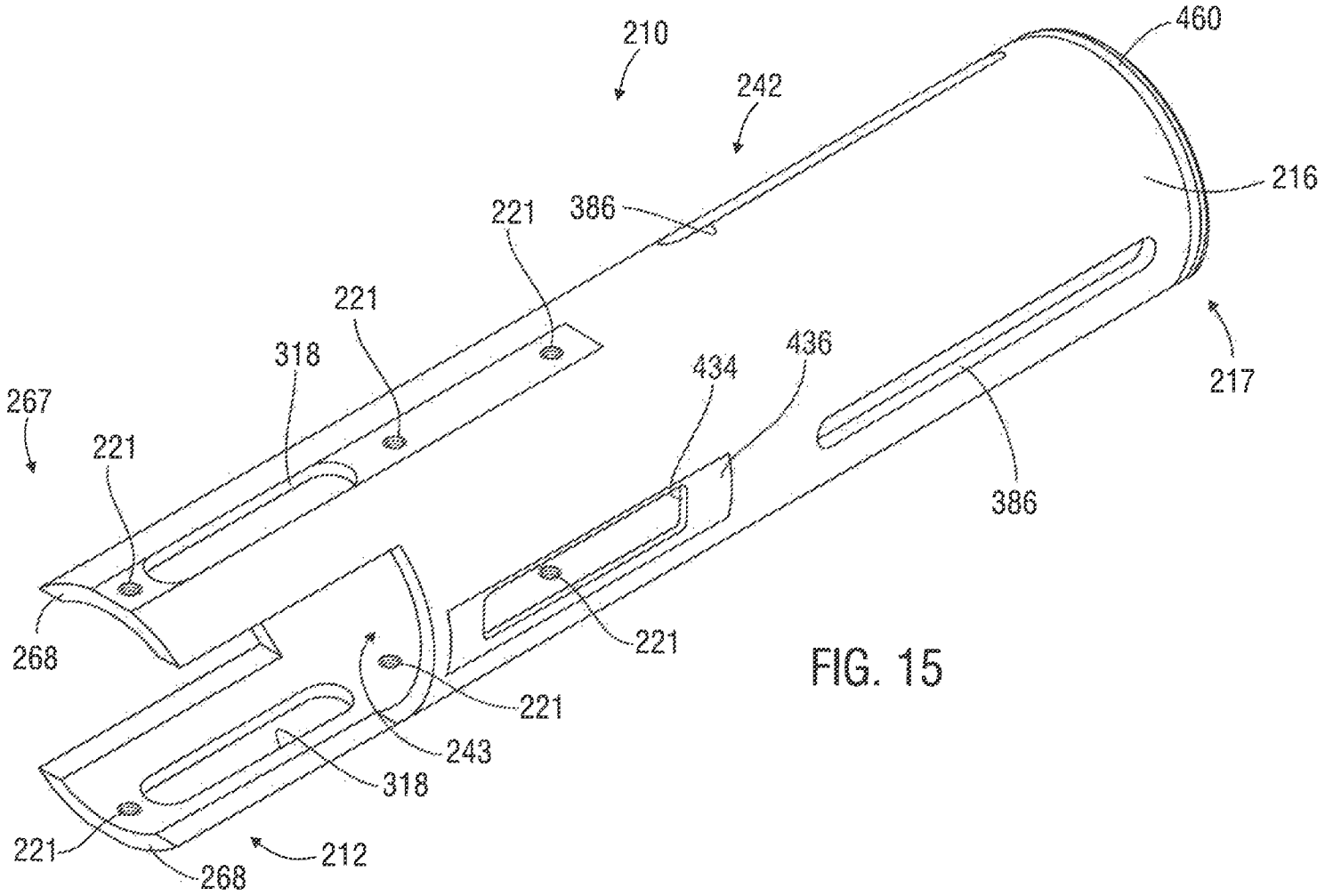
FIG. 15 is an embodiment of the main body of the carrier of the exemplary power tool of FIGS. 12A-B in accordance with one or more embodiments of the present disclosure.

Still referring to the embodiment of FIGS. 12A-14, the carrier 210 may have any suitable form, configuration, construction, components and operation. For example, the illustrated carrier 210 includes a main body 216 and at least one handle 218. In this embodiment, the exemplary main body 216 is a longitudinally-extending, cylindrical sleeve 242 (e.g. FIG. 15) and includes a longitudinal bore 243 extending therethrough. The front end 267 of the illustrated main body 216 is configured to be positioned over the attachment pin 34 during pin manipulation operations. In some instances, one or more front edges 268 (or other surfaces) of the main body 216 may be configured to abut, or rest upon, the upper surface 27 of the uppermost ground cover 26*a* at least partially around the attachment pin 34 to orient the tool 200 at least substantially upright to initiate pin manipulation operations, and/or for any other purpose. If desired, the tool 200 may be configured and the main body 216 shaped so that such positioning of the front edges 268 thereof on the ground cover 26*a* will align the gripper(s) 220 and rotator(s) 230 in desired positions over the respective corresponding parts of the pin 34. In some embodiments, the front edges 268 of the main body 216 may essentially straddle the opposing long sides 86, 88 of the head 36 of the first portion 64 of the attachment pin 34 (e.g. FIGS. 8A-9B).

Referring now to FIGS. 12A-B & 16A-B, the handle 218 on the exemplary carrier 210 is a fixed position handle 218*a* coupled to the main body 216, configured to be gripped by an operator (e.g. human, robot, vehicle, other equipment, etc.) and useful to assist in positioning and moving the tool 200 and/or for any other purpose(s). For example, the handle 218*a* may be rigidly, releasably coupled to one or more elongated mounting brackets 244 (e.g. beam, rod, etc.) rigidly coupled to the main body 216 (e.g. with one or more bolts or other connectors 219 through aligned orifices 221) so the position of the handle 218*a* is "fixed" relative to the main body 216 and the handle 218*a* and main body 216 move together.

In this embodiment, the illustrated carrier 210 includes a distinct mounting bracket 244 coupled to respective opposing sides of the main body 216. Each illustrated mounting bracket 244 includes at least one coupling point 245 (e.g. proximate to the rear end 248 thereof) for releasably securing the handle 218*a* thereto (e.g. with one or more bolts or other connectors). For example, each mounting bracket 244 may include three (or more or less) alternate, spaced-apart, coupling points 245 so that the handle 218*a* may be positioned in any among multiple alternate (e.g. three) positions (e.g. at different heights) on the carrier 210 on either side of the carrier 210 (e.g. for the operator's convenience or other purpose(s)). In some instances, a distinct fixed-position handle 218*a* may be coupled to the mounting brackets 244 on each side of the carrier 210. However, any other desired number of fixed position handle(s) 218*a* (e.g. 1, 2, 3, 4 etc.) may be coupled directly to, or integral with, the main body 216 (or other component(s)) or indirectly coupled to the main body 216 (or other component(s)) in any suitable manner. Further, the mounting bracket(s) 244 (or other handle coupling component(s)), when included, may be connected to the main body 216 at any other desired location(s) and/or on only one side of the main body 216, have more or less than three coupling points 245 (e.g. 1, 2, 4, 5, etc.) provided at any location thereon (e.g. intermediate to its ends, side-by-side), or a combination thereof.

If desired, one or more lanyards 316 (straps, bridles, etc.) may be releasably coupled (e.g. with one or more bolts or other connectors) to one or both mounting brackets 244 (or other part of the tool 200) to support a tool-carrier sling, webbing or other component (not shown). For example, the lanyard 316 may include or carry a sling, webbing, harness or the like between its ends so that an operator can wrap it over his/her shoulder(s) (or other part) and at least partially support the tool 200, such as to free his/her/its hands without having to lay the tool 200 down, or for any other purpose(s). In this embodiment, the lanyard 316 is connectable at its ends to the respective mounting brackets 244 or other component to help bear the weight of the tool 200 (e.g. during use or transport thereof) and/or for any other purpose(s). However, a lanyard 316 or like component is not required. Moreover, the exemplary carrier 210 is not limited to the above configuration of parts. For example, the main body 216 may have a rectangular, triangular, hexagonal square, octagonal, or other non-circular cross-sectional shape, may include one or more side plates, other components or a combination thereof. Furthermore, the carrier 210 may not include a main body 216, at least one handle 218, one or more mounting brackets 244 or a combination thereof.

Referring back to FIGS. 12A-14, in this embodiment, the carrier 210 is elongated and designed to be oriented by an operator (e.g. human, robot, vehicle, other equipment, etc.) in an at least substantially upright position during most, or all, of the operations associated with manipulating the attachment pin 34. For example, to initiate attachment pin 34 manipulation operations with the illustrated tool 200, the carrier 210 may be lowered into position over the attachment pin 34 until it at least partially rests upon the uppermost ground cover 26*a* (or other component of the support surface 16), such as described above. As used herein and in the appended claims, the terms "elongated" and variations thereof means, includes and refers to an item having an overall length (during the intended use of the item) that is greater than its average width. As used herein and in the appended claims, the terms "upright" and variations thereof means, includes and refers to perfectly or substantially vertical or angled (not perfectly vertical) in any non-horizontal orientation. However, the carrier 210 may not be elongated and/or have a different orientation during use of the tool 200 and a different technique may be used to initiate operations.

Figure 17:
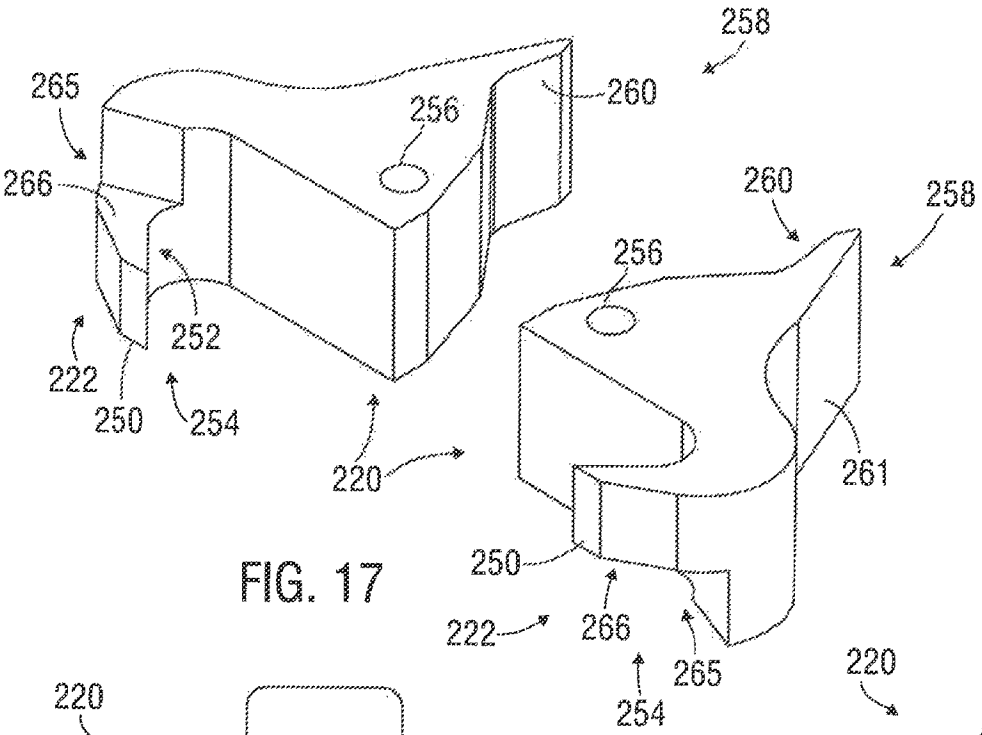
FIG. 17 is a perspective view of the exemplary grippers of the power tool of FIGS. 12A-B in accordance with one or more embodiments of the present disclosure.
Figure 18C:
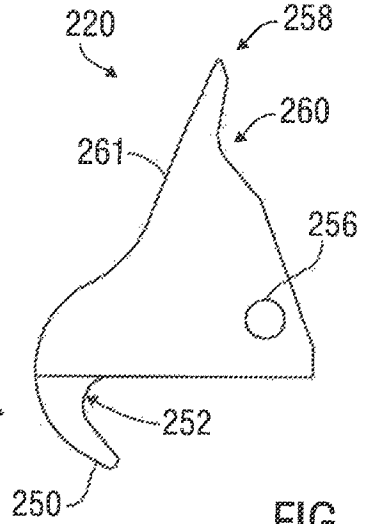
FIG. 18C is a side view showing a second side of the exemplary gripper shown in FIG. 17.

The gripper(s) 220 may have any suitable form, configuration, construction, components and operation and may grip or otherwise engage the attachment pin 34 in any suitable manner and for any desired purpose(s). For example, the grippers 220 may engaged the pin 34 to retain the first portion 64 of the pin 34 in a substantially fixed position relative to the second portion 66 of the pin 34 during rotation of the second portion 66 (e.g. by the rotator(s) 230), allow the pin 34 to be extracted or moved away from the support surface 16 or both. Referring to FIGS. 17-18C, for example, two grippers 220 are shown each including at least one portion (e.g. claw, clip, clamp, rod, pin, finger, tube, jaw, or the like) for gripping the attachment pin 34. In this embodiment, each gripper 220 includes a claw 222 having at least one tooth 250 and gripping surface 252 disposed at the front end 254 of the gripper 220 and configured to grip the attachment pin 34 as desired. Thus, the illustrated tool 200 is shown having first and second spaced-apart claws 222, each including an inwardly projecting tooth 250 and inwardly facing gripping surface 252. If desired, the teeth 250 and gripping surfaces 252 may be shaped and angled to match the contour of a typical, or any particular, attachment pin 34. In the present embodiment, the claws 222 are configured so that their respective teeth 250 and gripping surfaces 252 will grip opposing short sides 72, 74 of the head 36 of the exemplary attachment pin 34 (e.g. FIGS. 8A-9B). However, the claws 222 may not include one or more teeth 250 and/or gripping surfaces 252 or the gripper(s) 220 may not include any claws 222. In some embodiments, one or more of the grippers 220 may have a different configuration of parts, operation or form (e.g. clamp, jaw, clip, clamp, rod, pin, tube or the like) as described above and/or may grip a different portion of the pin 34. For example, each gripper 220 may include one or more angled fingers, such as to grip or engage the attachment pin 34 at one or more extraction tool receivers 92 (e.g. recesses 94, FIGS. 10A-11). For a few other examples, only one gripper 220 may be included to grip or otherwise engage the attachment pin 43 as desired, or the tool 200 may include more than one gripper 220 but only one of which is moveable.

Figure 20:
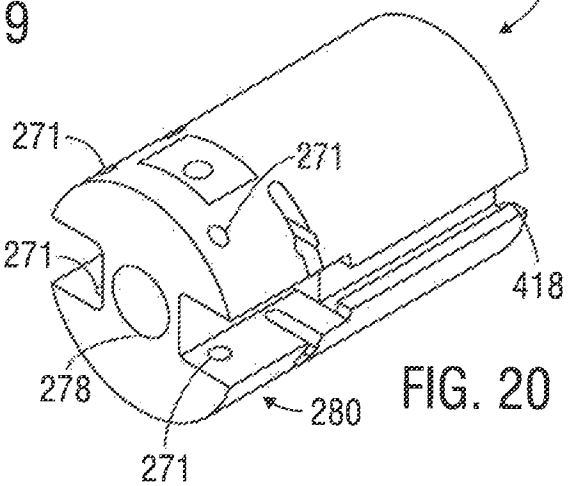
FIG. 20 is a perspective view the exemplary sliding body, or nose, of the power tool of FIGS. 12A-B in accordance with one or more embodiments of the present disclosure.
Figure 21C:
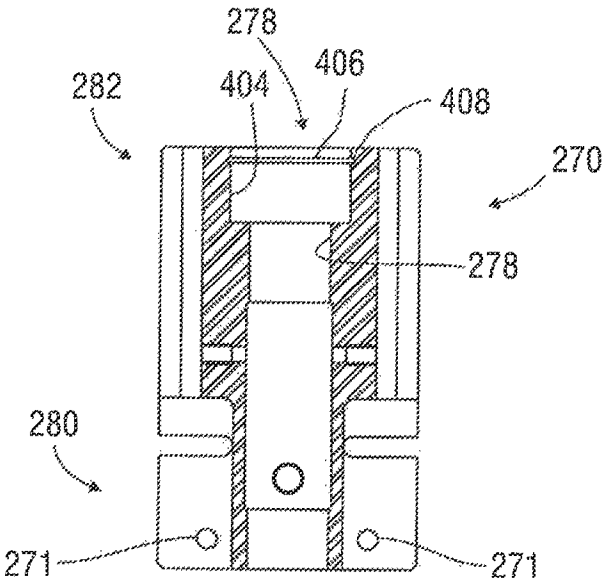
FIG. 21C is a partial cross-sectional view of the exemplary nose of FIG. 21A taken along a transverse axial plane.
Figure 21B:
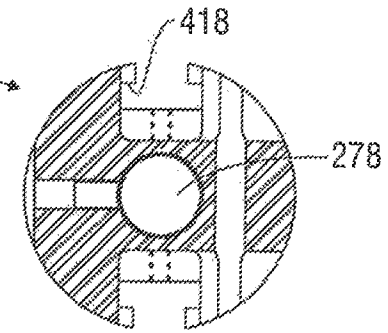
FIG. 21B is a cross-sectional view of the exemplary nose of FIG. 21A taken along lines FIG. 21B-FIG. 21B.
Figure 21A:
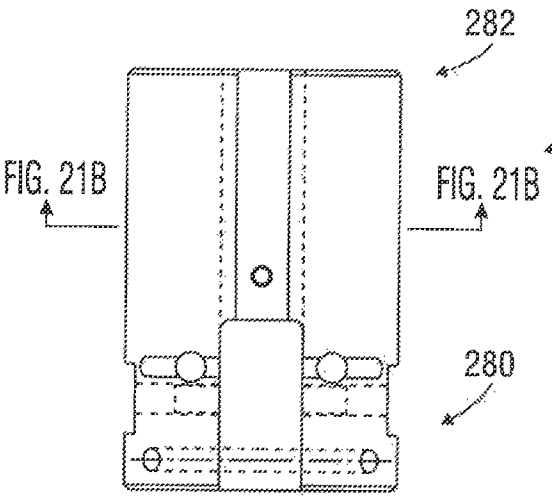
FIG. 21A is a top view of the exemplary nose of FIG. 20.

Referring back to FIGS. 12A-B & 16A-B, one or more of the gripper(s) 220 may be moveable between engaged and disengaged positions in any suitable manner. For example, one or more of the grippers 220 may move inwardly relative to the carrier 210 (and attachment pin 34) into at least one engaged position and outwardly relative to the carrier 210 (and attachment pin 34) into at least one disengaged position. In the present embodiment, the grippers 220 are each pivotably moveable into at least one engaged position and outwardly into at least one disengaged position. For example, each illustrated gripper 220 is pivotably coupled to a sliding body, or nose, 270 positioned at or proximate to the front end 212 of the carrier 210. In this embodiment, a pivot pin 272 is seated in the nose 270 (e.g. at orifices 271, FIG. 20) and extends through an orifice 256 (e.g. FIG. 17) formed in each gripper 220 so that the gripper 220 is rotatable at least partially around the associated pivot pin 272.

However, any other suitable arrangement may be provided to allow the gripper(s) 220 to move between engaged and disengaged positions or otherwise engage and disengage the attachment pin 34 as desired. For example, one or more pivot pin 272 may be part of, or coupled, to the gripper 220 and moveable therewith relative to the nose 270. For another example, a nose 270 may not be included (e.g. the gripper(s) 220 may be coupled directly to the carrier 210, rotator 239 or other component(s)). For other examples, the gripper 220 may include one or more protrusions or the like that rotate in one or more associated dimples, or orifices, or other features of the nose 270 or other components at or proximate to the front end 212, or other part, of the carrier 210. Other embodiments may include one or more grippers 220 that engage the attachment pin 34 as desired in a non-pivoting manner (e.g. sliding, shifting, encapsulating). In various embodiments, the gripper(s) 220 may be rigidly coupled to or integral with the carrier 210 or other component and configured to engage the attachment pin 34 concurrently therewith. In some embodiments, only one gripper 220 or more than two grippers 220 may be moveable into and/or out of engagement with the attachment pin 34, one or more grippers 220 may be stationary, or a combination thereof.

In the present embodiment, the grippers 220 are also spring-loaded into one or more engaged positions. As used herein and in the appended claims, when a component is "spring-loaded" or "spring-biased", the component is arranged to be pressed in one general direction by one or more springs and/or other mechanisms, and can be moved back (in the opposite general direction) upon the application of force(s) to the component sufficient to overcome the pressing forces of the spring(s) and/or other mechanism(s). Spring(s) and/or other mechanisms mentioned herein may be referred to as "biasing" the associated component(s) or providing "biasing force(s)" upon or to the associated component(s). The use of the terms "spring-loaded", "spring-biased", "biasing", "biasing force(s)" and variations thereof herein and in the appended claims does not require the use of one or more actual springs to provide the biasing force(s); any desired or suitable mechanism or arrangement of parts may be used, except and only to the extent as may be expressly recited and explicitly required in a particular claim hereof and only for such claim(s) and any claim(s) depending therefrom. In other embodiments, only one gripper 220, or more than two grippers 220, may be spring-loaded into an engaged position, one or more of the grippers 220 may be moveable into the engaged position in a different manner (e.g. not spring-loaded, by operation of the power-driven actuator 240 or other component, etc.) or a combination thereof.

Still referring to FIGS. 12A-B & 16A-B, the exemplary grippers 220 may be spring-loaded into the engaged position in any suitable manner. For example, an outwardly-biased, biasing pin 274 may bear upon an inner face 260 on the rear end 258 of each respective gripper 220 (e.g. FIG. 17), biasing the rear end 258 outwardly relative to the carrier 210 and nose 270, the front end 254 of the gripper 220 inwardly and, thus, the gripper 220 into at least one engaged position. Each exemplary biasing pin 274 is biased outwardly relative to the nose 270 via two biasing springs 276 seated in and extending (e.g. laterally) from the nose 270. In this embodiment, the biasing springs 276 are coil springs. When the exemplary tool 200 is lowered into engagement with the attachment pin 34 such as explained above and/or below, outward forces that may be placed upon the front end 254 of a gripper 220 (e.g. as one or more teeth 250 of the gripper 220 abuts and moves around part of the attachment pin 34) will be met with resistance from the biasing springs 276 and biasing pin 274 acting upon the inner face 260 of the rear end 258 of the gripper 220 to assist in the proper movement and seating of the gripper 220 relative to the pin 34. However, the biasing pin 274 and biasing springs 276 may be arranged in a different configuration to act on any desired part of the gripper 220, more than one biasing pin 274 or a different quantity of biasing springs 276 or other biasing members (1, 3, 4 etc.) may bias the associated gripper 220 into one or more engaged positions or a combination thereof. Moreover, one or more of any other type of springs or biasing mechanisms (e.g. Bellville washers) may be used to bias one or more grippers 220 into one or more engaged or disengaged positions or this feature may not be included.

One or more of the exemplary grippers 220 may grip the attachment pin 34 in any suitable manner. Referring again to FIGS. 12A-14, as the illustrated tool 200 is lowered over the attachment pin 34 to initiate attachment pin manipulation operations, such movement and/or the weight of the tool 200 should typically force the front end 254 of one or more of the grippers 220 (spring-loaded closed) to bear upon the upper end 84 of the attachment pin 34. The continued downward movement (and/or weight) of the exemplary tool 200 and force of the gripper(s) 220 on the attachment pin 34 will typically push the front end 254 of the gripper(s) 220 outwardly and around the flange 82 (e.g. FIGS. 8A-9B) of the head 36 of the attachment pin 34. Since the illustrated grippers 220 are spring-loaded inwardly, they will typically generally stay engaged or pressed against the flange 82, such as described above. At or near the end of the downward movement of the exemplary tool 200 (during initiation of attachment pin manipulation operations), the illustrated grippers 220 will then typically snap or settle into gripping engagement with the attachment pin 82 around the flange 82 of the head 36 thereof. However, any other techniques and components may be used for one or more of the grippers 220 to grip any type of attachment pin 34, as desired.

In the engaged position, the exemplary gripper(s) 220 are configured to firmly grasp the attachment pin 34 sufficient to assist in anchoring the carrier 210 to the (at least substantially non-rotational) first portion 64 of the attachment pin 34, allow the pin 34 to be lifted or extracted from the support surface 16 (when the attachment pin 34 is unlocked from the support surface 16), for any other purpose(s) or a combination thereof. During typical operations, since the first portion 64 of the exemplary attachment pin 34 is at least substantially non-rotatable relative to the support surface 16, the exemplary gripper(s) 220 will assist in maintaining the carrier 210 in a substantially fixed position relative to the support surface 16 as the rotator(s) 230 apply rotational forces to the second portion 66 of the attachment pin 34 such as described below, assist in preventing substantial (or more than negligible) rotation of the carrier 210 during rotation of the second portion 66 of the attachment pin 34, for any other purpose(s) or a combination thereof. However, in other embodiments, the grippers 220 may grip a different portion of the attachment pin 44 (other than the first portion 64), not assist in anchoring the carrier 210 to the first portion 64 of the attachment pin 34 and/or lifting, or extracting the pin 34 from the support surface 16 when the attachment pin 34 is unlocked from the support surface 16.

Figure 46:
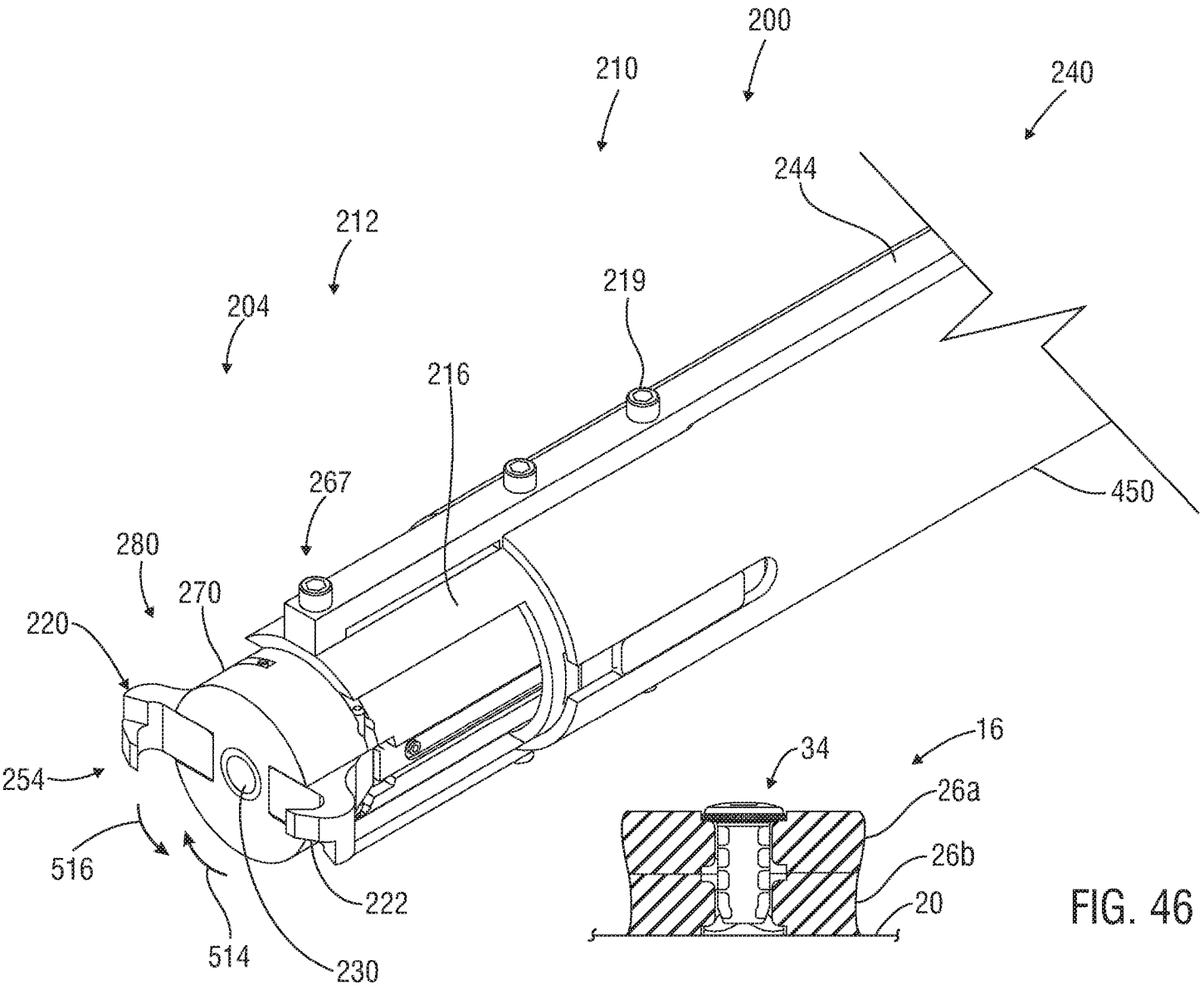
FIG. 46 is a perspective view of part of another embodiment of an attachment pin manipulation power tool in accordance with the present disclosure.

Various embodiments may involve rotation, or other movement, of one or more grippers 220. For example, referring to FIG. 46, the grippers 220 may engage (e.g. grip) and rotate the attachment pin 34 for securing the attachment pin 34 into and out of locking engagement with at least first and second ground covers 26*a*, 26*b*. This may be useful, for example, with attachment pins 34 that are themselves rotatable between locked and unlocked positions (e.g. not having a distinct second portion 66 that is rotatable relative to a first portion 64). If desired, the grippers 220 of these embodiments may also extract the attachment pin 34 from the ground covers 26.

In this embodiment, the tool 200 has a modified configuration of the above described embodiments, but with the rotator 230 operatively coupled to the grippers 220 for their concurrent rotational movement. In other embodiments, the rotator 230 may not be included. In either case, the exemplary power-driven actuator 240 may be configured to selectively rotate at least one gripper 220 to lock and unlock the pin 34, selectively move the gripper(s) 220 up and away from the support surface 16 to extract the pin 34, selectively actuate the gripper(s) 220 to disengage from the pin 34, or a combination thereof. When the illustrated grippers 220 are in gripping engagement with the attachment pin 34, the grippers 220 are rotatable to rotate the pin 34 between locked and unlocked positions, moveable axially away from the support surface 16 when the pin 34 is in an unlocked position to remove the attachment pin 34 therefrom and thereafter disengageable from the pin 34.

Referring back to FIGS. 12A-14, if desired, the exemplary tool 200 may be configured to transfer at least some rotational torsional forces placed upon the carrier 210 during attachment pin manipulation operations to the attachment pin 34 and/or support surface 16. For example, one or more of the illustrated grippers 220 may be configured to transfer at least some rotational torsional forces that may be placed upon the carrier 210 during attachment pin manipulation operations to the first portion 64 of the attachment pin 34 (and support surface 16), such as when rotation of the rotator 230 and/or the second portion 66 of the attachment pin 34 is met with resistance.

When this feature is included, rotational torsional forces may be transferred to the attachment pin and/or support surface in any suitable manner. For example, one or more grippers 220 may bear upon the (at least substantially non-rotatable) first portion 64 of the attachment pin 34 when rotational torsional forces are placed upon the carrier 210 (e.g. when the carrier 210 wants to rotate if the foot 62 of the attachment pin 34 is stuck or difficult to rotate). In the illustrated embodiment, when rotation of the rotator 230 and/or the second portion 66 of the attachment pin 34 is met with resistance (e.g. due to freezing, jamming, dirt, ground cover 26 or attachment pin 34 deformation, warping, etc.) that causes the carrier 210 to want to rotate, such resistance may, in many instances, be negated and/or overcome by one or more grippers 220 bracing against one or more shoulders 70 (e.g. FIGS. 8A-9B) formed in the (at least substantially non-rotatable) flange 82 of the head 36 of the attachment pin 34. In those instances, at least some (e.g. nearly all or all) rotational torque placed upon the exemplary carrier 210 may be transferred to the attachment pin 34 and therefrom to the support surface 16, often allowing the rotational torque of the rotator 230 to ultimately successfully rotate the second portion 66 of the attachment pin 34 and assisting in relieving the operator from having to bear some, much or all of rotational torque that may be placed upon the carrier 210, for any other purpose(s) or a combination thereof.

Figure 18B:
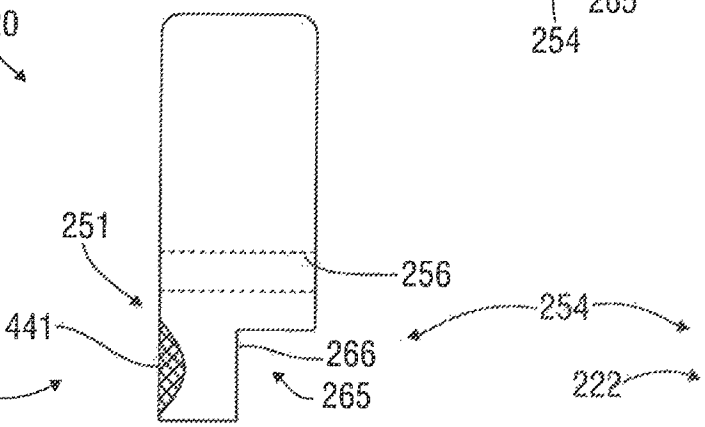
FIG. 18B is an end view of the exemplary gripper shown in FIG. 18A.

Still referring to FIGS. 12A-14, the exemplary gripper(s) 220 may brace against one or more of the shoulders 70 formed in the flange 82 of the head 36 of the attachment pin 34 in any suitable manner. For example, in the engaged position(s), at least one exemplary gripper 220 may grip the attachment pin 34 adjacent to one its respective shoulders 70, such as at a depression 76 (FIGS. 8A-9B) formed in the head 36 of the pin 34, to allow the gripper 220 to brace (shoulder-up) against the shoulder 70 and transfer rotational forces. Referring to FIGS. 17 & 18B, in the present embodiment, each claw 222 includes a cut-out, or void, 265 adjacent to the tooth 250 and configured to effectively mate with, capture or partially surround part of the flange 82 (e.g. FIGS. 8A-9B) of the head 36 of the exemplary attachment pin 34 at the shoulder 70 and allow the tooth 250 to seat in the depression 76. A side face 266 of the illustrated tooth 250 (at the cut-out 265) will typically bear upon the shoulder 70 if rotational torque is placed upon the carrier 210 as the rotator 230 attempts to rotate the second portion 66 of the attachment pin 34 (e.g. which might be stuck or tight and require substantial torque). It should be noted that during this "shouldering-up" or bracing of the exemplary gripper 220 with the shoulder 70 of an attachment pin head 36, there may nevertheless be some (typically minimal) rotation of the exemplary tool 200 and/or first portion 64 of the attachment pin 34. If desired, during initiation of pin manipulation operations, the tooth 250 of each exemplary gripper 220 may be positioned over and lowered into the corresponding depression 76 in the attachment pin head 36 to assist in properly positioning the tool 200 over the attachment pin 34. However, any other arrangement of components and techniques may be used to transfer at least some rotational torsional forces placed upon the carrier 210 to the attachment pin 34 and/or support surface 16, or this capability may not be included.

Figure 18A:
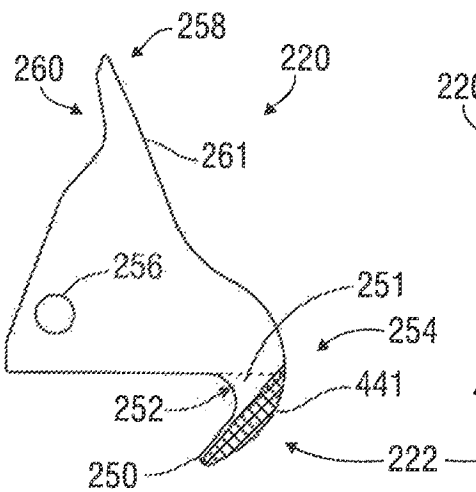
FIG. 18A is a side view showing a first side of one of the exemplary grippers of FIG. 17.

Referring to FIGS. 18A-C, in some embodiments, one or more grippers 220 may include one or more cut-outs, or bevels, 441 formed along one or more outer edges thereof, such as to allow the gripper 220 to clear one or more edges of the attachment pin hole 32 of the uppermost ground cover 26*a* (e.g. FIG. 3B) when the gripper 220 is moving into engagement with a pin 34 therein. For example, each illustrated claw 222 of each gripper 220 includes a bevel 441 formed in an outermost side edge 251 of the tooth 250. The bevel 441 may have any suitable dimensions and orientation. In some embodiments, the bevel 441 may have a length of approximately 3/16" in two directions and/or be cut at an angle of approximately forty five degrees (45°) from a curved corner of the claw 22. However, this feature may not be necessary or included in various embodiments.

Referring again to FIGS. 12A-B & 16A-B, when included, the nose 270 may have any suitable form, components, construction and configuration and operation. For example, the nose 270 may be generally tubular in shape and coupled to and axially slideable within the main body 216 of the carrier 210. In this embodiment, the nose 270 includes or carries one or more protrusions 314 (e.g. proximate to its front end 280) that engage one or more corresponding longitudinally-extending slots 318 formed in the main body 216. The illustrated protrusions 314 are stud rollers 315, but could take any other suitable form (pins, shafts, bolts, etc.). At least two exemplary stud rollers 315 are evenly spaced-apart on the illustrated nose 270 and extend through and slide along corresponding evenly spaced-apart slots 318 in the main body 216 to couple the nose 270 to the main body 216. In this configuration, the illustrated nose 270 is allowed to move axially relative to the main body 216 within a range of motion defined by the length of the slots 318, but is not (at least substantially) rotatable relative to the main body 216. However, any other configuration of components may be used to couple the exemplary nose 270 and carrier 210. In some embodiments, the nose 270 may be integral with the main body 216 or carrier 210. In various embodiments, one or more different components (other than the nose 270) may be used to provide the desired capabilities of the exemplary nose 270.

Figure 19:
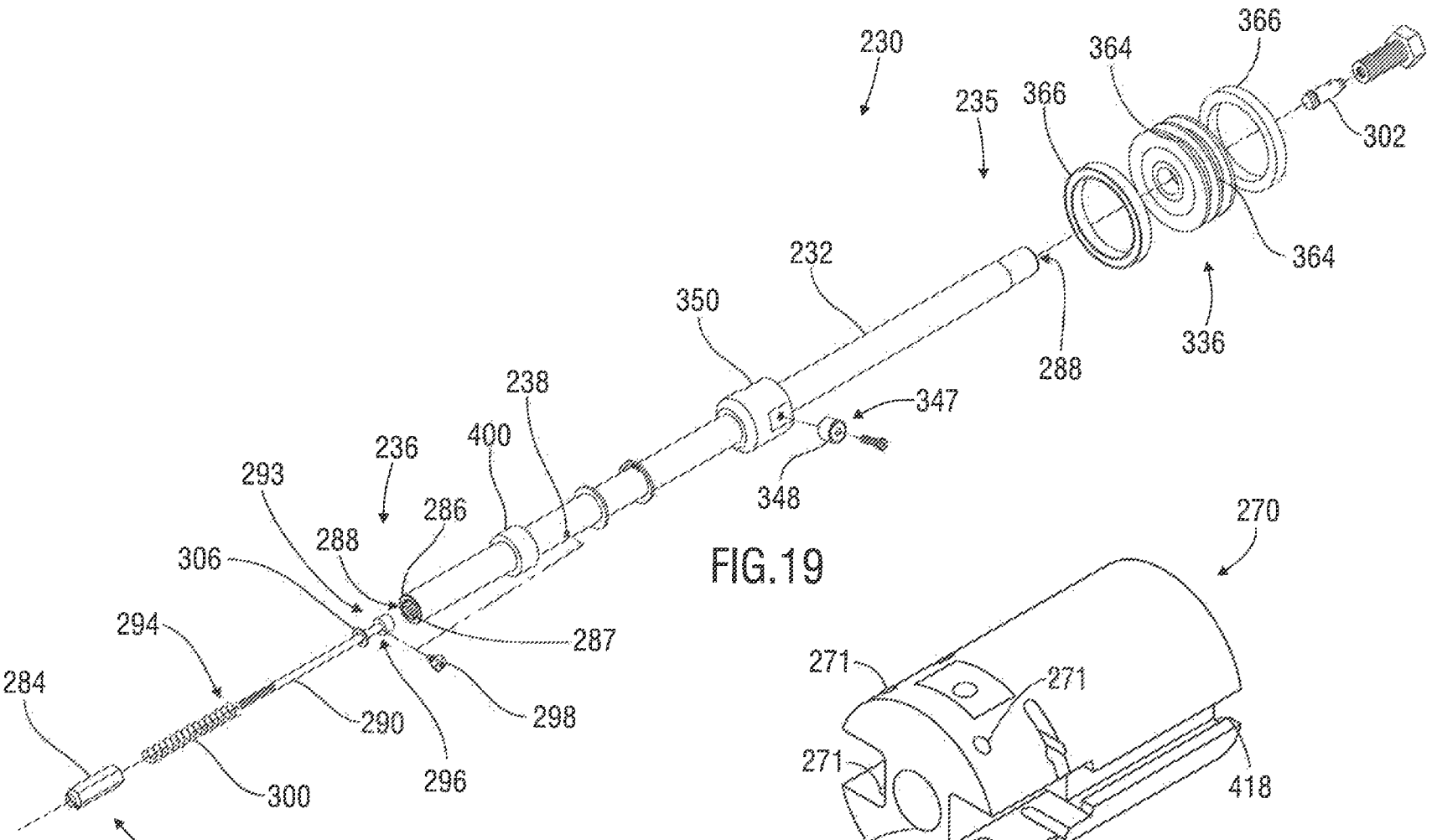
FIG. 19 is an assembly view of the exemplary rotator of the power tool of FIGS. 12A-B in accordance with one or more embodiments of the present disclosure.

Now referring to FIG. 19, the rotator(s) 230, when included, may have any suitable form, configuration, construction, components and operation. In this embodiment, the rotator 230 includes a rotatable rod 232 positionable longitudinally in the carrier 210 (e.g. FIGS. 16A-B) and extending through a longitudinal bore 278 in the nose 270. The exemplary rod 232 is configured to releasably engage and rotate at least the second portion 66 of the attachment pin 34 (e.g. FIGS. 28A-29B). However, there may be embodiments of rotators 230 that do not include a rotatable rod 232. For example, the rotator 230 may be integral to the carrier 210 and/or one or more grippers 220. Further, the rotator(s) 230 may engage a different portion of the attachment pin 34 (other than the second portion 66) or multiple portions of the pin 34.

Still referring to FIG. 19, in this embodiment, the rotator(s) 230 (e.g. rotatable rod 232) may engage and rotate the second portion 66 (or other part) of the attachment pin 34 in any suitable manner. For example, the rotator 230 may include one or more mating portions 234 configured to engage with and/or mate the mateable portion(s) 68 of the second portion 66 of the attachment pin 34 to facilitate rotation of the second portion 66. The illustrated mating portion 234 extends axially from the front end 236 of the rotatable rod 232 so that it at least partially protrudes out of the front end 280 of the nose 270 (e.g. FIG. 12A) for engagement with the attachment pin 34 when the carrier 210 is lowered over the attachment pin 34. However, the present disclosure is not limited to this particular configuration and arrangement of parts.

When included, the mating portion 234 of the rotator 230 may have any suitable form, configuration, construction and operation. For example, when the mateable portion 68 of the second potion 66 of the attachment pin 34 includes a socket-like recess 78 (e.g. FIGS. 8A-9B, 11) having a particular shape/configuration (e.g. square, hexagonal, octagonal, rectangular, slotted, etc.), the exemplary mating portion 234 of the rotator 230 may include a protrusion (e.g. bit, pin, blade, spade, etc.) having a complimentary cross-sectional shape (e.g. square, hexagonal, rectangular, octagonal, etc.). If instead the mateable portion 68 of the attachment pin 34 includes a solid rotatable portion 80 (e.g. protrusion, bolt head, bit, pin, blade, spade, etc.) (e.g. FIGS. 10A-B) having a particular shape (e.g. square, hexagonal, octagonal, rectangular, etc.), the exemplary mating portion 234 of the rotator 230 may include a socket-like recess having a complimentary shape/configuration (e.g. square, hexagonal, octagonal, rectangular, slotted, etc.). For example, when the attachment pin 34 includes a mateable portion 68 having a hexagonal socket-like recess 78 (e.g. FIGS. 8A-9B), the corresponding mating portion 234 of the exemplary rotator 230 may be a hexagonal protrusion, or bit, 284 coupled to the front end 236 of the rotatable rod 232 (e.g. FIGS. 22A-C). However, the present disclosure is not limited to this mating arrangement. For example, the mating portion 234 may instead include one or more clips, claws, recessed-portions, sockets or the like and/or may be integral with the rotatable rod 232. Moreover, the details, nature and characteristics of the mating portion 234 of the rotator 230 (as well as the mateable portion 68 of the attachment pin 34) as provided herein are not limiting upon the present disclosure and appended claims, except and only to the extent as may be expressly recited and explicitly required in a particular claim hereof and only for such claim(s) and any claims depending therefrom. Further, in some embodiments, the rotator 230 may not include a mating portion 234.

Figure 22C:
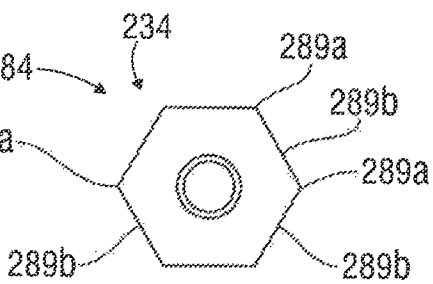
FIG. 22C is a rear view of the exemplary mating portion shown in FIG. 22A.
Figure 22B:
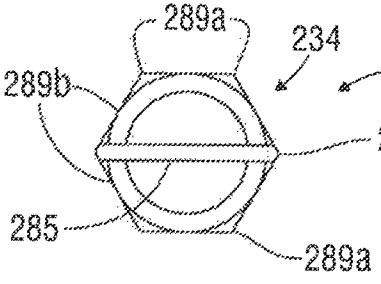
FIG. 22B is a front view of the exemplary mating portion shown in FIG. 22A.
Figure 22A:
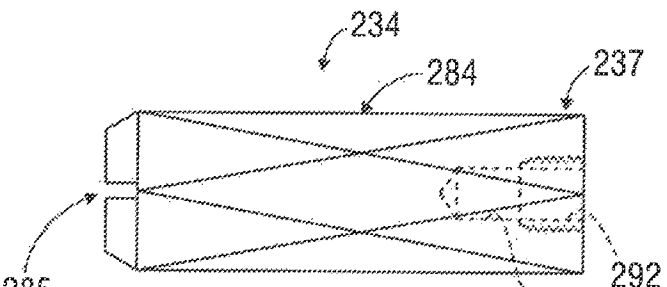
FIG. 22A is a side view of the mating portion of the exemplary rotator of the power tool of FIGS. 12A-B in accordance with one or more embodiments of the present disclosure.

Referring still to FIG. 19, the mating portion 234 of the illustrated rotator 230 may be coupled to the rotatable rod 232 in any suitable manner. The exemplary mating portion 234 connects to the front end 294 of a connector rod 290 extending longitudinally, and secured, within a longitudinally-extending bore 288 formed in the rotatable rod 232. For example, the connector rod 290 may be a bolt, or screw, having a threaded front end 294 and one or more raised portions 296 (e.g. a head) at or proximate to its rear end 293. The exemplary mating portion 234 may releasably engage the front end 294 of the connector rod 290, such as to allow easy removal of the mating portion 234 for replacement and/or other desired purpose. In this embodiment, as shown in FIGS. 22A-C, the mating portion 234 is formed with an at least partially threaded bore, or cavity, 292 accessible at its rear end 237 to threadably engage the front end 294 of the connector rod 290. However, the threading configuration of the mating portion 234 and connector rod 290 may be reversed or any other suitable mating or connecting mechanism may be used. Furthermore, the mating portion 234 may be coupled to the rotatable rod 232, or one or more other components of the rotator 230, in any other manner. In fact, in some embodiment, the mating portion 234 may be integral to the rotator 230 or rotatable rod 232.

Referring again to FIG. 19, the exemplary connector rod 290 may be secured in the bore 288 of the rotatable rod 232 in any suitable manner. In this embodiment, one or more couplers 298 (e.g. set screws) extend laterally into the rotatable rod 232 (and into the bore 288 therein) to retain the connector rod 290 within the bore 288. For example, each coupler 298 may be releasably coupled to a lateral orifice 238 formed in the rod 232 and which will be forward of the raised portion 296 of the connector rod 290 when the tool 200 is assembled. The exemplary coupler(s) 298 will allow the connector rod 290 to move axially within the bore 288 of the rotatable rod 232 within a limited range of motion while preventing the raised portion 296 of the connector rod 290 from exiting the bore 288 of the rotatable rod 232 at its front end 236. Further, the illustrated connector rod 290 is easily removable by loosening or removing the coupler(s) 298, such as to allow easy removal of the mating portion 234 of the rotator 230 for replacement, and/or other desired purpose. However, these components may have any other suitable form, configuration and operation or may not be included.

Still referring to FIG. 19, if desired, the mating portion 234 of the exemplary rotator 230 may be biased downwardly or axially moveable relative to the rotatable rod 232. The mating portion 234 may be biased downwardly or axially moveable relative to the rotatable rod 232 in any suitable manner. For example, the illustrated mating portion 234 is spring-loaded in the front end 236 of the rotatable rod 232. Spring-loading (or other retraction) of the mating portion 234 may be desirable, for example, during initiation of attachment pin manipulation operations (e.g. lowering of the tool 200) to allow the mating portion 234 to initially retract back if it initially contacts the attachment pin 34 or is misaligned with the mateable portion 68 to avoid breakage, holding up the operation, etc. Being spring-loaded, the retracted exemplary mating portion 234 should thereafter pop, or snap, into engagement with the mateable portion 68 when properly aligned.

If this capability is included, the mating portion 234 may be biased downwardly or axially moveable relative to the rotatable rod 232 in any suitable manner. In the illustrated embodiment, at least one spring 300 biases the mating portion 234 downwardly (outwardly) relative to the front end 236 of the rotatable rod 232. For example, one end of the spring 300 (e.g. coil spring) may bear upon the mating portion 234 (e.g. at an interior surface 291 of the cavity 292 formed therein, FIG. 22A), while the other end of the spring 300 bears upon a surface inside the bore 288 of the rotatable rod 232 (e.g. a washer 306 or other component slid onto the connector rod 290 forward of the coupler 298, a ledge of a counterbore formed in the bore 288, or the like). However, any other arrangement of components or techniques may be used to allow the mating portion 234 to be biased downwardly, or move axially, relative to the rotatable rod 232 or other component(s), or the tool 200 may be configured without this feature.

If desired, the mating portion 234 of the exemplary rotator 230 may be configured to rotationally engage the rotatable rod 232, such as to ensure they rotate concurrently when the mating portion 234 engages the attachment pin 34, to assist the rotator 230 in withstanding high torque/rotational forces during rotation of the attachment pin 34, for any other suitable purpose(s) or a combination thereof. The mating portion 234 may be rotationally lockable to the rotatable rod 232 in any suitable manner. For example, the rear end 237 of the mating portion 234 may be shaped and configured to mate with a female splined portion 287 of the interior wall of the bore 288 of the rotatable rod 232 proximate to the front opening 286 of the bore 288 to prevent relative rotation therebetween. However, any other configuration may be used to rotationally (torsionally) lock the mating portion 234 to the rotatable rod 232 or other component. In other embodiments, this feature may not be included.

Still referring to FIG. 19, if desired, the rotatable rod 232 and/or mating portion 234 may be adjustable to provide alternate positions of the mating portion 234 relative to the rotatable rod 232 and attachment pin 34 (to be manipulated). This sort of arrangement may be useful, for example, when the mateable portion 68 of the second portion 66 of the exemplary attachment pin 34 (e.g. FIG. 11) includes a hex-shaped socket-like recess 78 and is rotated ninety degrees (90°) (or other non-60° divisible increments (e.g. 30°, 150°, etc.)) between locked and unlocked positions, leaving a flat 83 of the recess 78 at the "twelve o-clock" position at the end of locking or unlocking the pin 34. If the mating portion 234 of the rotator 230 is a hex bit 284 having six (6 ea.) corners 289*a* (e.g. FIGS. 22B-C) spaced apart sixty degrees (60°) between six flats 289*b*, the orientation of the mating portion 234 will be off by thirty (30°) degrees when switching the use of the exemplary tool 200 between attachment pin locking and unlocking operations, or vice versa. Thus, between attachment pin manipulation operations, it may be desirable or beneficial to reset the mating portion 234 of the illustrated rotator 230 by thirty degrees (30°) to properly align it with the socket-like recess 78 of the attachment pin 34 for the next operation. Of course, other embodiments may warrant resetting the mating portion 234 by a different amount (e.g. 10°, 15°, 20°, 45°, 60°, 90°, etc.) to provide a different variety of alternate position of the mating portion 234.

Any suitable configuration of components and techniques may be used to provide alternate positions of the mating portion 234 relative to the rotatable rod 232 and attachment pin 34, if this feature is included. For example, the splined portion 287 of the interior wall of the bore 288 may be configured to provide alternate positions of the illustrated mating portion 234 of the rotator 230. In the present embodiment, since the mating portion 234 is a hex bit 284 having six (6 ea.) corners 289*a* spaced apart sixty degrees (60°) between six flats 289*b*, the splined portion 287 in the bore 288 may be formed with a 12-point spline to provide alternate positions (thirty degrees (30°) apart) for the mating portion 234 relative to the rotatable rod 232 and attachment pin 34.

To reset the exemplary mating portion 234, the mating portion 234 may be disengaged from the splined portion 287, rotated by thirty degrees (30°) and then reengaged with the splined portion 287. Since the illustrated mating portion 234 is spring-biased outwardly (downwardly) in the front end 236 of the bore 288 (such as described above), the mating portion 234 may be pushed up into the bore 288 against the spring-biasing forces and rearward of the splined portion 287 to allow it to be freely rotated to adjust the position of the mating portion 234, more precisely align it with the socket-like recess 78 of the attachment pin 34 (e.g. aligning the flats and corners of the mating portion 234 and mateable portion 68) before the next operation, for any other purpose or a combination thereof. For example, the mating portion 234 may be pushed up and rotated with a screwdriver or other tool engaged in one or more receiver 285 (e.g. FIG. 22A) at the front end of the mating portion 234. However, when this capability is included, the position of the mating portion 234 may be adjusted any desired amount in any other suitable manner.

Figure 16A:
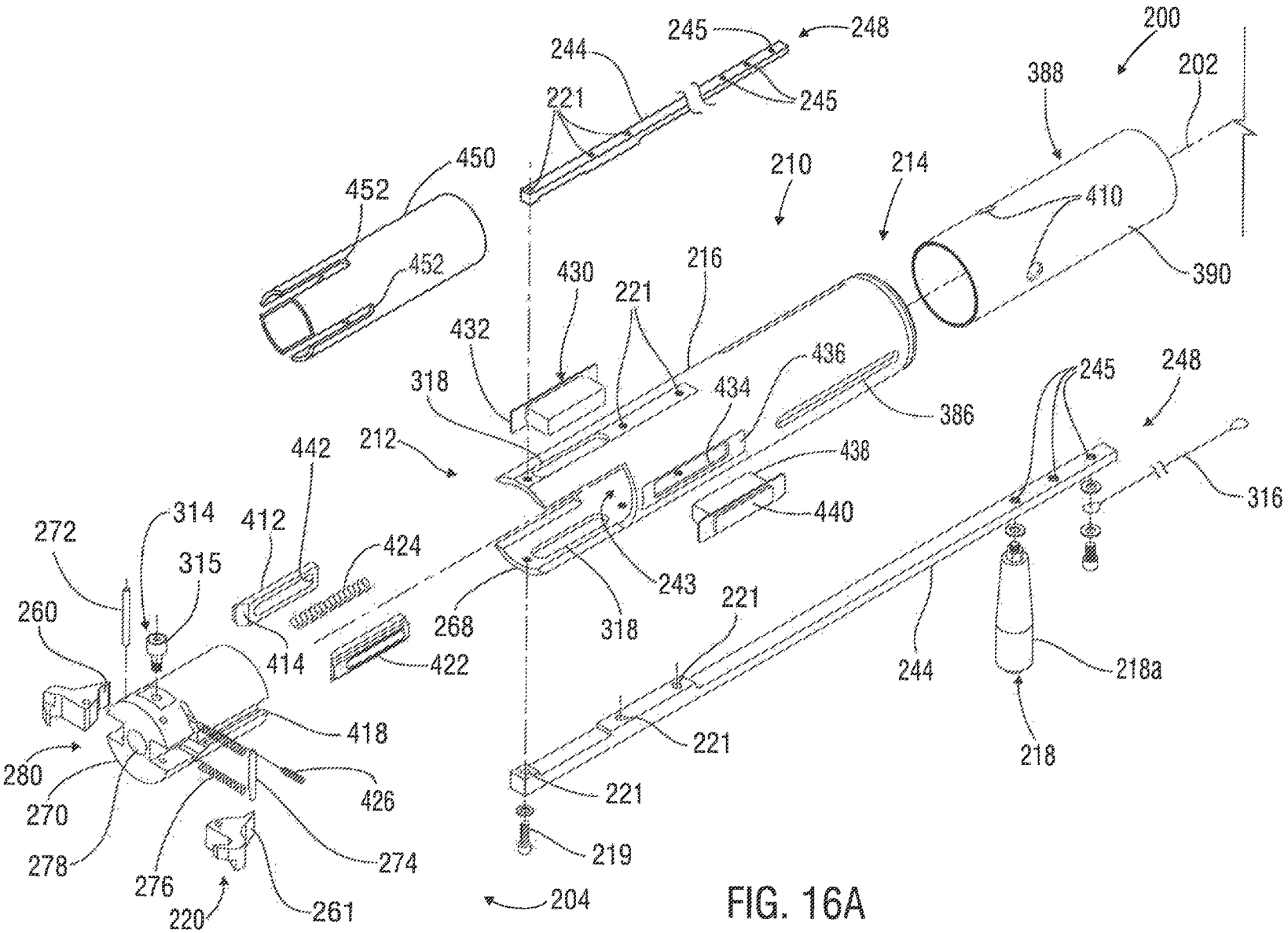
FIGS. 16A-B show an assembly view of the power tool of FIGS. 12A-B.
Figure 16B:
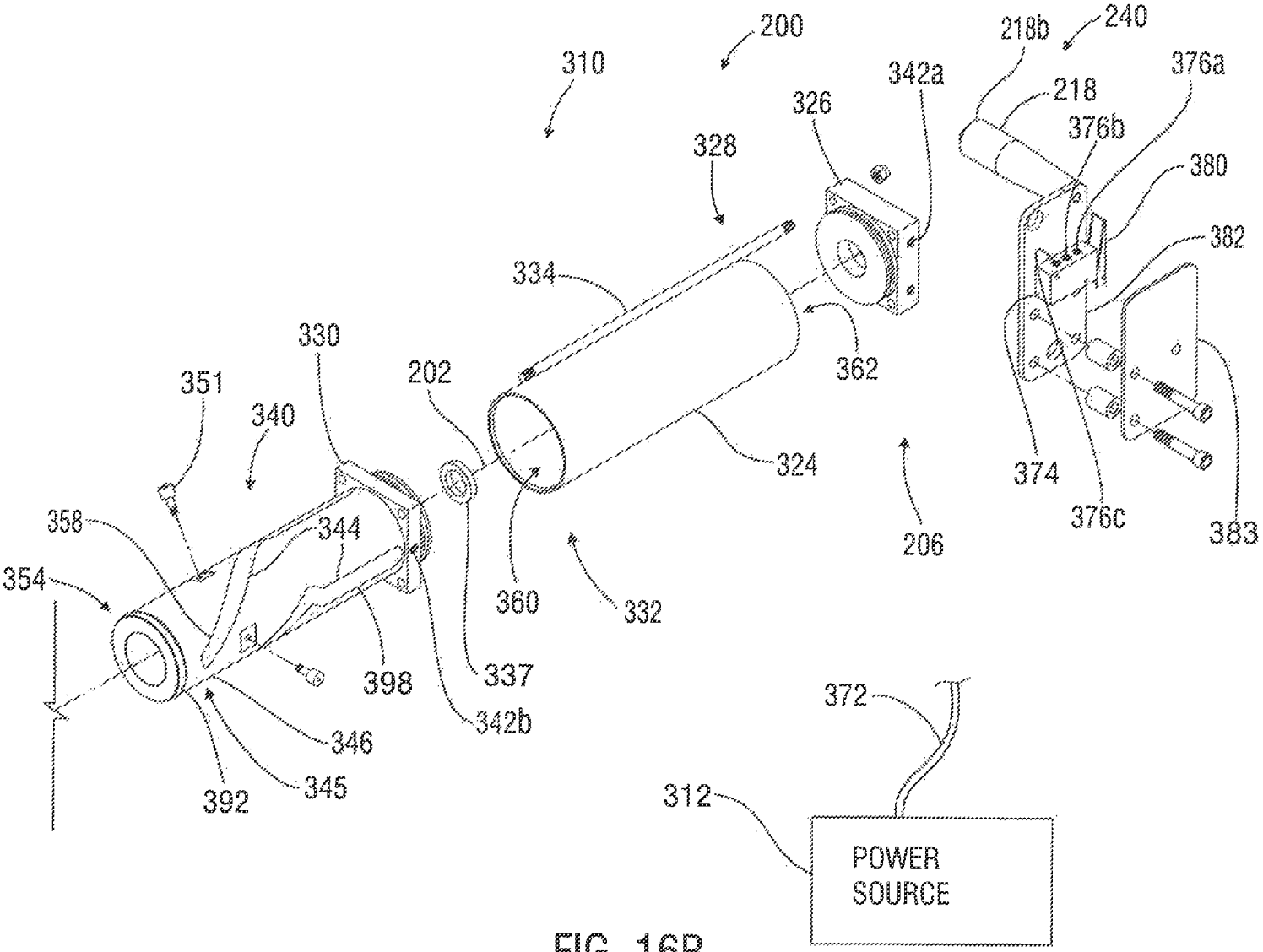

Referring back to FIGS. 12A-14, the exemplary rotator(s) 230 may be selectively rotatable relative to the carrier 210, the first portion 64 of the attachment pin 34 and the first and second ground covers 26*a*, 26*b* (or other components of the tool 200 and/or support surface 16) to unlock (and/or lock) the attachment pin 34 relative to the ground covers 26 in any suitable manner. In this embodiment, as indicated above, the power-driven actuator 240 is operatively coupled to the rotator 230 and configured to cause the selective rotation thereof. The power-driven actuator 240 may have any suitable form, configuration, construction, components and operation. As shown in FIGS. 16A-B, the illustrated power-driven actuator 240 includes a cylinder assembly 310 coupled to, or carried by, the carrier 210 and which causes the selective rotation of the rotator 230. In other embodiments, the power-driven actuator 240 may utilize a different mechanism or arrangement of components to rotate the rotator(s) 230. For example, the tool 200 could include an impact wrench or similar mechanism to selectively rotate the rotator 230. In yet other embodiments, a power-driven actuator 240 may not be included (e.g. the rotator(s) 230 may be self-powered).

Referring still to FIGS. 16A-B, when included, the cylinder assembly 310 may have any suitable form, configuration, components and operation. In this embodiment, the cylinder assembly 310 is axially slideable relative to the carrier 210 and is thus sometimes referred to as a floating cylinder assembly 310. The exemplary cylinder assembly 310 includes a pressurized (e.g. fluidly sealed) cylinder tube 324 configured to be associated with the carrier 210 proximate to the rear end 214 thereof. A blind end cap 326 is shown disposed proximate to the rear end 328 of the exemplary cylinder tube 324 and a rod end cap 330 is disposed proximate to the front end 332 of the cylinder tube 324. Extending forward of the exemplary rod end cap 330 and longitudinally aligned with and rigidly (e.g. releasably) coupled to the cylinder tube 324 is a helically-slotted body 340.

Referring still to FIGS. 16A-B, the exemplary helically-slotted body 340 may be coupled to the cylinder tube 324 of the cylinder assembly 310 in any suitable manner. For example, the rod end cap 330 may be integral with the helically-slotted body 340 and rigidly releasably coupled to the blind end cap 326, such as with one or more releasable tie rods 334. In this embodiment, four evenly-spaced, releasable tied rods 334 (e.g. long bolts) rigidly couple the end caps 326, 330 together. However, any other arrangement of components may be used to couple the helically-slotted body 340 to the cylinder tube 324 or they may be integrally formed.

The helically-slotted body 340, when included, may have any suitable form, configuration, components and operation. In this embodiment, the helically-slotted body 340 is cylindrical, axially slideable at least partially within the main body 216 of the carrier 210 proximate to the rear end 214 thereof, and includes at least one track, or slot, 344 extending at least partially through the wall 346 thereof along a specially designed, generally longitudinal-oriented path.

The exemplary helically-slotted body 340 may be coupled and axially slideably moveable relative to the main body 216 in any suitable manner. For example, the helically-slotted body 340 may include one or more protrusions 351 that engage one or more corresponding longitudinally-extending slots 386 formed in the main body 216. In this embodiment, the protrusions 351 are stud rollers 352 (e.g. FIG. 23), but could take any other suitable form (pins, shafts, bolts, etc.). At least two exemplary stud rollers 352 are evenly spaced-apart on the illustrated helically-slotted body 340 and extend through and slide along corresponding (spaced-apart) linear slots 386 in the main body 216 to couple the helically-slotted body 340 to the carrier 210 and allow the helically-slotted body 340 to move axially relative to the carrier 210. While the illustrated helically-slotted body 340 is moveable axially relative to the carrier 210 and within a range defined by the length of the slots 386, the helically-slotted body 340 is typically not (more than minimally) rotatable relative to the carrier 210, which may assist in substantially inhibiting or preventing rotation of the entire cylinder assembly 310 during attachment pin 34 manipulation operations. However, any other configuration of components and techniques may be used to slideably couple the exemplary helically-slotted body 340 (or other part of the cylinder assembly 310) to the carrier 210 and/or assist in preventing rotation of the cylinder assembly 310 during attachment pin 34 manipulation operations.

Referring now to FIGS. 16A-B & 19, in the present embodiment, to effect rotation of the rotator 230, the exemplary rotatable rod 232 includes at least one piston 336 disposed proximate to, or at, the rear end 235 thereof and which is configured to be contained and slideable within the cylinder tube 324. The piston(s) 336 may have any suitable form, configuration, construction, components and operation. For example, the illustrated piston 336 is a disc having two grooves 364 formed in its outer diameter, each configured to accept at least one seal member 366 (e.g. O-ring seal) to provide sealing engagement with the interior wall of the cylinder tube 324. When engaged in the tool 200, the exemplary rotatable rod 232 will extend through the rod end cap 330 (e.g. through-bore 338 (e.g. FIG. 24B)) and cylinder tube 324 and into the helically-slotted body 340. If desired, one or more rod seals 337 (e.g. FIG. 16B) or other sealing mechanism(s) may be provided to seal the slideable connection of the rotatable rod 232 and rod end cap 330 at the bore 338. However, the form, arrangement and operation of these components may be modified as desired and any other suitable configuration of components may be used.

Still referring to FIGS. 16A-B & 19, inside the exemplary helically-slotted body 340, at least part of the rotatable rod 232 (or one or more components coupled thereto) engages at least one of the tracks 344 formed in the helically-slotted body 340 to cause rotation and/or other movement of the rotatable rod 232 as the cylinder tube 324 is pressurized on either side of the piston 336 (such as described below). The rotatable rod 232 (or one or more components coupled thereto) may engage at least one of the exemplary tracks 344 in any suitable manner and with any desired components. In this embodiment, at least one protrusion 347 extends from the rotatable rod 232 to ride within each of the respective tracks 344 formed in the helically-slotted body 340. For example, each protrusion 347 may be a track roller 348 coupled to the rotatable rod 232. Each illustrated track roller 348 is releasably coupled to a helical boss, or collar, 350 shrunk-fit onto (or otherwise connected or integral to) the rotatable rod 232 at the desired location. In this embodiment, the helically-slotted body 340 includes four identicallyconfigured tracks 344 evenly spaced-apart around the circumference thereof and the rotatable rod 232 includes four similarly spaced-apart track rollers 348. However, the protrusion(s) 347 may take any other suitable form (e.g. bolt, pin, etc.) and be coupled to the rotatable rod 232 in any suitable manner or be integral thereto. Further, any other suitable quantity of slots 344 and protrusions 347 (e.g. 1, 2, 3, 5, 6 etc.) having any desired spacing and location may be used. For example, more than one track protrusion 347 may ride in each slot 344. Moreover, a different configuration of components may be used to cause rotation and/or other movement of the rotatable rod 232.

Figure 24B:
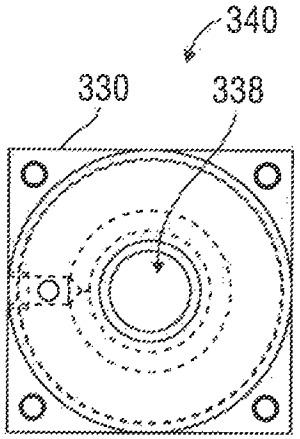
FIG. 24B is an end view of the exemplary helically-slotted body of FIG. 23.
Figure 23:
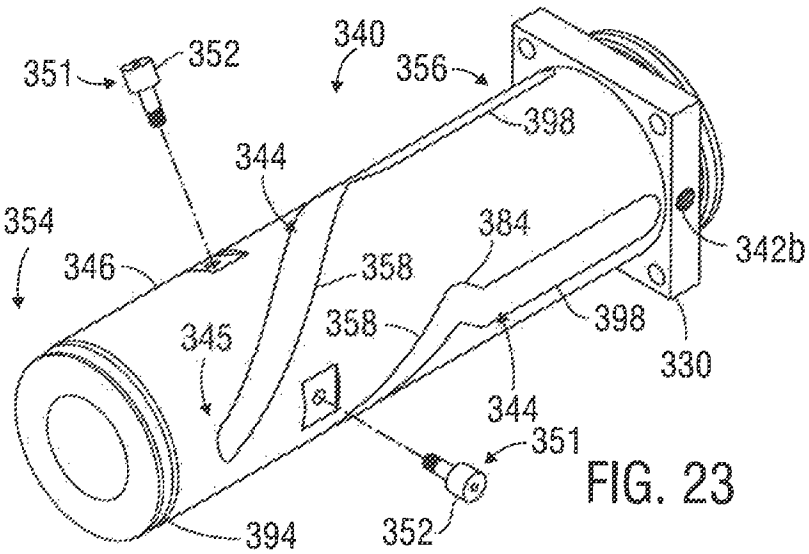
FIG. 23 is a perspective view of the exemplary helically-slotted body of the power tool of FIGS. 12A-B in accordance with one or more embodiments of the present disclosure.

Referring now to FIGS. 23-24B, the slots 344 formed in the exemplary helically-slotted body 340 may have any desired configuration. In this embodiment, each slot 344 extends through the thickness of the wall 346 of the body 340 and includes a helical portion 358 starting closest to the front end 354 of the body 340 and extending toward the rear end 356 of the body 340 sufficient to rotate the rotator 230 (e.g. rotatable rod 232) and second portion 66 of the attachment pin 34 as desired. In scenarios involving an attachment pin 34 that rotates ninety degrees (90°) clockwise between locked and unlocked positions (and vice versa), for example, the exemplary helical portion 358 of each slot 344 may be configured (e.g. with a counterclockwise-oriented helix of a desired length) to rotate the rotator 230 (and second portion 66 of the attachment pin 34) approximately ninety degrees (90°) in the clockwise direction. When the tool 200 is configured to unlock and lock attachment pins 34 that rotate in the same direction between (fully) locked and unlocked positions, such as the present embodiment, the same helical portion 358 of the exemplary slots 344 accommodates both locking and unlocking of the exemplary attachment pins 34. However, in other embodiments, the slot(s) 344 may not extend through the entire thickness of the wall 346 of the helically-slotted body 340 and/or may rotate the rotatable rod 232 more or less than 90° (e.g. 30°, 45°, 180°, etc.), the tool 200 may be configured to effect rotation of the rotator(s) 230 and attachment pin 34 in opposite directions for locking and unlocking operations or a different configuration of components for rotating the rotator 230 may be provided.

Still referring to FIGS. 23-24B, if desired, the exemplary helical portion 358 of the slots 344 in the helically-slotted body 340 may be sized to rotate the rotator 230 more than the necessary amount (e.g. ninety degrees) (90°) for locking and/or unlocking the pin 34, such as to allow for some additional rotation of the rotatable rod 232 at the beginning and/or end of locking or unlocking the attachment pin 34. This may be desirable upon initiation of pin manipulation operations, for example, to allow some initial rotation of the mating portion 234 of the rotator 230 to move into full engagement with the mateable portion 68 of the second portion 66 of the attachment pin 34 (e.g. for proper indexing when the tool 200 is lowered), to allow one or more grippers 220 to be moved into engagement with one or more shoulders 70 (or other part) of the attachment pin 34, for other suitable purpose(s) or a combination thereof. At the end of locking or unlocking the exemplary attachment pin 34, some additional rotation of the rotator 230 may be necessary or desirable, for example, to accommodate for (allow the release of) torsion or deflection of the of rotatable rod 232, accommodate imperfect indexing of the mating portion 234 of the rotator 230 with the rotatable rod 232 and/or mateable portion 68 of the attachment pin 34, for any other purpose(s) or a combination thereof.

Still referring to FIGS. 23-24B, in the present embodiment, each slot 344 in the helically-slotted body 340 includes a reverse-direction portion 384 (e.g. clockwise-oriented) rearwards of the helical portion 358. Thus, at the end of rotation of the exemplary rotator 230 in one direction (e.g. clockwise) to unlock or lock the attachment pin 34, the rotator 230 is caused to reverses direction (e.g. counterclockwise) (e.g. FIGS. 31A-B). For example, the reverse-direction portion 384 may be configured to rotate the rotator 230 approximately 9° (or more or less) to relieve torsional load on the tool 200, allow the gripper(s) 220 to become torsionally inert (e.g. not jammed up against the shoulder(s) 70 of the attachment pin 34), for any other purpose(s) or a combination thereof). However, the slots 344 in the helically-slotted body 340 may take any other desired form. In some embodiments, one or more of the above features of the helically-slotted body 340 may not be included.

Referring back to FIGS. 16A-B, if desired, one or more covers 388 may be provided at least partially over the outside of the helically-slotted body 340. In this embodiment, the cover 388 is a substantially solid cylindrical sleeve 390 extending at least substantially around the helically-slotted body 340 to cover the slots 344 therein, provide lubricant in the tool 200, assist in preventing debris from entering the slots 344 and tool 200, serve as a replaceable wear sleeve, for any other purpose(s) or a combination thereof. For example, the cover 388 may be constructed at least partially of lubricating or lubricant-containing material (e.g. oil-filled-nylon) to serve as a lubricant or otherwise be lubricated or provide lubricant. In this embodiment, the cover 388 may be provided with lubricant on the outside thereof to assist in lubricating the main body 216 within which it will typically slide during use of the tool 200.

The exemplary cover 388 may be positioned at least partially over the helically-slotted body 340 in any suitable manner. In this embodiment, a removable coupler 392 seats in and is selectively releasable from a groove 394 (e.g. FIG. 24*a*) at front end 354 of the helically-slotted body 340 to retain the cover 388 in position over the helically-slotted body 340. If desired, the exemplary coupler 392 may also assist in ensuring the cover 388 moves axially concurrently with the helically-slotted body 340 within the main body 216 of the exemplary carrier 210. The illustrated coupler 392 is an O-ring, but could take any other suitable form (e.g. clip, snap-ring, etc.). Also if desired, the coupler 392 may be moveable (e.g. slid forward of the cover 388) to allow the cover 388 to be removed and replaced. However, any other components and techniques for positioning the cover 388 may be used or the cover 388 may not be included.

When the exemplary helically-slotted body 340 includes one or more protrusions 351 (e.g. stud rollers 352) to engage the slots 386 in the main body 216, the cover 388 may be formed with corresponding apertures 410 to allow each protrusion 351 to pass through the cover 388. In some embodiments, one or more of the apertures 410 may be sized to closely surround the portion of the associated protrusion 351 that extends therethrough to assist in retaining the cover 388 in the desired position over the helically-slotted body 340, assist in ensuring the cover 388 moves axially concurrently with the helically-slotted body 340 within the main body 216, for any other purpose(s) or a combination thereof.

Referring back to FIGS. 12A-14, the exemplary power-driven actuator 240 may be selectively actuated with the use of any suitable power source 312. For example, the actuator 240 may be pneumatically, hydraulically or electrically driven, self-powered (e.g. by battery), powered by a local or off-site power source, or a combination thereof. In this embodiment, the cylinder assembly 310 of the power-driven actuator 240 is pneumatically-powered and configured to be releasably connected to and receive pressurized air from a pressurized-air power source 312 (e.g. fuel-powered air compressor, electric-powered air compressor, compressed air storage tank, etc.). However, the exemplary cylinder assembly 310 (or other actuator) could instead be hydraulically-driven and releasably connected to and receive pressurized fluid from a hydraulic power source 312 (e.g. electric or fuel-powered pump). In yet other embodiments, the exemplary cylinder assembly 310 (or other actuator) could be driven by one or more electric power source 312. Electric power may be provided in any suitable manner, such as by gas turbine generators located on-site, or remotely located relative to the work site, and electrically coupled to the power-driven actuator 240. For another example, a local utility power grid may be connectable to the power-driven actuator 240, such as by one or more distribution or transmission lines, sub-stations, breaker panels, etc. Thus, the tool 200 may be configured to be easily transported between multiple work sites and connected to and disconnected from one or more external power sources 312 at each location.

Still referring to FIGS. 12A-14, the exemplary power-driven actuator 240 may be configured to provide any desired or suitable amount of rotational torque to the rotator 230 (and second portion 66 of the attachment pin 34) and/or provide sufficient power to actuate any other components of the tool 200. For example, the cylinder assembly 310 (pneumatic or hydraulic) may be configured to receive at least ten (10) psi of air, or fluid, pressure to drive the rotator 230 and provide at least five (5) ft.-lbs. of rotational torque to the rotator 230. For another example, when the power-driven actuator 240 includes at least one electric motor, the motor may possess a horsepower rating at least ¼ HP and provide the rotator 230 with at least five (5) ft.-lbs. of rotational torque. However, other embodiments may possess higher or lower values. For example, the tool 200 may be configured so that the cylinder assembly 310 receives at least 15, 20, 30 psi or more of air or fluid pressure, provides the rotator(s) 230 with at least 10, 20, 50, 100 ft.-lbs. or more of rotational torque, is driven by at least one electric motor having a horsepower rating of at least ½ HP, 1 HP, 5 HP or more, or a combination thereof.

Referring back to FIGS. 16A-B, the exemplary power-driven actuator 240 may be configured to drive the cylinder assembly 310 in any suitable manner. In this embodiment, the cylinder tube 324 has front and rear portions 360, 362 defined (at one end) and separated by the piston 336 (e.g. FIG. 19) of the rotatable rod 232 therein. The exemplary actuator 240 can be actuated to selectively pressurize the front and rear portion 360, 362 to drive the helically-slotted body 340 and/or rotatable rod 230 as desired. For example, the tool 200 may include one or more respective fluid ports 342*a*, 342*b* that allow pressurized air (or other fluid) to be selectively provided into and out of the respective front and rear portions 360, 362 of the exemplary cylinder tube 324 to cause rotation of the rotator 230 (or other desired movement of one or more other components). The ports 342*a*, 342*b* may have any suitable configuration, location and operation. In this embodiment, the ports 342*a*, 342*b* are provided in the end caps 326, 330, respectively. One or more hoses 372 fluidly coupled to the power source 312 (e.g. air compressor) are releasably fluidly coupled to the exemplary fluid ports 342*a*, 342*b* via a fluid control valve 374 secured to the tool 200. However, one or more fluid ports 342*a*, 342*b* may also or instead be formed one or more different components or directly into the cylinder tube 324 and coupled to the power source(s) 312 in any other suitable manner.

When included, the fluid control valve 374 may have any suitable configuration, form and operation. In this embodiment, the control valve 374 includes at least a first port 376*a* fluidly coupled to the port(s) 342*a* (e.g. via another hose), at least a second port 376*b* in fluid communication with the port(s) 342*b* (e.g. via another hose) and at least a third port 376*c* fluidly coupled to the power source hose 372 (such as via a quick disconnect 370). In a first position, the exemplary control valve 374 supplies pressurized fluid from the power source 312 into the rear portion 362 of the cylinder tube 324 (e.g. via port(s) 376*a*, 342*a*) and opens the front portion 360 (the "rod side") of the cylinder tube 324 to atmosphere (e.g. via port(s) 376*b*, 342*b*). In a second position, the exemplary control valve 374 supplies pressurized fluid from the power source 312 into the front portion 360 of the cylinder tube 324 (e.g. via port(s) 376*b*, 342*b*) and opens the rear portion 362 to atmosphere (e.g. via port(s) 376*a*, 342*a*). However, any other components or sequence may be used for pressurizing the cylinder tube 324 or otherwise driving the cylinder assembly 310 to rotate the rotator 230 and/or actuate any other components.

Still referring to FIGS. 16A-B, if desired, at least one trigger, or lever, 380 may be provided on, or associated with, the illustrated control valve 374 to allow selective control of pressurized fluid into and out of the cylinder tube 324 (e.g. via the ports 342*a*, 342*b*). In this embodiment, the trigger 380 (e.g. push-button thumb-type) and the control valve 374 are mounted upon a mounting plate 382 secured to the tool 200 proximate to the rear end 328 of the cylinder tube 324. For example, the mounting plate 382 may be rigidly secured to the blind end cap 326 (and thus movable up and down with the cylinder assembly 310). If desired, a handle 218 may also be mounted to the mounting plate 382 (or other component) proximate to the trigger 380. In this example, the handle 218 is positioned to be gripped by an operator with his/her/it's right hand with the right thumb conveniently positionable over the trigger 380. Since this handle 218 will move up and down along with cylinder assembly 310, it is sometimes referred to herein as the "moving handle" 218*b*. If desired, a guard plate 383 may be associated with the exemplary mounting plate 382, such as outwards of the trigger 380 and/or control valve 374 to enclose or shield them. However, these components are not required and any other arrangement of parts may be used to control fluid flow into and out of the front and rear portions 360, 362 of the cylinder tube 324 or otherwise drive the cylinder assembly 310 or this feature may not be included.

Figure 27A:
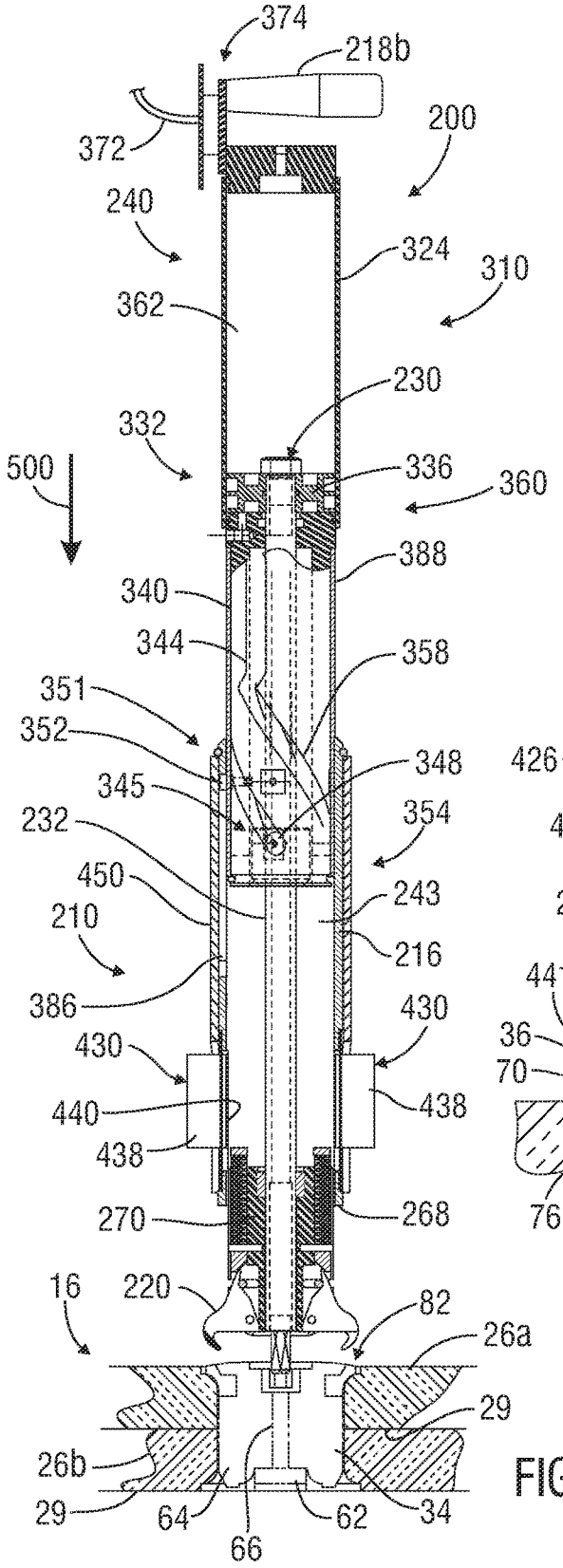
FIG. 27A is a front, partial cross-sectional view of the exemplary power tool of FIGS. 12A-B showing the tool being lowered prior to unlocking an exemplary attachment pin from an exemplary support surface in accordance with one or more embodiments of the present disclosure.

Still referring to FIGS. 16A-B, in this embodiment, the tool 200 is configured so that connection of the power source 312 to the exemplary tool 200 (e.g. connecting the hose 372 to the port 376*c* in the control valve 374) automatically supplies pressurized fluid into the rear portion 362 of the cylinder tube 324 and allows fluid to escape from the front portion 360. Thus, the first position of the exemplary control valve 374 described above represents the "default" and start position of the tool 200. When the illustrated control valve 374 is in the first position, the piston 336 of the rotatable rod 232 (e.g. FIG. 19) is closest to the front end 332 of the cylinder tube 324 and the track roller(s) 348 of the rotatable rod 232 are closest to the front end 345 of the respective associated slot(s) 344 of the helically-slotted body 340, such as shown in FIG. 27A.

Actuating the exemplary trigger 380 during use of the tool 200 in attachment pin manipulation operations moves the control valve 374 to its second position, which supplies pressurized fluid into the rod side, or front portion, 360 of the cylinder tube 324 and opens the rear portion 362 (e.g. to atmosphere). As the exemplary trigger 380 is depressed (e.g. FIGS. 30A-B), pressure in the front portion 360 typically pushes the helically-slotted body 340 axially linearly down toward the support surface 16, forcing the track roller(s) 348 of the rotatable rod 232 (e.g. FIG. 19) to travel through the helical portion 358 of their respective associated slot(s) 344 in the helically-slotted body 340, rotating the rotatable rod 232 and the second portion 66 of the engaged attachment pin 34 (e.g. 90°). The axial, linear movement of the exemplary helically-slotted body 340 is guided and limited by the protrusions 351 (e.g. stud rollers 352) thereof moving in the slots 386 of the main body 216. However, any other configuration of components and techniques may be used to selectively rotate the exemplary rotator(s) 230 or actuate one or more other components in a different manner.

Referring back to FIG. 19, if desired, the exemplary tool 200 may include one or more fluid relief valves 302. The fluid relief valve 302 may have any suitable form, configuration and operation. For example, the fluid relief valve 302 may be associated with the rotatable rod 232 and configured to release pressure in the front and/or rear portions 360, 362 of the cylinder tube 324 through the bore 288 (FIG. 16). In the illustrated embodiment, the fluid relief valve 302 is provided proximate to, or at, the rear end 235 of the rotatable rod 232. For example, the fluid relief valve 302 may be retained inside the bore 288 of the rotatable rod 232 by one or more connectors, such as bolts which secure the piston 336 to the rod 232 proximate to the rear end thereof 235. The illustrated fluid relief valve 302 is configured so that if the pressure inside the cylinder tube 324 (e.g. in the front portion 360) exceeds a particular value, the valve 302 will release pressure down into and through the bore 288 of the rotatable rod 232. However, any other configuration of one or more fluid relief valves 302 may be included. Moreover, some embodiments may not include any fluid relief valve(s) 302.

Figure 38A:
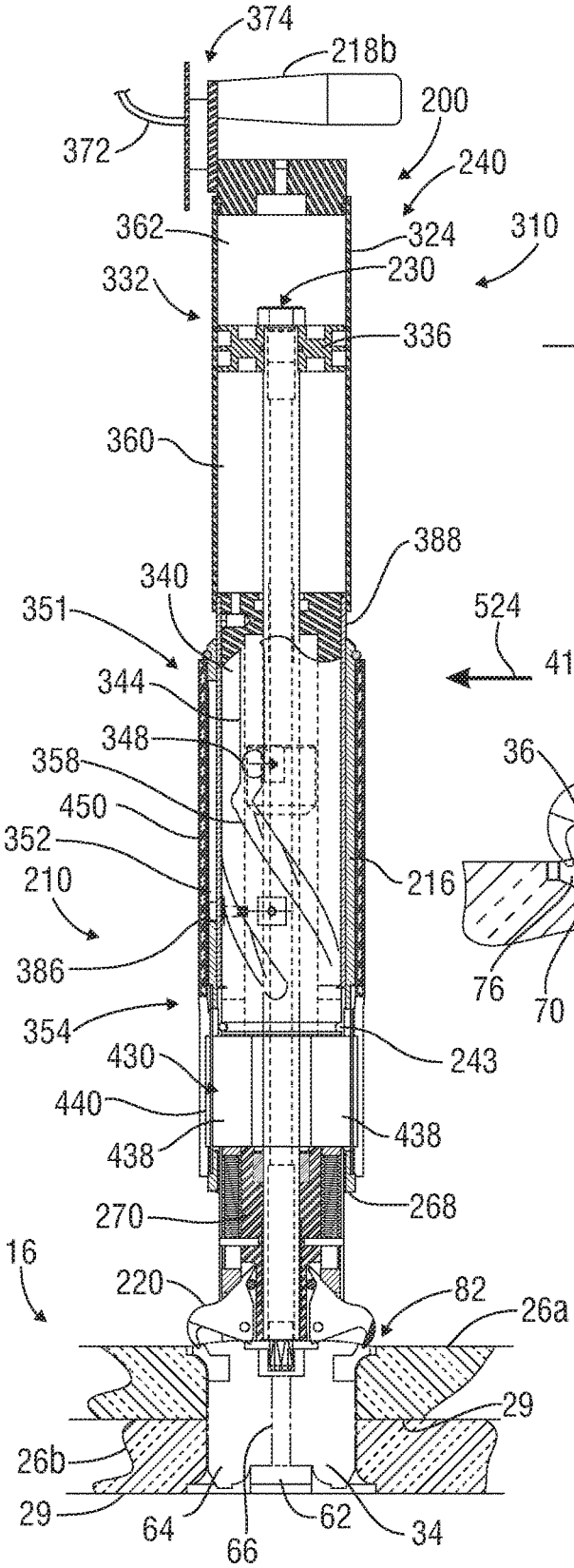
FIG. 38A is a front, partial cross-sectional view of the exemplary power tool of FIG. 33A showing the tool disengaging from the illustrated locked attachment pin in accordance with one or more embodiments of the present disclosure.
Figure 38B:
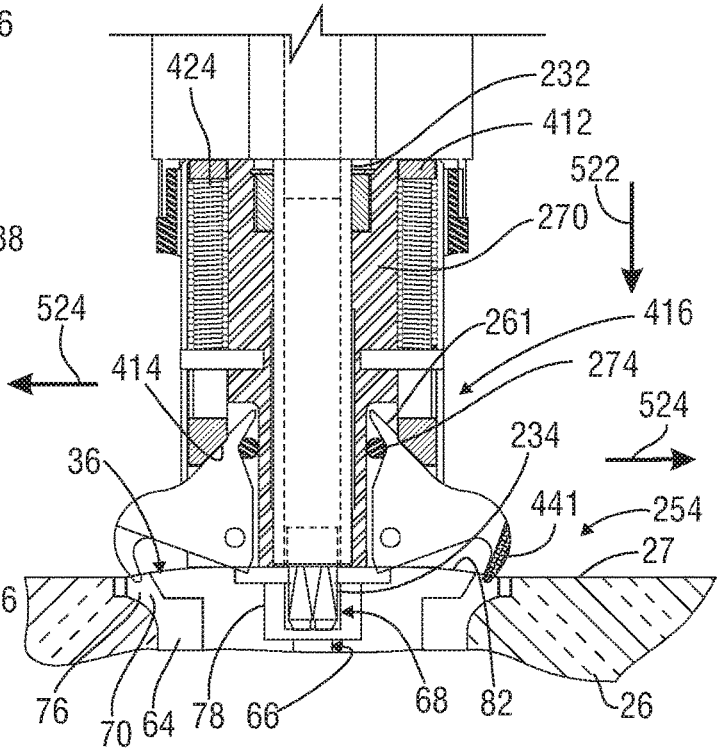
FIG. 38B is an exploded view of part of the exemplary power tool shown in FIG. 38A.

If desired, the valve 302 may be configured to distribute lubricated air (e.g. provided in the cylinder tube 324) to other components (e.g. the connector rod 290, spring 300, mating portion 234, nose 270, connector sleeve 496 (FIG. 39A) and related parts) of the tool 200, such as to lubricate them. For yet another example, the valve 302 may supply pressurized air (e.g. at full retraction of the piston 336, FIGS. 32A-B; FIGS. 38A-B) to blow out or purge the bore 288 of the rotatable rod 232 and/or one or more other components (e.g. the collar 350, protrusions 347, connector rod 290, spring 300, mating portion 234, nose 270, connector sleeve 496 (e.g. FIG. 39A) and related parts) of dirt, mud or other debris or material that may pack, or enter, the tool 200 (e.g. proximate to its front end 204).

Referring back to FIGS. 12A-14, when the exemplary tool 200 is utilized to unlock the attachment pin 34, the tool 200 may, if desired, be configured to move the gripper(s) 220 upwardly away from the support surface 16, such as to extract the unlocked attachment pin 34 from the support surface 16, and/or for any other desired purpose(s). For example, the power-driven actuator 240 may be operatively coupled to at least one gripper 220 to move the gripper(s) 220 rearwardly (upwardly) relative to the carrier 210 toward the rear end 206 of the tool 200.

The power-driven actuator 240 may be operatively coupled to at least one gripper 220 in any suitable manner. Referring to FIGS. 16A-B, 19 & 21C, for example, the rotator 230 may be coupled to the nose 270 (which carries the grippers 220), so the rotator 230 and grippers 220 can move concurrently together axially, linearly, rearwardly, but not rotationally, relative to the carrier 210. In this embodiment, the rotatable rod 332 includes a thrust boss, or collar, 400 rigidly coupled (e.g. shrunk fit) thereto or integral therewith and which is secured and rotatable within a recess, or counterbore, 404 formed in the nose 270 proximate to the rear end 282 thereof. For example, one or more retainers 406 may be secured to the nose 270 to retain and allow rotation of the collar 400 (and rotatable rod 332) in the recess 404. The retainer(s) 406, when included, may have any suitable form, configuration and operation. The illustrated retainer 406 is a releasable snap ring that fits in a groove 408 formed in the nose 270 rearward of the collar 400 to couple the rotator 230 and nose 270 together for concurrent, linear, axial movement. In this embodiment, to assemble these components, the front end 236 of the rotatable rod 232 (e.g. with mating portion 234) may be easily slid into the bore 278 of the nose 270 from the rear end 282 thereof until the collar 400 seats in the counterbore 404. The exemplary retainer(s) 406 may thereafter be secured in the nose 270. If desired, the retainer 406 may be removable or releasable to allow easy disconnection and replacement of the rotator 230 and/or nose 270 and/or for any other purpose(s).

Figure 24A:
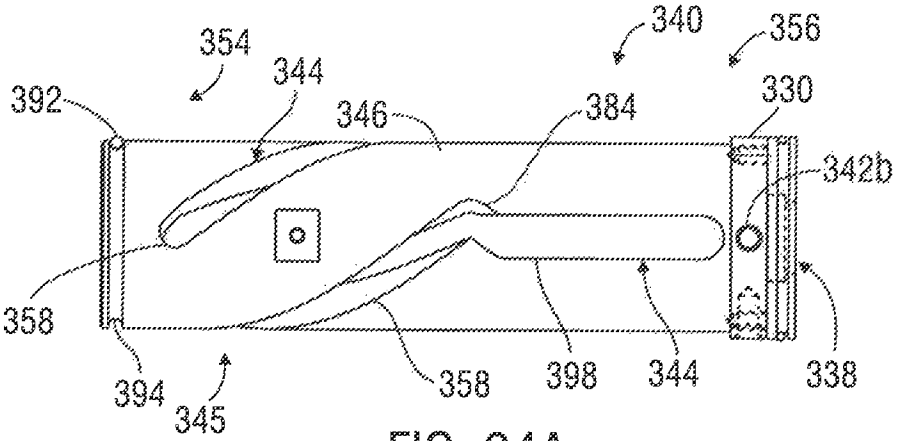
FIG. 24A is a side view of the exemplary helically-slotted body of FIG. 23.

Referring to FIGS. 16B, 23 & 24A, to direct the concurrent rearward, linear, axial movement of the exemplary rotator 230, nose 270 (and grippers 220) relative to the carrier 210, at least one slot 344 in the exemplary helically-slotted body 340 may include a linear (e.g. straight) portion 398 rearward of its helical portion 358 (and the reverse-direction portion 384, if included). The illustrated linear portion(s) 398 directs the desired rearward, axial, linear movement of the gripper(s) 220 and attachment pin 34 carried thereby relative to the support surface 16 (e.g. 2⅜" or more or less) as the exemplary track rollers 348 of the rotator 230 move therein. Thus, at the end of rotation (and counter-rotation, if included) of the exemplary rotator 230 when unlocking of the attachment pin 34, the actuator 240 is capable of drawing both the rotator 230 and the grippers 220 (with pin 34) upwardly toward the rear end 206 of the tool 200 (see e.g. FIG. 32A).

In this embodiment, after rotating (and, if included, counter-rotating) the exemplary rotatable rod 232 during normal operating conditions, as the trigger 380 continues to be depressed and the front portion 360 of the cylinder tube 324 continues to be pressurized, the protrusion(s) 351 (e.g. stud roller(s) 352) extending from the helically-slotted body 340 will bottom-out at the front end 387 (e.g. FIG. 31A) of the corresponding slot(s) 386 in the main body 216, stopping downward movement of the body 340 and forcing the rotatable rod 232 to then move up. The track roller(s) 348 of the exemplary rotatable rod 232 will travel along the linear portions 398 of the respective associated slot(s) 344 in the helically-slotted body 340, drawing the nose 270 and grippers 220 (with pin 34) up and away from the support surface 16 a desired distance (e.g. FIG. 32A), such as to extract the pin 34 from the support surface 16. However, any other arrangement of components and techniques may be used to move one or more grippers 220 upwardly away from the support surface 16 and relative to the carrier 210 or otherwise extract the pin 34 from the support surface 16. Moreover, this feature may not be included in various embodiments. For example, this feature may not be provided in various embodiments of the tool 200 configured for only locking the attachment pin 34 to the support surface 16 when there is no need or desire to move the grippers 220 upwardly relative to the carrier 210 and away from the support surface 16 after locking the pin 34 to the support surface 16. In such instances, after locking the pin 34 to the support surface 16, it may only be necessary to open the gripper(s) 220 to disengage the pin 34 and move the tool 200 away from that work location.

Referring to FIGS. 16A-B & 19, the exemplary tool 200 may open one or more of the grippers 220 (e.g. to disengage from the attachment pin 34) after unlocking and/or locking the pin 34 in any suitable manner. In this embodiment, the power-driven actuator 240 is operatively coupled to at least one gripper 220 and configured to cause it to open (move from an engaged to a disengaged position) and consequently disengage from, or release, the attachment pin 34. For example, the helically-slotted body 340 may cause the grippers 220 to open. After unlocking the pin 34 and extracting it from the support surface 16 with the illustrated tool 200 (such as described above), as the trigger 380 continues to be depressed, the track rollers 348 of the rotatable rod 232 will continue to move up in the linear portions 398 of the tracks 344 of the body 340. The exemplary nose 270 and grippers 220 will continue to be drawn up thereby to cause one or more sliders 412 carried by the nose 270 to contact the front end 354 of the helically-slotted body 340 (e.g. FIGS. 32A-B). Due to contact with the helically-slotted body 340 and continued upward movement of the nose 270, the exemplary slider(s) 412, which are slideably mounted in the nose 270, will be pushed downwardly (e.g. ⅝" or more or less) relative to the nose 270 and grippers 220 carried thereby. An outer face 261 of the rear end 258 of each exemplary gripper 220 (e.g. FIGS. 17, 32A-B) will ride across at least one engagement face 414 at the front end 416 of each slider 412 to lever the grippers 220 open (into a disengaged position). However, any other components and sequence of actions may be used to open one or more of the grippers 220 when this capability is included.

Figure 25C:
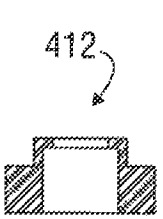
FIG. 25C is a cross-sectional view of the exemplary slider of FIG. 25B taken along lines FIG. 25C-FIG. 25C.
Figure 25B:
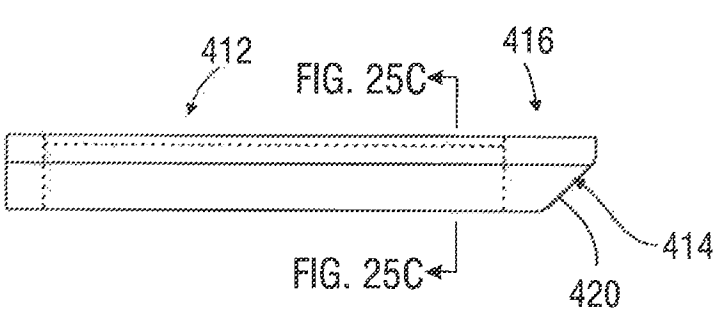
FIG. 25B is a side view of the exemplary slider shown in FIG. 25A.
Figure 25A:
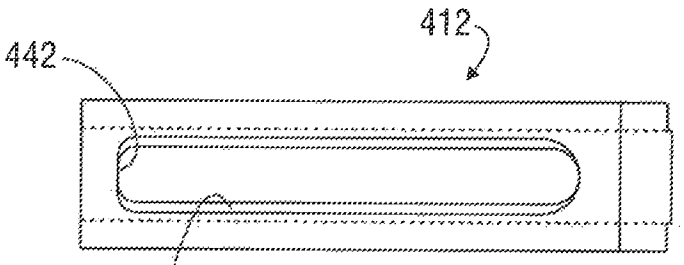
FIG. 25A is a top view of one of the exemplary sliders carried by the nose of the power tool of FIGS. 12A-B in accordance with one or more embodiments of the present disclosure.

Referring to FIG. 16A, when included, the exemplary slider(s) 412 may be slideably mounted in, or relative to, the nose 270 and capable of moving at least one gripper 220 into at least one disengaged position in any suitable manner. In this embodiment, to disengage each gripper 220, a slider 412 (e.g. FIGS. 25A-C) is retained and slideable within a longitudinally oriented T-slot 418 (e.g. FIG. 20) formed in the nose 270. For example, two T-slots 418 are shown formed in opposing sides of the illustrated nose 270; however, any other number, location and configuration of sliders 412 and T-slots 418 or other components may be used. As shown in FIG. 25B and mentioned above, each exemplary slider 412 includes an engagement face 414 proximate to its front end 416 and configured to abut the outer face 261 of the rear end 258 of the gripper 220 (e.g. FIG. 17) to lever the gripper 220 open as the slider 412 slides down (and/or the nose 270 moves up). If desired, the engagement face 414 may be a bevel 420 and the outer face 261 of the rear end 258 of the gripper 220 may be sloping to cause the rear end 258 to move inwardly and the front end 254 of the gripper 220 to move outwardly as the slider 412 slides down and/or the nose 270 moves up, overcoming the outward biasing forces of the biasing pin 274 on the gripper 220 and moving the gripper 220 into at least one disengaged position.

Referring again to FIG. 16A, if desired, the slider 412 may be spring-loaded rearwardly, such as to prevent the engagement face 414 of the slider 412 from hanging up on the gripper 220, allow the slider 412 to move back to a neutral (start) position after operations and/or for any other suitable purpose(s). For example, the slider 412 may include a longitudinal slot 422 (e.g. formed on the inside thereof) to retain at least one compressed spring member 424 (e.g. coil spring) therein. In this embodiment, one end of the illustrated spring member 424 bears up against the rear wall 442 of the longitudinal slot 422 (e.g. FIG. 25A) in the slider 412, while the other end of the spring member 424 bears up against a fixed base 426 extending laterally through the slot 422 and anchored to the nose 270. For example, the fixed base 426 (e.g. FIG. 12A) may be a set screw, pin or the like releasably inserted into an orifice in the nose 270. In some embodiments, the fixed base 426 may prevent the slider 412 from sliding out of the nose 270 at the front end 280 thereof. However, any other suitable components may be for moving at least one gripper 220 into at least one disengaged position or this feature may not be included.

If desired, at the same approximate time as disengaging the exemplary gripper(s) 220 from the pin 34 or thereafter, the operator may choose to lift or swing the tool up off of, or away from, the support surface 16 to allow the attachment pin 34 to fall out of the tool 200 (e.g. adjacent to the attachment pin holes 32 and/or release the trigger 380 to switch the control valve 374 back to its default/start position (e.g. FIG. 27A), returning the piston 336 of the rotatable rod 232 to nearest front end 332 of the cylinder tube 324 and the track roller(s) 348 of the rotatable rod 232 at or proximate to the front end 345 of their respective associated slot(s) 344 in the helically-slotted body 340.

Referring back to FIGS. 12A-14, when the exemplary tool 200 is used for locking the attachment pin 34, any suitable components and techniques may be used to open one or more grippers 220 and disengage the tool 200 from the attachment pin 34 after the pin 34 has been moved into locking engagement with the support surface 16. In this embodiment, one or more keys 430 (e.g. FIG. 16A) are configured to assist in moving the grippers 220 from an engaged to a disengaged position after moving the attachment pin 34 into a locked position. The exemplary keys 430 may be used to essentially limit or prevent the concurrent linear, axial, rearward movement of the exemplary rotator 230 and nose 270 with grippers 220 (such as described above) when such movement is not desired or necessary.

Figure 26:
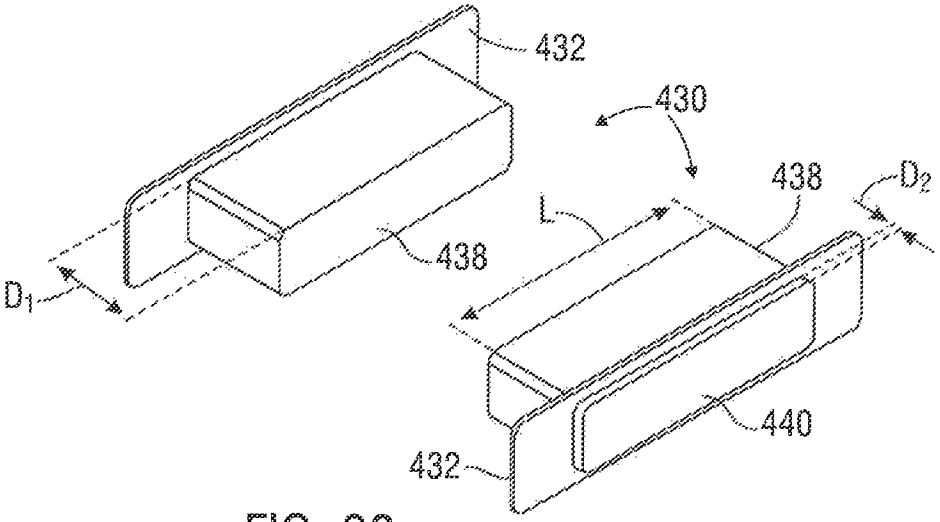
FIG. 26 is a perspective view of the exemplary keys of the power tool of FIGS. 12A-B in accordance with one or more embodiments of the present disclosure.

When included, the key 430 may have any suitable form, configuration and operation. As shown in FIGS. 16A & 26, the exemplary key 430 is elongated, reversible and includes a flange 432, at least one deep protrusion 438 extending outwardly on one side thereof and at least one shallow protrusion 440 extending outwardly on the other side. At least one illustrated key 430 is releasably retained in a longitudinally-oriented slot 434 formed in the main body 216 of the carrier 210 (e.g. FIG. 15). For example, one or more keys 430 may be provided in each among two longitudinally-oriented slots 434 formed in opposing sides of the main body 216 in axial linear alignment with the respective sliders 412 in the nose 270. Each exemplary longitudinally-oriented slot 434 is configured to allow the corresponding key(s) 430 to slide therein within a defined range of linear, axial movement relative to the main body 216. For example, each illustrated longitudinally-oriented slot 434 is longer than its associated key(s) 430 and at least partially surrounded by at least one elongated recess 436 (e.g. FIG. 15) formed in the main body 216 to seat the flange 432 of the corresponding key(s) 430 and allow and/or assist in guiding the sliding movement of the key 430 relative to the main body 216. However, the keys 430 and related components may have different features or may not be included.

Referring still to FIGS. 16A & 26, since the illustrated key 430 is reversible, the key 430 may be positioned so that either the deep or shallow protrusion 438, 440 faces and protrudes inwardly into the bore 243 of the main body 216 forward of the helically-slotted body 340 and rearward of the nose 270, and the other protrusion 438, 440 faces and protrudes outwardly. The exemplary deep protrusion 438 has a depth $D_1$ (e.g. 1.0 inches or more or less) such that when the deep protrusion 438 faces inwardly (e.g. FIG. 33A), it will protrude into the bore 243 of the main body 216 and at least partially block the movement of at least certain other components through the bore 423 thereby. If desired, the protrusions 438, 440 may be formed with a length L (e.g. FIG. 26) equal to the length of the linear portion 398 of the slots 344 in the helically-slotted body 340. For example, when it is desired to extract the attachment pin 34 four inches (4.0") from its seated position in the support surface 16 during unlocking operations, the linear portion 398 of each slot 344 in the helically-slotted body 340 and each protrusion 438, 440 may each have a length of three inches (4.0"). However, any other desired length dimensions of these features may be used (e.g. 1.0", 2.5", 3.0", 3.5", 4.5" or more or less). Further, the length of the protrusion 438, 440, linear portion(s) 398 of each slot 344 and the desired extraction distance for the attachment pin 34 may not be the same.

In this embodiment, when the illustrated tool 200 is used for locking the attachment pin 34 to the support surface 16, at least one key 430 is oriented with the deep protrusion 438 facing inwardly to limit or inhibit relative axial movement between the nose 270 (and grippers 220 carried thereby) and the helically-slotted body 340 in the bore 243 of the main body 216 (e.g. after the rotator 230 has rotated the attachment pin 34 into a locked position). For example, referring to FIGS. 37A-38B, after the exemplary attachment pin 34 has been rotated into a locked position and the trigger 380 continues to be depressed (pressurizing the front portion 360 of the cylinder tube 324), the exemplary track roller(s) 348 of the rotatable rod 232 will be forced to travel through the linear portions 398 of the respective associated slot(s) 344 in the helically-slotted body 340 (e.g. such as described above). The front end 354 of the illustrated helically-slotted body 340 will, in this configuration, contact the deep protrusion 438 of at least one key 430 and typically push the key 430 forward (downward) in its associated slot 434 (e.g. FIG. 16A) in the main body 216. When the down-stroke of the exemplary helically-slotted body 340 is stopped (e.g. by its protrusion(s) 351 reaching the front end 387 of the corresponding slot(s) 386 in the main body 216), the exemplary nose 270 will typically be forced to move up. One or more exemplary sliders 412 in the nose 270 will be drawn into contact with the aligned deep protrusion 438 of one of the keys 430 and biased or pushed downwardly (e.g. ⅝" or more or less), causing the outer face 261 of the rear end 258 of at least one exemplary gripper 220 (e.g. FIGS. 17) to ride across at least one engagement face 414 of at least one slider 412 to lever the grippers 220 open. It should be noted that the occurrence and order of these actions may vary depending upon the particular embodiment and configuration of the tool 200 and the particular circumstances of use of the tool 200. For example, in some instances, the key(s) 340 may already be in their lowermost position, the full down-stroke of the helically-slotted body 340 may be achieved before the key(s) 340 are in their lowermost position, or the keys 340 may not be axially slideable. Thus, the present disclosure is not limited to the inclusion and order of each of the above actions.

Accordingly, the deep protrusion 438 "facing-inwardly" position of the exemplary keys 430 is typically desirable when the exemplary tool 200 is used to lock the attachment pin 34 to the support surface 16 and there is no need or desire to subsequently move the grippers 220 (engaged with the attachment pin 34) upwardly (such as described above when the tool 200 is used to unlock the attachment pin 34). However, any other sequence of actions may be used to open the grippers 220 after locking the attachment pin 34. And, in some embodiments, this feature may not be included.

Referring back to FIGS. 16A & 26, when the exemplary tool 200 includes one or more keys 430 and is used to unlock and extract the attachment pin 34, the exemplary shallow protrusion 440 of each illustrated key 430 is oriented facing inwardly. Each illustrated shallow protrusion 440 is formed with a shallow depth $D_2$ (e.g. 0.25 inches or more or less) so that when the keys 430 are oriented with the shallow protrusions 440 facing inwardly, the keys 430 will not obstruct relative axial movement of the helically-slotted body 340 and the nose 270 in the bore 243 of the main body 216. This arrangement should typically allow the nose 270, grippers 220 and engaged attachment pin 34 to be drawn up and away from the support surface 16 after disengaging the pin 34 from the support surface 16, such as described above.

Thus, in this embodiment, the tool 200 is configured to be oriented with the shallow protrusions 440 of the keys 430 facing inwardly during pin unlocking and/or extraction operations and the deep protrusions 438 of the keys 430 facing inwardly during pin locking operations. However, the keys 430 and helically-slotted body 340 may have a different form, configuration and operation, and any other suitable arrangement of components may be used to open one or more grippers 220. For example, one or more keys 430 (or other component(s)) may instead be selectively expandable (e.g. with one or more bladders, accordion-like configuration or the like), or moveable in a different manner than described above between two or more positions, alleviating the need for use of a reversible key 430 such as described herein. In some embodiments, the key 430 may not be elongated or reversible and other features may be included to allow each key 430 to function as desired. Various embodiments may not include any keys 430. For example, in embodiments of the tool 200 configured for only locking the attachment pin 34 to the support surface 16, there may be no need for a reversible key 430.

Referring to FIGS. 16A-B, when included, the key(s) 430 may be retained in the tool 200 in any suitable manner. For example, one or more key-retention sleeves 450 may be configured to retain the keys 430 in the tool 200. The key-retention sleeve 450 may have any suitable form, configuration and operation. In this embodiment, a single cylindrical key-retention sleeve 450 extends at least substantially around at least part of the main body 216 and includes slots 452 configured to retain the keys 430 in the slots 434 of the main body 216. The illustrated slots 452 are large enough to allow either protrusion 438, 440 to extend therethrough but not the flanges 432, so as to bias or hold (e.g. sandwich) the flange 432 of each key 430 into the corresponding recess(s) 436 formed in the main body 216 without disturbing the axial movement of the keys 430 or obstructing the protrusions 438, 440. However, any other desired configuration of components may be used to retain the keys 430 in the tool 200.

Still referring to FIGS. 16A-B, in this embodiment, to reverse the keys 430 (e.g. between use of the illustrated tool 200 for locking and unlocking the pin(s) 34), the exemplary key-retention sleeve 450 may be moved away from the keys 430 sufficient to allow the keys 430 to fall out of or, be removed from, the tool 200. The illustrated keys 430 may then be reversed and reinserted into the slots 434 of the main body 216 and the key-retention sleeve 450 repositioned over the main body 216. The key-retention sleeve 450 may be movable away from the keys 430 in any desired manner. For example, a releasable anchor 454 (e.g. FIG. 12B) may be associated with the key-retention sleeve 450 to secure the position of the key-retention sleeve 450 over the main body 216 and allow the key-retention sleeve 450 to be moved, removed and replaced, etc. In this embodiment, the anchor 454 includes at least one O-ring 456 (e.g. FIG. 12B) releasably secured in a groove 460 formed in the main body 216 (e.g. proximate to its rear end 217, e.g. FIG. 15). The exemplary O-ring 456 (or other form of anchor 454) may be slid rearwards away from the main body 216 to allow the key-retention sleeve 450 to be slid rearwards (upwards) sufficient to allow the keys 430 to be removed, reversed and re-inserted into the main body 216. After the exemplary keys 430 are reversed and reinstalled, the exemplary key-retention sleeve 450 may be slid forward (down) and secured in its desired position by the O-ring 456 (e.g. slid back down into the groove 460). However, the anchor 454, when included, may have any other suitable form (e.g. one or more clips, snap-rings, etc.) and operation.

If desired, the exemplary key-retention sleeve 450 may also serve as a protective cover over at least part of the main body 216 and/or have any other purpose. For example, the key-retention sleeve 450 may cover the slot(s) 386 formed in the main body 216 and the protrusions 351 of the helically-slotted body 340 extending therethrough, assist in preventing debris from entering the slots 386 and tool 200, provide lubricant for the slots 386, serve as a replaceable wear sleeve, have any other purpose(s) or a combination thereof. For example, the key-retention sleeve 450 may be constructed at least partially of lubricating or lubricant-containing material (e.g. oil-filled-nylon) to serve as a lubricant.

Still referring to FIGS. 16A-B, when an attachment pin manipulation operation has been completed (e.g. locking, unlocking, extracting, disengaging, etc.) or at any other desired time, the exemplary gripper(s) 220 and rotator(s) 230 may be reset. For example, releasing the illustrated trigger 380 switches the control valve 374 back to its start/default position, returning the piston 336 of the rotatable rod 232 (e.g. FIG. 19) to near the front end 332 of the cylinder tube 324 and the track roller(s) 348 of the rotatable rod 232 at, or proximate to, the front end 345 of the respective associated slot(s) 344 of the helically-slotted body 340 (e.g. FIG. 23). Thereafter, the attachment pin manipulation operations can be continued on another attachment pin 34 or otherwise as desired. However, this feature is not required and may not be included in various embodiments.

Referring back to FIGS. 12A-14, an embodiment of a method of use of the exemplary tool 200 to lock or unlock an attachment pin 34 during normal operating conditions will now be described. When the tool 220 includes one or more keys 430, the shallow protrusions 440 are positioned to face inwardly for unlocking the pin 34 (e.g. FIG. 27A) from the support surface 16, or the deep protrusions 438 are positioned to face inwardly for locking the pin 34 (e.g. FIG. 33A) to the support surface 16. The exemplary power-driven actuator 240 of the tool 200 is connected to a power source 312, such as described above, supplying pressurized fluid into the rear portion 362 of the cylinder tube 324 and allowing fluid to escape from the front portion 360. This represents the first position of the exemplary control valve 374 and the start position of the tool 200.

An operator can typically hold the exemplary fixed-position handle 218*a* with the right hand and the moving handle 218*b* with the left hand so the tool 200 hangs down (e.g. like a pendulum). It should be noted, the handles 218*a*, 218*b* can be quickly and easily repositioned as desired. For example, the handles 218*a*, 218*b* can be moved to extend from the opposite sides of the tool 200 (as shown) to accommodate left-handed operators, to different heights on the tool 200 to accommodate different-height operators, for ergonomic reasons or any other purpose. The operator may then orient the exemplary grippers 220 over the opposing shorts sides, 72, 74 of the attachment pin head 36 and set the tool 200 down (e.g. arrow 500, FIGS. 27A-28B for unlocking, FIGS. 33A-34B for locking) over the attachment pin 34. In some instances, the front edges 268 of the exemplary main body 216 may straddle the long sides 86, 88 of attachment pin 34 and abut, or rest upon, the upper surface 27 of the uppermost ground cover 26*a*.

Figure 27B:
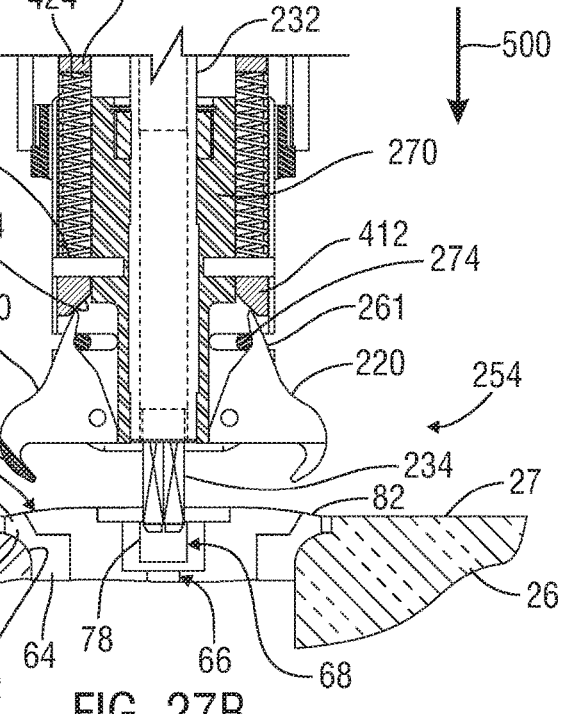
FIG. 27B is an exploded view of part of the exemplary power tool shown in FIG. 27A.

Still referring to FIGS. 12A-14, the mating portion 234 of the exemplary rotator 230 should align over the mateable portion 68 of the attachment pin 34 (e.g. FIG. 27B). If the exemplary mating portion 234 is perfectly indexed with the mateable portion 68 of the attachment pin 34, it will slip into the desired position (e.g. FIG. 28B). If not, the exemplary mating portion 234 may be pushed back up into the rotatable rod 232, rather than damaging or jamming the tool 200 or preventing the tool 200 from descending into the proper position and potentially delaying operations (e.g. prompt rotation of the second portion 66 of the attachment pin 34). If the exemplary mating portion 234 is pushed back, the tool 200 can continue descending over the attachment pin 34 as desired. The exemplary grippers 220 should bias around and engage the first portion 64 of the attachment pin 34 (e.g. FIGS. 28B & 29B).

As soon as the operator depresses the exemplary trigger 380 (e.g. with his/her right thumb), pressure will be provided in the front portion 360 of the cylinder tube 324, pushing the helically-slotted body 340 linearly down toward the support surface 16, forcing the track roller(s) 348 of the rotatable rod 232 (e.g. FIG. 19) to travel through the helical portions 358 of their respective associated slots 344 in the helically-slotted body 340 and rotating (e.g. 90°) the rotatable rod 232 (e.g. FIGS. 30A-B, 36A-B). If the exemplary mating portion 234 had been pushed back up into the rotatable rod 232, it should instantaneously or nearly instantaneously rotate into proper index and then axially slide into engagement with the mateable portion 68 of the attachment pin 34 and rotate the second portion 66 of the attachment pin 34 into a locked or unlocked position as desired.

Thereafter, if the pin 34 was unlocked from the support surface 16, continued pressure on the exemplary trigger 380 will cause the grippers 220 and engaged pin 34 to move up away from the support surface 16 and then cause the grippers 220 to disengage from the pin 34 (e.g. FIGS. 32A-B). If the pin 34 was locked to the support surface 16, continued pressure on the exemplary trigger 380 will cause the grippers 220 to disengage from the pin 34 (e.g. FIGS. 38A-B). In either case, the operator may choose to lift, or swing, the tool up and away from, or off of, the support surface 16 to allow the attachment pin 34 to fall out of the tool 200. Upon releasing the exemplary trigger 380, the control valve 374 will switch back to its default/start position (e.g. FIG. 27A), returning the tool 200 to a start position. However, any other techniques using any other components may be used to lock or unlock an attachment pin 34 to/from a support surface 16.

Now referring to FIGS. 27A-32B, an exemplary method of unlocking, extracting and disengaging an exemplary attachment pin 34 from a support surface 16 with this embodiment of the tool 200 will be described. Referring initially to FIGS. 27A-B, the exemplary tool 200 is shown with the keys 430 arranged so that the respective deep protrusions 438 thereof face outwardly and the shallow protrusions 440 thereof face inwardly in the bore 243 of the main body 216. This configuration will allow the illustrated nose 270, grippers 220 and engaged attachment pin 34 to be drawn up and away from the support surface 16 after disengaging the pin 34 from the support surface 16.

The exemplary power-driven actuator 240 of the tool 200 is connected to a power source 312, such as described above, supplying pressurized fluid into the rear portion 362 of the cylinder tube 324 and allowing fluid to escape from the front portion 360. This represents the first position of the exemplary control valve 374 and the start position of the illustrated tool 200. In this position, the illustrated piston 336 of the rotatable rod 232 is near the front end 332 of the cylinder tube 324 and the track roller(s) 348 of the rotatable rod 232 are at or proximate to the front end 345 of the respective associated slot(s) 344 of the helically-slotted body 340. The exemplary grippers 220 are in a disengaged, or extended, position as the tool 200 is being lowered over the attachment pin 34 and support surface 16 (e.g. arrow 500). It should be noted that any other technique and components may be used to initiate attachment pin manipulation operations. Thus, any among the power source 312, power-driven actuator 240, and grippers 220 and their components thereof may differ in kind and operation as compared to the embodiments described herein or may not be included.

Figure 28A:
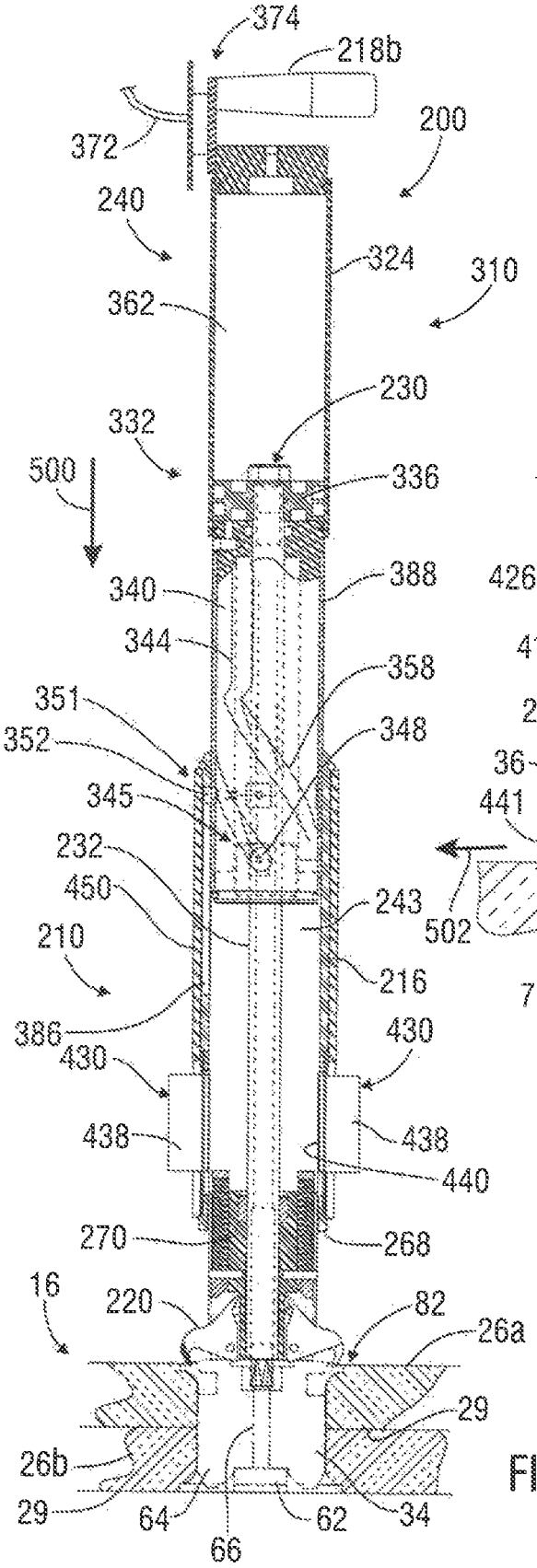
FIGS. 28A & 29A are front, partial cross-sectional views of the exemplary power tool of FIG. 27A showing the exemplary grippers and rotator engaging the illustrated attachment pin in accordance with one or more embodiments of the present disclosure.
Figure 28B:
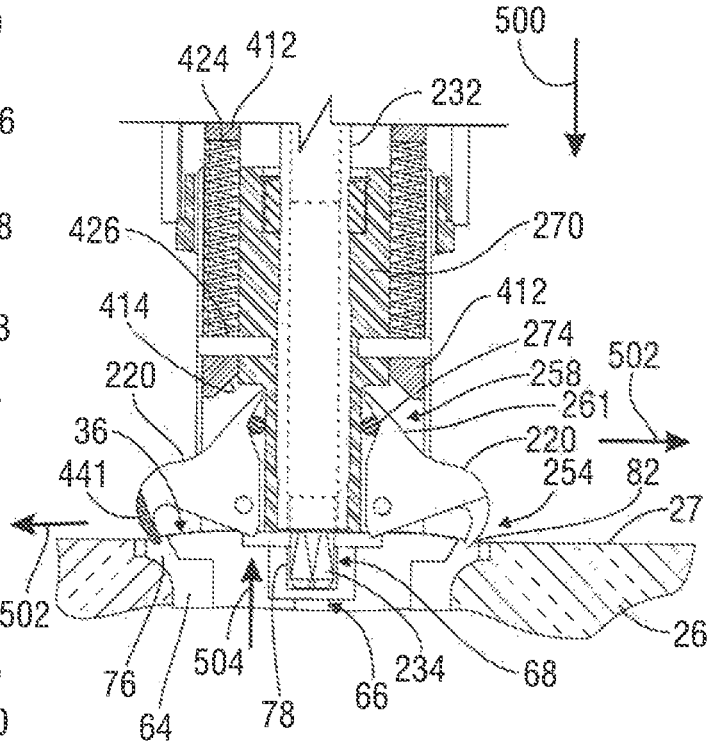
FIGS. 28B & 29B are exploded views of part of the exemplary power tool shown in FIGS. 28A & 29A, respectively.

In FIGS. 28A-B, as the exemplary tool 200 continues to be lowered down (e.g. arrow 500), the grippers 220 are shown contacting the head 36 (or upper end) of the attachment pin 34, pushing the front end 254 of the gripper(s) 220 further outwardly (e.g. arrows 502). Since the illustrated grippers 220 are spring-loaded inwardly, they will typically stay engaged or pressed against the pin head 34 (e.g. at the flange 82). The mating portion 234 of the exemplary rotator 230 should align over the mateable portion 68 of the attachment pin 34. If the mating portion 234 of the exemplary rotator 230 is not perfectly indexed with the mateable portion 68 of the attachment pin 34 and, since it is spring-biased downwardly, it may be pushed up (e.g. arrow 504) into the rotatable rod 232 (e.g. rather than damaging or jamming the tool 200 or preventing the tool 200 from descending into the proper position), allowing the tool 200 to continue descending over the attachment pin 34. However, these features are not required and may not be included.

Figure 29A:
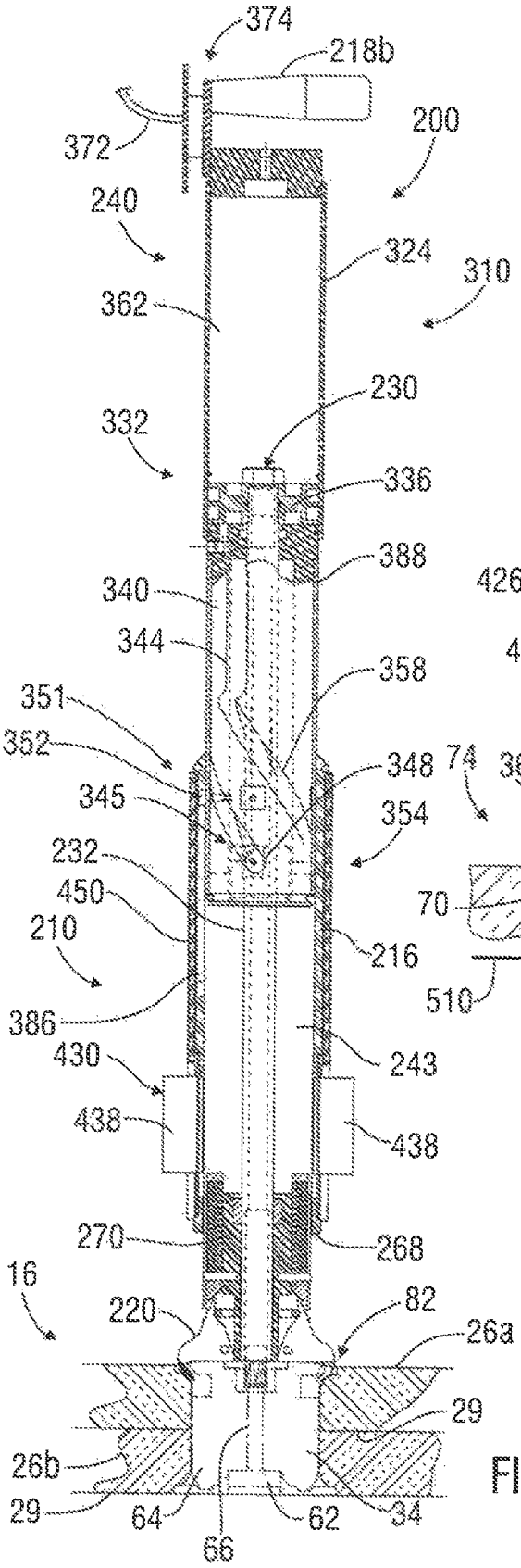
Figure 29B:
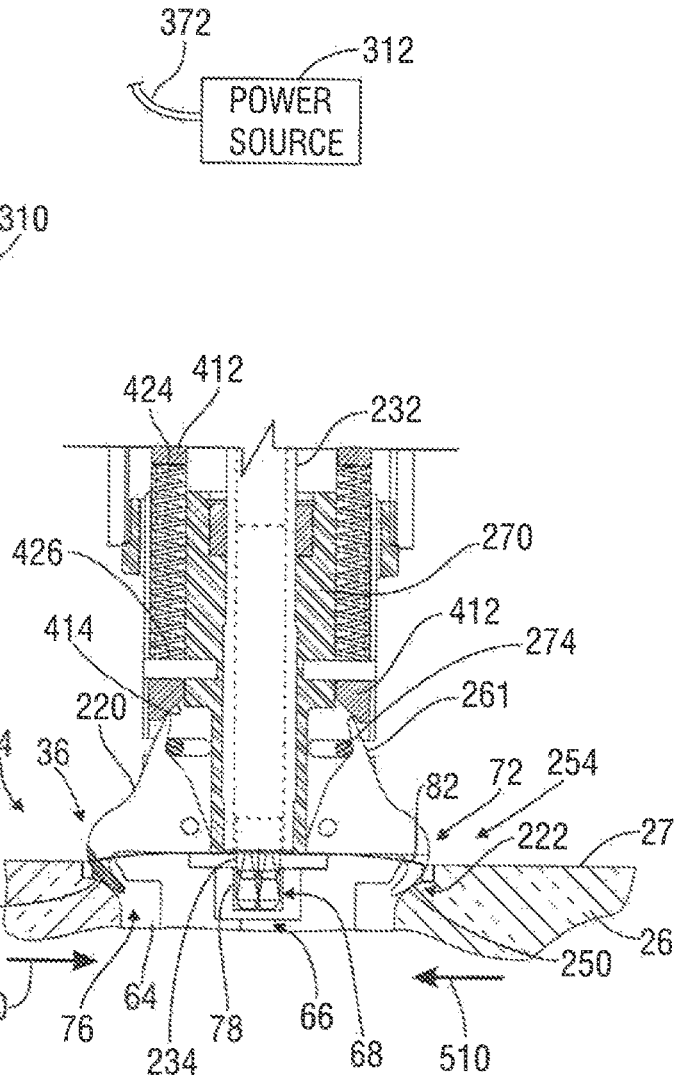

Referring now to FIGS. 29A-B, at or near the end of the downward movement of the exemplary tool 200, the illustrated grippers 220 are shown having moved back inwardly (e.g. arrows 510) and snapped or settled into gripping engagement with the attachment pin 82 (e.g. around the flange 82 of the head 36 thereof). For example, the respective tooth 250 of the claw 222 of each gripper 220 is shown gripping one of the opposing short sides 72, 74 of the head 36 of the attachment pin 34.

Figure 30A:
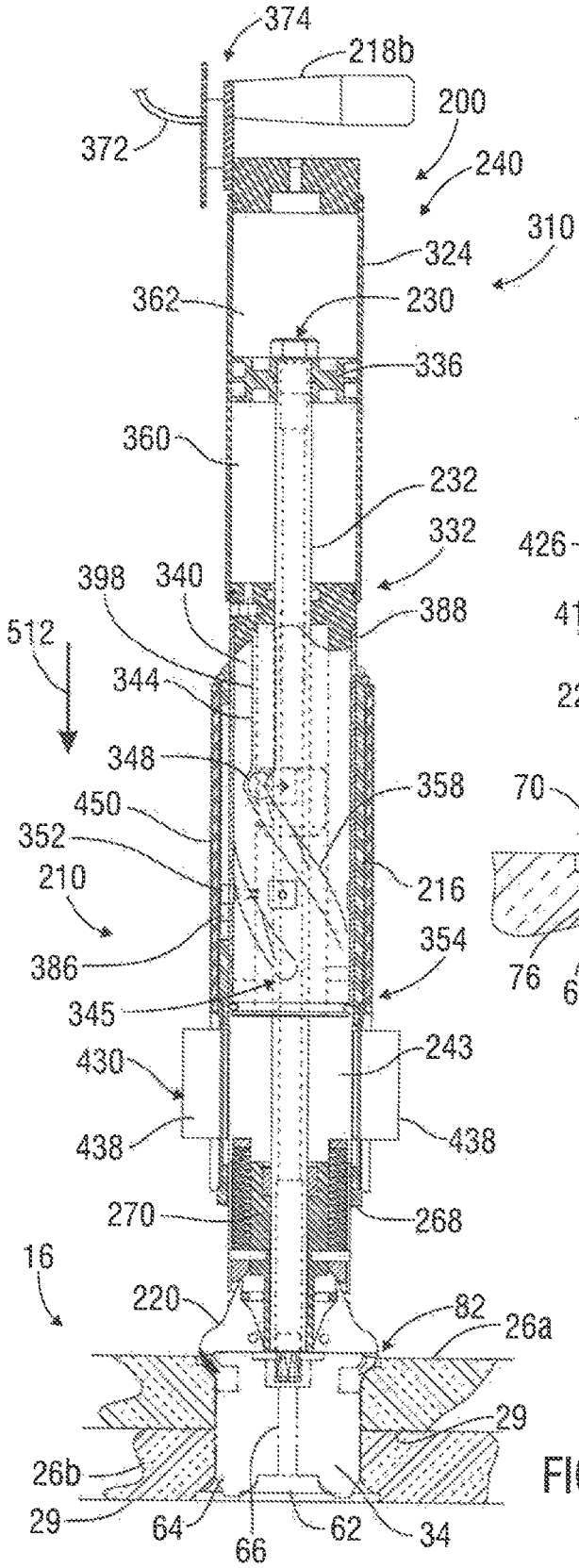
FIG. 30A is a front, partial cross-sectional view of the exemplary power tool of FIG. 27A showing the exemplary rotator rotating the second portion of the illustrated attachment pin to unlock the pin from the exemplary support surface in accordance with one or more embodiments of the present disclosure.
Figure 30B:
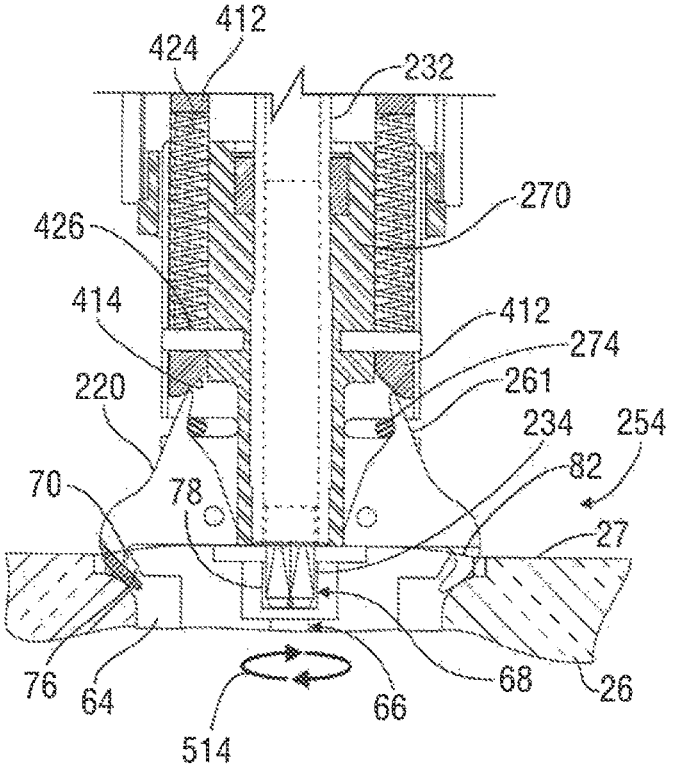
FIG. 30B is an exploded view of part of the exemplary power tool shown in FIG. 30A.

In FIGS. 30A-B, the exemplary trigger 380 (e.g. FIG. 16B) has been depressed, moving the control valve 374 to its second position, which supplies pressurized fluid into the rod side, or front portion, 360 of the cylinder tube 324 and opens the rear portion 362 to atmosphere. The pressure in the exemplary front portion 360 typically pushes the helically-slotted body 340 linearly down (e.g. arrow 512) toward the support surface 16, forcing the track roller(s) 348 of the rotatable rod 232 to travel through the helical portion 358 of their respective associated slot(s) 344 in the helically-slotted body 340, rotating the rotatable rod 232 (e.g. 90°) in a clockwise direction (e.g. arrow 514). Since the exemplary helically-slotted body 340 is restrained from rotation by its protrusions 351 (e.g. stud rollers 352) riding in the slots 386 in the main body 216, the rotation of the mating portion 234 of the rotator 230 and the attachment pin 34 pin is typically assured. If the exemplary mating portion 234 of the rotator 230 had been pushed up into the rotatable rod 232, it should instantaneously or nearly instantaneously rotate into proper index with the mateable portion 68 of the second portion 66 of the attachment pin 34, axially slide into engagement with the mateable portion 68 and rotate the second portion 66 of the pin 34 into an unlocked position. However, any other components and/or techniques may be used to rotate the mating portion 234 of the rotator 230 and/or the mateable portion 68 of the second portion 66 of the attachment pin 34 or otherwise unlock the attachment pin 34.

Now referring to FIGS. 31A-B, in this embodiment, once the attachment pin 34 has been unlocked from the support surface 16, continued pressurization of the exemplary front portion 360 of the cylinder tube 324 and linear downward movement of the helically-slotted body 340 (e.g. arrow 512) will force each track roller 348 of the rotatable rod 232 to travel through a short reverse-direction portion 384 of the associated slot 344 in the helically-slotted body 340 rearwards of the helical portion 358. Thus, at the end of rotation of the exemplary rotator 230 in one direction (e.g. 90° clockwise), the rotator 230 reverses direction (e.g. counter-clockwise, arrow 516). For example, the reverse-direction portion 384 may be configured to rotate the rotator 230 approximately 9° (or more or less) to relieve torsional load on the tool 200, allow the gripper(s) 220 to become torsionally inert (e.g. not jammed up against the shoulder(s) 70 of the attachment pin 34), for any other purpose(s) or a combination thereof. However, this feature may not be included.

Referring now to FIGS. 32A-B, if desired, the exemplary tool 200 may be capable of drawing the attachment pin 34 away from the support surface 16. In this embodiment, the exemplary rotator 230 is coupled to one or more grippers 220 to allow for their concurrent rearward movement relative to the carrier 210, such as by the collar(s) 400 secured via one or more retainers 406 and rotatable within the recess, or counterbore, 404 formed in the nose 270. After rotating (and, if included, counter-rotating) the exemplary rotatable rod 232, as the trigger 380 continues to be depressed and the front portion 360 of the cylinder tube 324 continues to be pressurized, the track roller(s) 348 of the rotatable rod 232 will be forced to travel through the linear portions 398 of the respective associated slot(s) 344 in the helically-slotted body 340, drawing the grippers 220 and attachment pin 34 up away from the support surface 16 (e.g. arrow 520) the desired distance. As indicated above, the illustrated nose 270 will be able to move up the desired distance through the bore 243 of the main body 216 adjacent to the shallow protrusions 440 of the keys 430. However, any other technique and components may be used to extract the attachment pin 34 from the support surface 16 or this capability and related components may not be included.

Still referring to FIGS. 32A-B, in this embodiment, the power-driven actuator 240 is operatively coupled to at least one gripper 220 and configured to cause it to move from an engaged to a disengaged position and consequently release the attachment pin 34. As the exemplary trigger 380 continues to be depressed, near the end of the pressurization of the front portion 360 of the cylinder tube 324 and downstroke of the helically-slotted body 340 (and/or upstroke of the rotator 230 and nose 270) and during the final linear movement of the track rollers 348 in the linear portions 398 of the tracks 344 in the helically-slotted body 340, the front end 354 of illustrated helically-slotted body 340 is shown contacting at least one slider 412 slideably mounted in the nose 270. This action will move or bias the exemplary slider(s) 412 forward (down, e.g. arrow 522) and into contact with one or more of the grippers 220 to open the gripper(s) 220 (e.g. arrows 524) and disengage the gripper(s) 220 from the attachment pin 34. At the same approximate time or thereafter, if desired, the operator may choose to lift or swing the illustrated tool 200 up off of or away from the support surface 16 to allow the attachment pin 34 to fall out of the tool 200. The operator may release the exemplary trigger 380 to switch the control valve 374 back to its default/start position, returning the piston 336 of the rotatable rod 232 to near the front end 332 of the cylinder tube 324 and the track roller(s) 348 at or proximate to the front end 345 of their respective associated slot(s) 344 in the helically-slotted body 340. However, any other technique and components may be used to disengage the tool 200 from attachment pin 34 or this feature and related components may not be included.

Figure 33A:
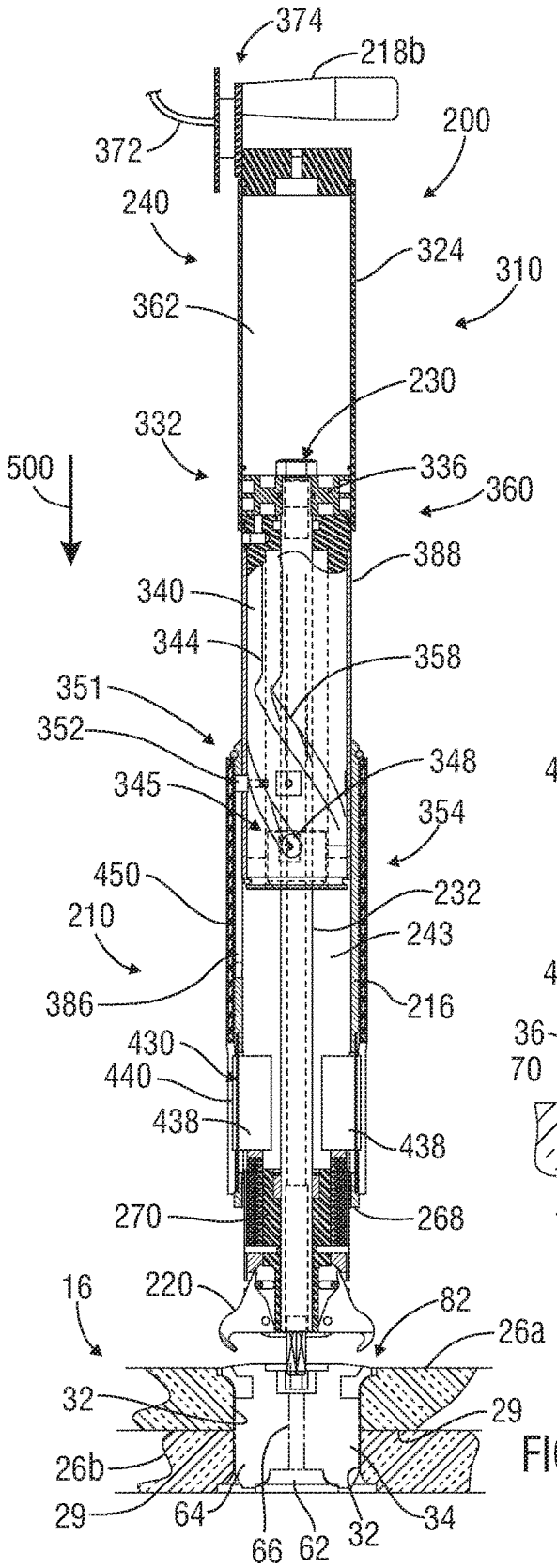
FIG. 33A is a front, partial cross-sectional view of the exemplary power tool of FIGS. 12A-B showing the tool being lowered prior to locking an exemplary attachment pin to an exemplary support surface in accordance with one or more embodiments of the present disclosure.
Figure 33B:
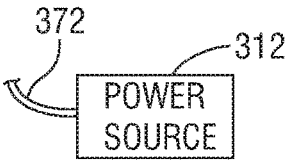
FIG. 33B is an exploded view of part of the exemplary power tool shown in FIG. 33A.
Figure 33B:
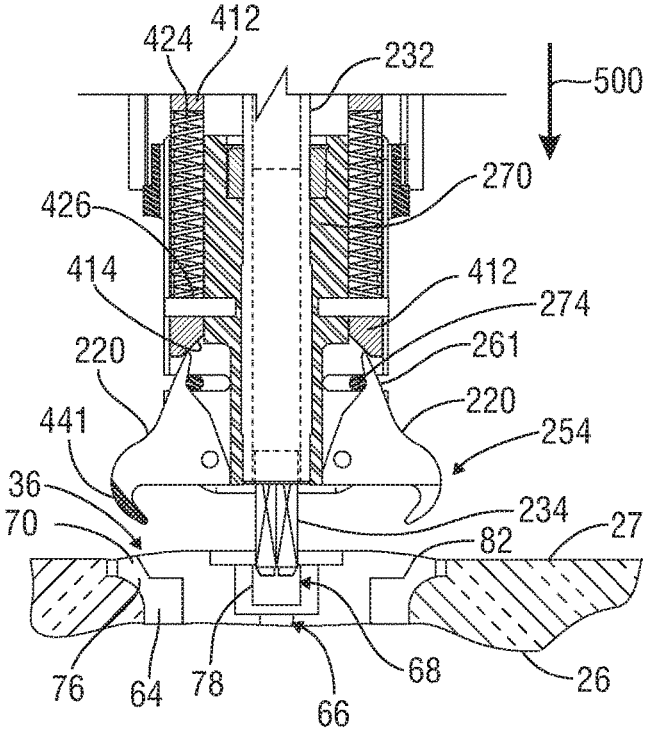

FIGS. 33A-38B illustrates an exemplary method of locking an exemplary attachment pin 34 with this embodiment of the attachment pin manipulation power tool 200. If desired, the exemplary tool 200 may be used to first pick up the attachment pin 34 and/or insert it into the desired attachment pin holes 32 before locking the attachment pin 34. Referring initially to FIGS. 33A-B, the exemplary tool 200 is shown with the keys 430 arranged so that the deep protrusions 438 face inwardly in the bore 243 of the main body 216 and the shallow protrusions 440 face outwardly. The exemplary power-driven actuator 240 of the tool 200 is connected to a power source 312, such as described above, supplying pressurized fluid into the rear portion 362 of the cylinder tube 324 and allowing fluid to escape from the front portion 360. This represents the first position of the exemplary control valve 374 and the start position of the illustrated tool 200. In this position, the illustrated piston 336 of the rotatable rod 232 is near the front end 332 of the cylinder tube 324 and the track roller(s) 348 of the rotatable rod 232 are at or proximate to the front end 345 of the respective associated slot(s) 344 of the helically-slotted body 340. The exemplary grippers 220 are in a disengaged, or extended, position as the tool 200 is being lowered over the attachment pin 34 and support surface 16 (e.g. arrow 500). It should be noted that any other technique and components may be used to initiate attachment pin manipulation operations. Thus, any among the power source 312, power-driven actuator 240, and grippers 220 and their components thereof may differ in kind and operation as compared to the embodiments described herein or may not be included.

Figure 34A:
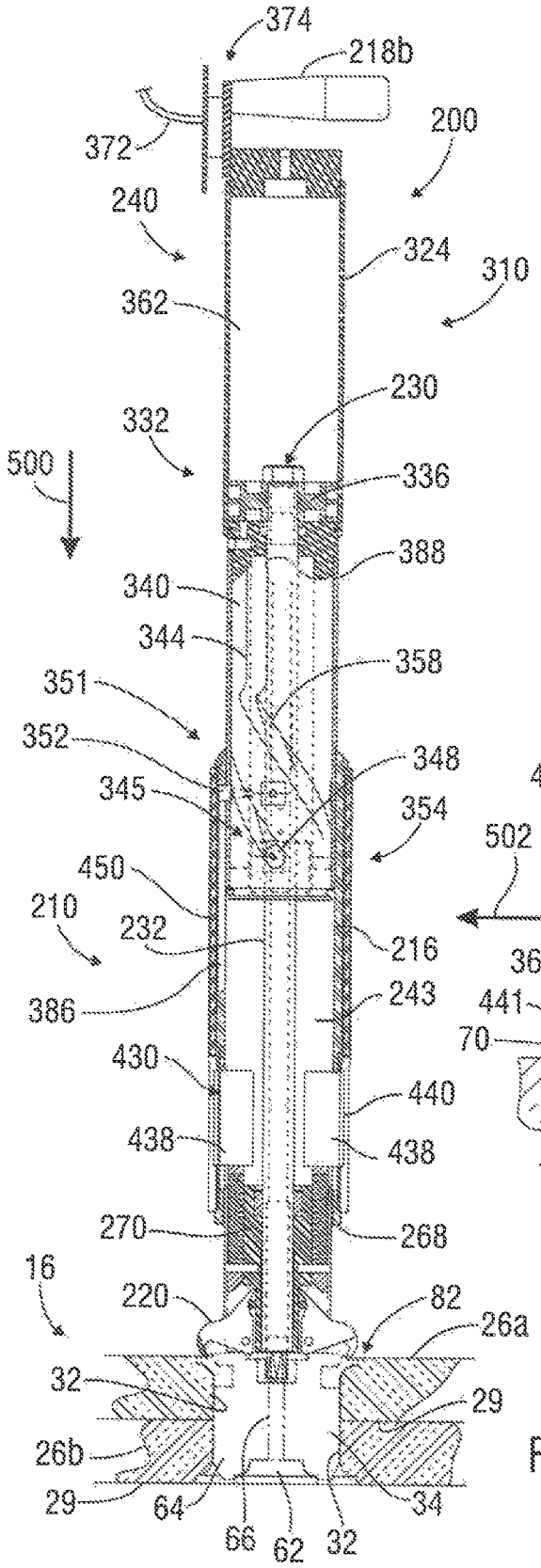
FIGS. 34A & 35A are front, partial cross-sectional views of the exemplary power tool of FIG. 33A showing the exemplary grippers and rotator engaging the illustrated attachment pin in accordance with one or more embodiments of the present disclosure.
Figure 34B:
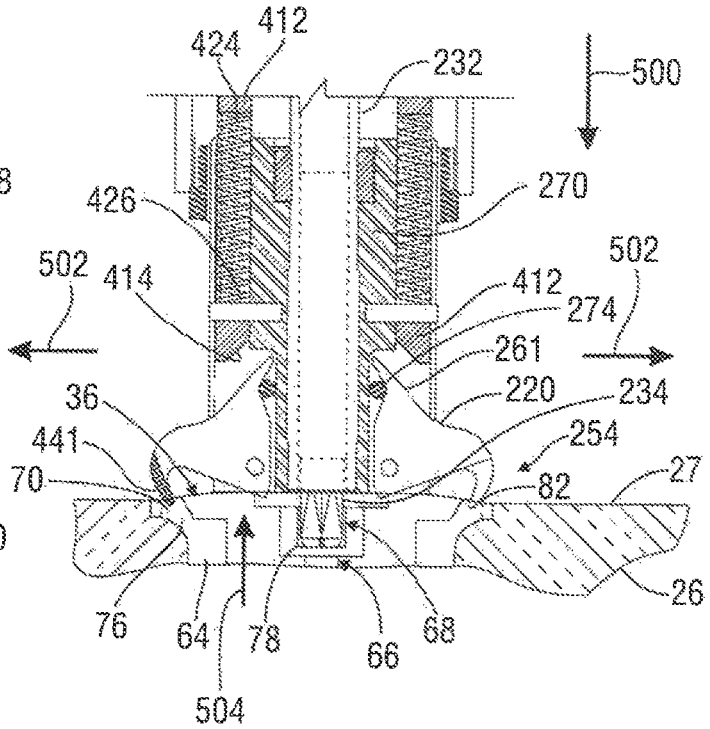
FIGS. 34B & 35B are exploded views of part of the exemplary power tool shown in FIGS. 34A & 35A, respectively.

Referring to FIGS. 34A-B, as the exemplary tool 200 continues to be lowered down (e.g. arrow 500), the grippers 220 are shown contacting the head 36 (or upper end) of the attachment pin 34, pushing the front end 254 of the gripper(s) 220 further outwardly (e.g. arrows 502). Since the illustrated grippers 220 are spring-loaded inwardly, they will typically stay engaged or pressed against the pin head 36 (e.g. at the flange 82). The mating portion 234 of the exemplary rotator 230 should align over the mateable portion 68 of the attachment pin 34. If the mating portion 234 of the exemplary rotator 230 is not perfectly indexed with the mateable portion 68 of the attachment pin 34 and, since it is spring-biased downwardly, it may be pushed back up (e.g. arrow 504) into the rotatable rod 232 (e.g. rather than damaging or jamming the tool 200 or preventing the tool 200 from descending into the proper position), allowing the tool 200 to continue descending over the attachment pin 34. However, these features are not required and may not be included.

Figure 35A:
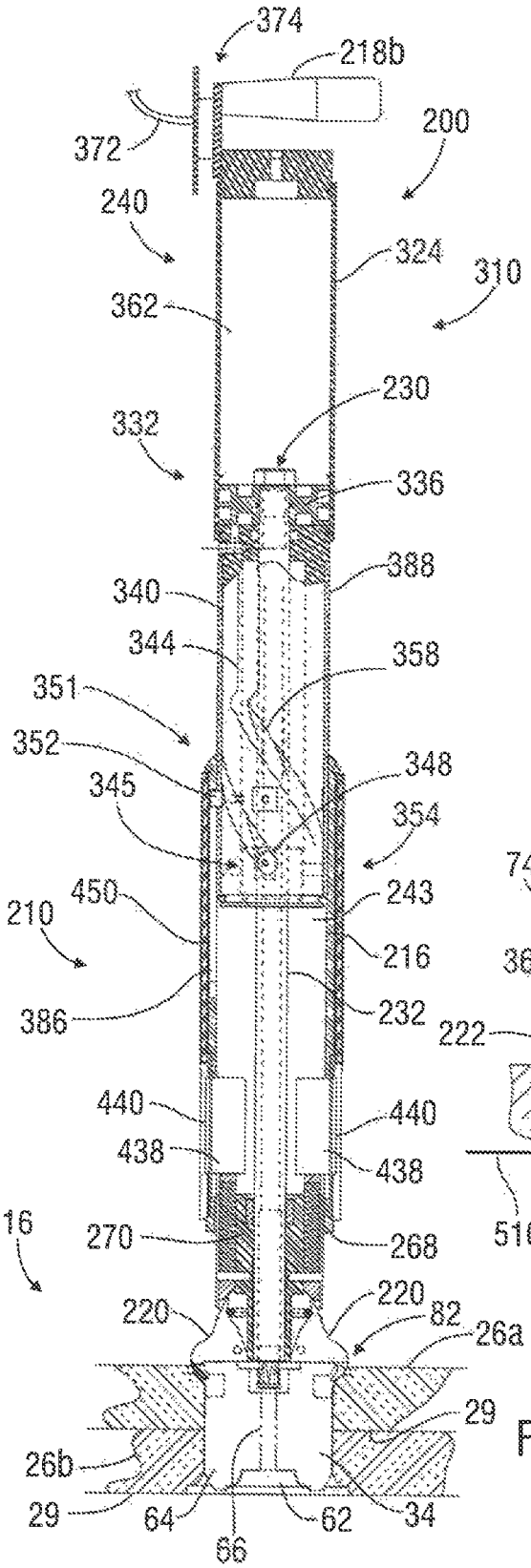
Figure 35B:
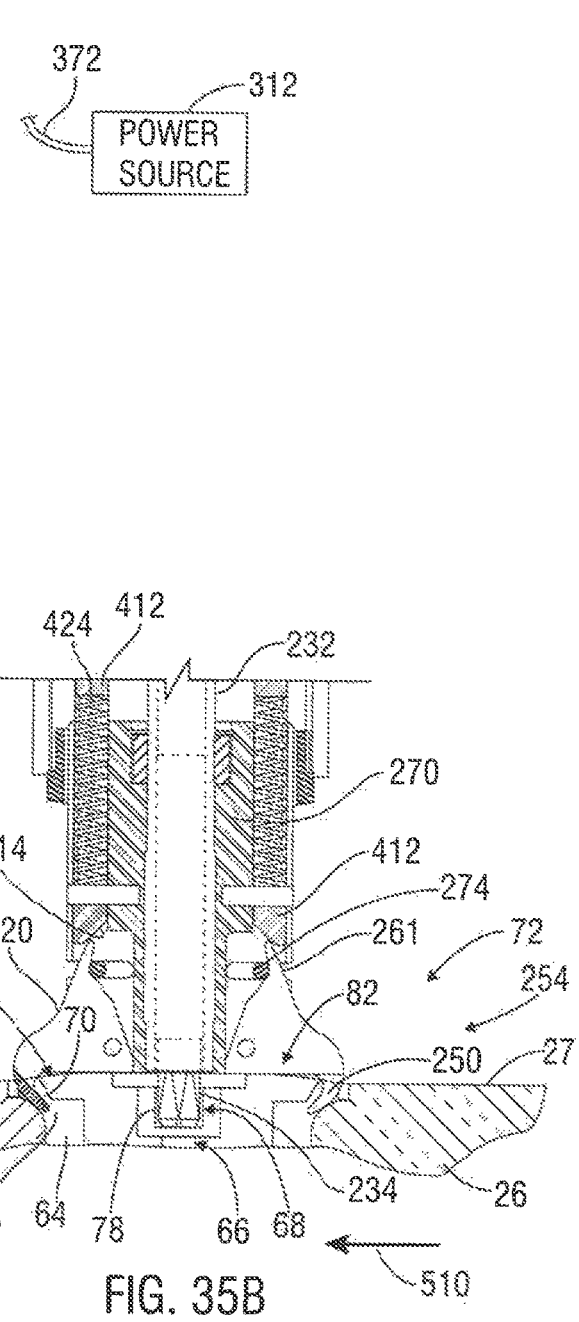

Referring now to FIGS. 35A-B, at or near the end of the downward movement of the exemplary tool 200, the illustrated grippers 220 are shown having moved back inwardly (e.g. arrows 510) and snapped or settled into gripping engagement with the attachment pin 82 (e.g. around the flange 82 of the head 36 thereof). For example, the respective tooth 250 of the claw 222 of each gripper 220 is shown gripping one of the opposing short sides 72, 74 of the head 36 of the attachment pin 34.

Figure 36A:
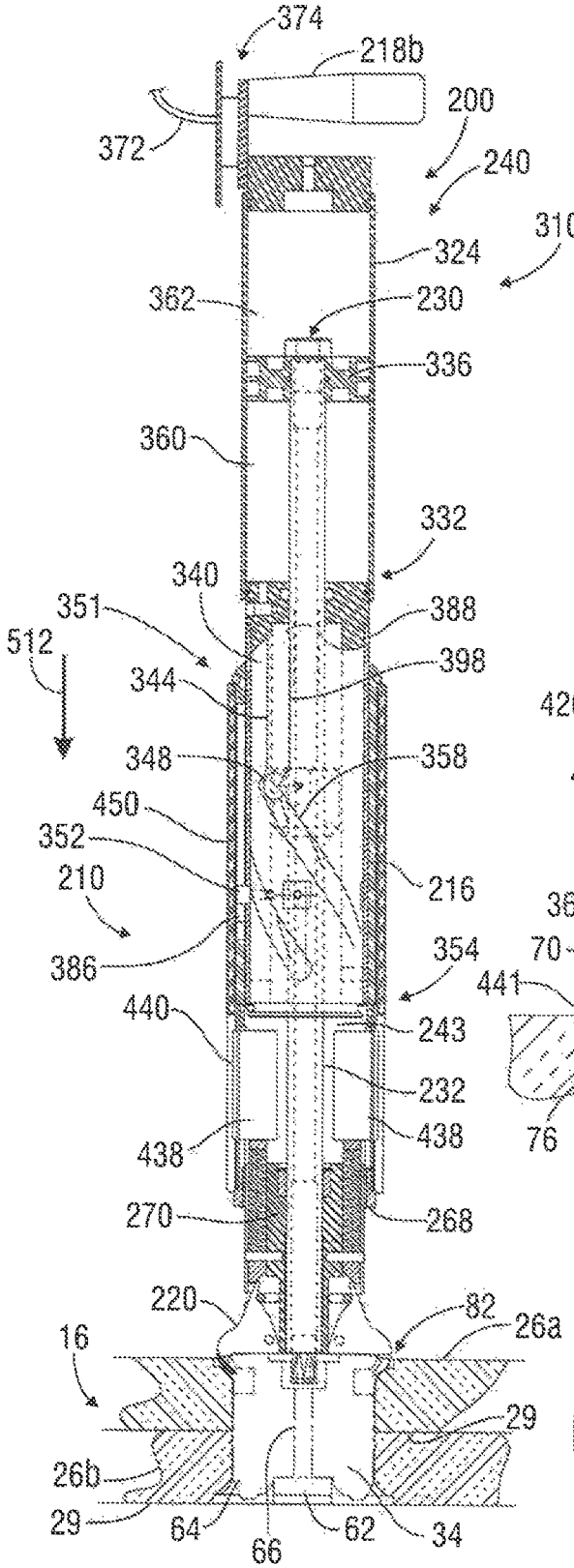
FIG. 36A is a front, partial cross-sectional view of the exemplary power tool of FIG. 33A showing the exemplary rotator rotating the second portion of the illustrated attachment pin to lock the pin to the exemplary support surface in accordance with one or more embodiments of the present disclosure.
Figure 36B:
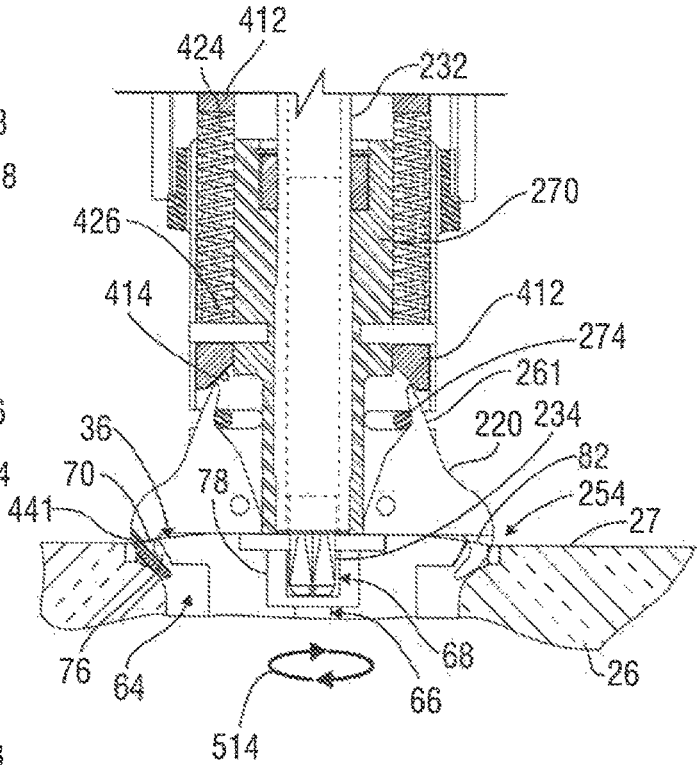
FIG. 36B is an exploded view of part of the exemplary power tool shown in FIG. 36A.

In FIGS. 36A-B, the exemplary trigger 380 (e.g. FIG. 16B) has been depressed, moving the control valve 374 to its second position, supplying pressurized fluid into the rod side, or front portion, 360 of the cylinder tube 324 and opening the rear portion 362 to atmosphere. The pressure in the exemplary front portion 360 typically pushes the helically-slotted body 340 linearly down (e.g. arrow 512) toward the support surface 16, forcing the track roller(s) 348 of the rotatable rod 232 to travel through the helical portion 358 of their respective associated slot(s) 344 in the helically-slotted body 340 to rotate the rotatable rod 232 in a clockwise direction (e.g. arrow 514) the desired distance (e.g. 90). If the exemplary mating portion 234 of the rotator 230 had been pushed back up into the rotatable rod 232, it should instantaneously or nearly instantaneously rotate into proper index with the mateable portion 68 of the second portion 66 of the attachment pin 34 then axially slide into engagement with the mateable portion 68 and rotate the second portion 66 of the pin 34 into a locked position. However, any other components and techniques may be used to rotate the mating portion 234 of the rotator 230 and/or the mateable portion 68 of the second portion 66 of the attachment pin 34 or otherwise lock the attachment pin 34 to the support surface 16.

Figure 37A:
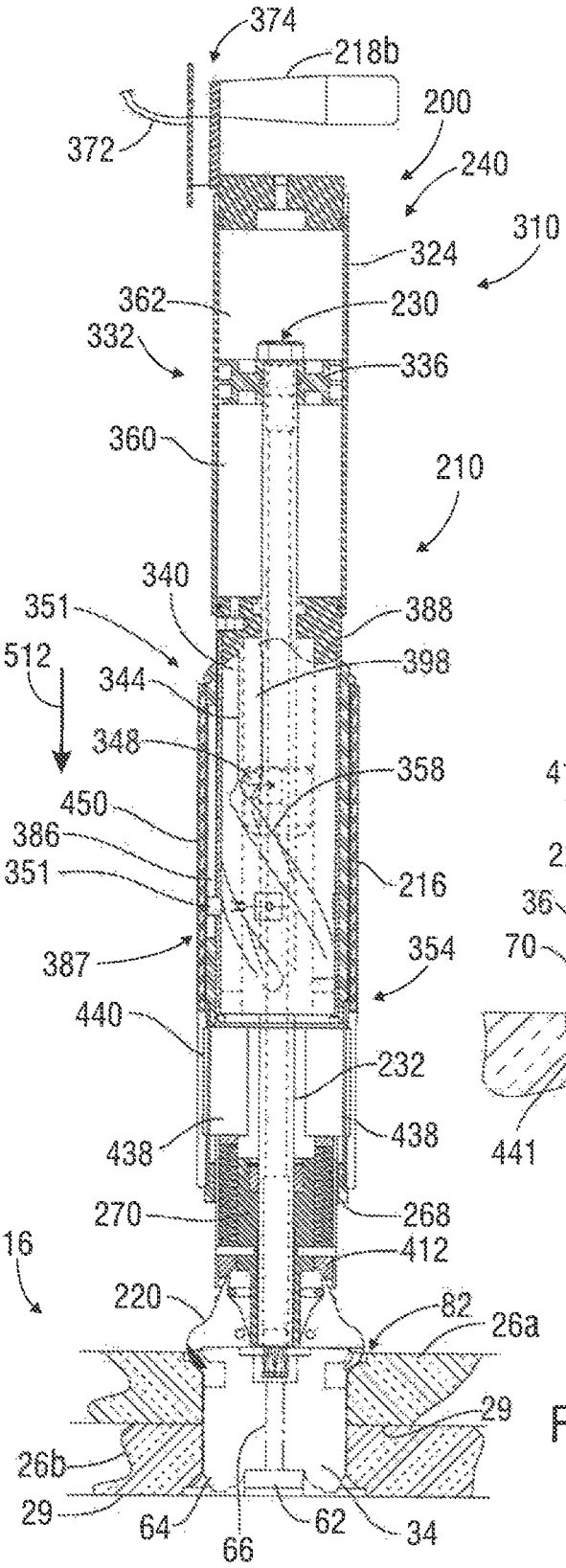
FIG. 37A is a front, partial cross-sectional view of the exemplary power tool of FIG. 33A showing the exemplary rotator counter-rotating the second portion of the illustrated attachment pin in accordance with one or more embodiments of the present disclosure.
Figure 37B:
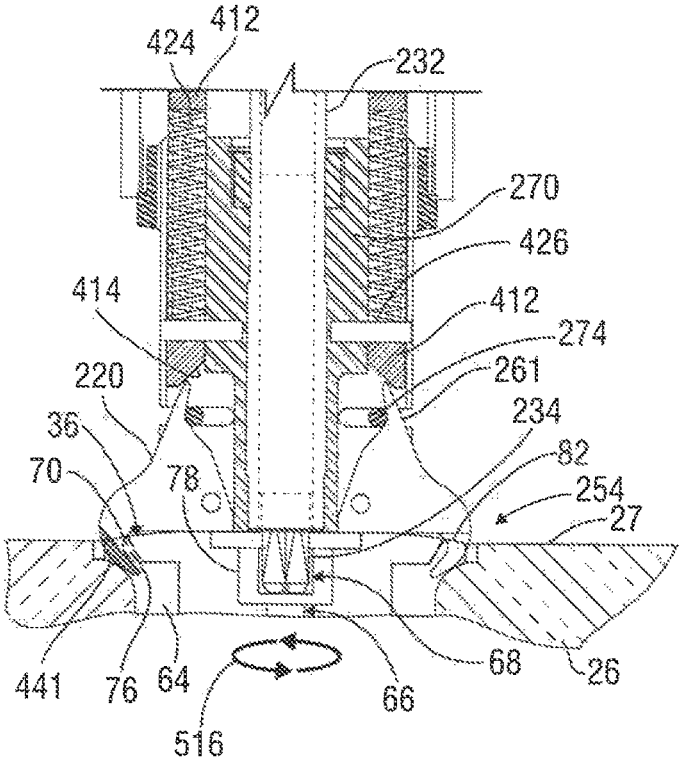
FIG. 37B is an exploded view of part of the exemplary power tool shown in FIG. 37A.

Now referring to FIGS. 37A-B, in this embodiment, once the attachment pin 34 has been locked to the support surface 16, continued pressurization of the exemplary front portion 360 of the cylinder tube 324 and linear downward movement of the helically-slotted body 340 (e.g. arrow 512) will force each track roller 348 of the rotatable rod 232 to travel through a short reverse-direction portion 384 of the associated slot 344 in the helically-slotted body 340 rearwards of the helical portion 358. Thus, at the end of rotation of the exemplary rotator 230 in one direction (e.g. clockwise), the rotator 230 reverses direction (e.g. counterclockwise, arrow 516). For example, the reverse-direction portion 384 may be configured to rotate the rotator 230 approximately 9° (or more or less) to relieve torsional load on the tool 200, allow the gripper(s) 220 to become torsionally inert (e.g. not jammed up against the shoulder(s) 70 of the attachment pin 34), any other purpose or a combination thereof. However, this feature may not be included.

In FIGS. 38A-B, if desired, the exemplary tool 200 may be capable of disengaging from the pin 34. In this embodiment, the power-driven actuator 240 is operatively coupled to at least one gripper 220 and configured to cause it to move from an engaged to a disengaged position and consequently release the attachment pin 34. As the exemplary trigger 380 continues to be depressed to pressurize the front portion 360 of the cylinder tube 324 and move the helically-slotted body 340 downwards (and/or the rotator 230 and nose 270 upwards), the track rollers 348 of the rotator 348 will be forced to travel in the linear portions 398 of the respective slots 344 in the helically-slotted body 340. However, the front end 354 of illustrated helically-slotted body 340 will typically contact the deep protrusion 438 of at least one of the keys 430 that is blocking its path in the bore 243 of the main body 216 and the key(s) 430 will typically contact at least one slider 412 slideably mounted in the nose 270. The exemplary slider(s) 412 should be biased or pushed downwardly (e.g. arrow 522), causing the outer face 261 of the rear end 258 of at least one exemplary gripper 220 to ultimately ride across at least one engagement face 414 of at least one slider 412 to open the gripper(s) 220 (e.g. arrows 524) and disengage the gripper(s) 220 from the attachment pin 34.

Thereafter, if desired, the operator may release the exemplary trigger 380 to switch the control valve 374 back to its default/start position, returning the piston 336 of the rotatable rod 232 to near the front end 332 of the cylinder tube 324 and the track roller(s) 348 of the rotatable rod 232 at or proximate to the front end 345 of their respective associated slot(s) 344 of the helically-slotted body 340. However, any other technique and components may be used to disengage the tool 200 from attachment pin 34 or this feature and related components may not be included.

FIGS. 39A-45 depict another embodiment of an attachment pin manipulation power tool 200 and methods for locking and unlocking an attachment pin 34 in accordance with the present disclosure. It should be noted that all of the details and description provided above and shown in, or as may be apparent from, FIGS. 1-38B are hereby incorporated by reference herein in their entireties with respect to this embodiment of the tool 200 and FIGS. 39A-45, except and only to the extent as may be described differently, evident from or otherwise incompatible with the description herein and/or the appended drawings.

Figure 39A:
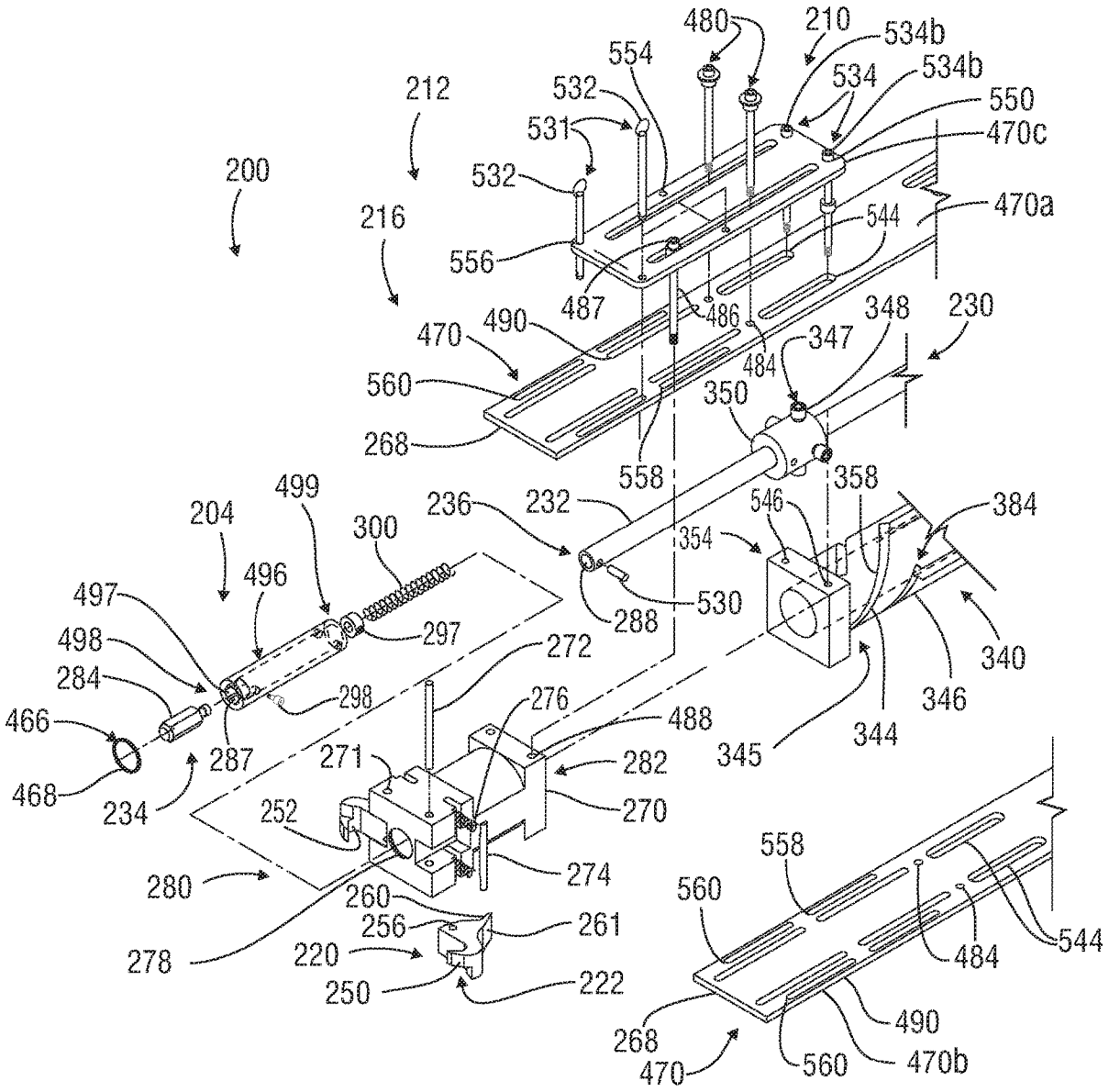
FIGS. 39A-B show a plan view of another embodiment of an attachment pin manipulation power tool in accordance with the present disclosure.
Figure 39B:
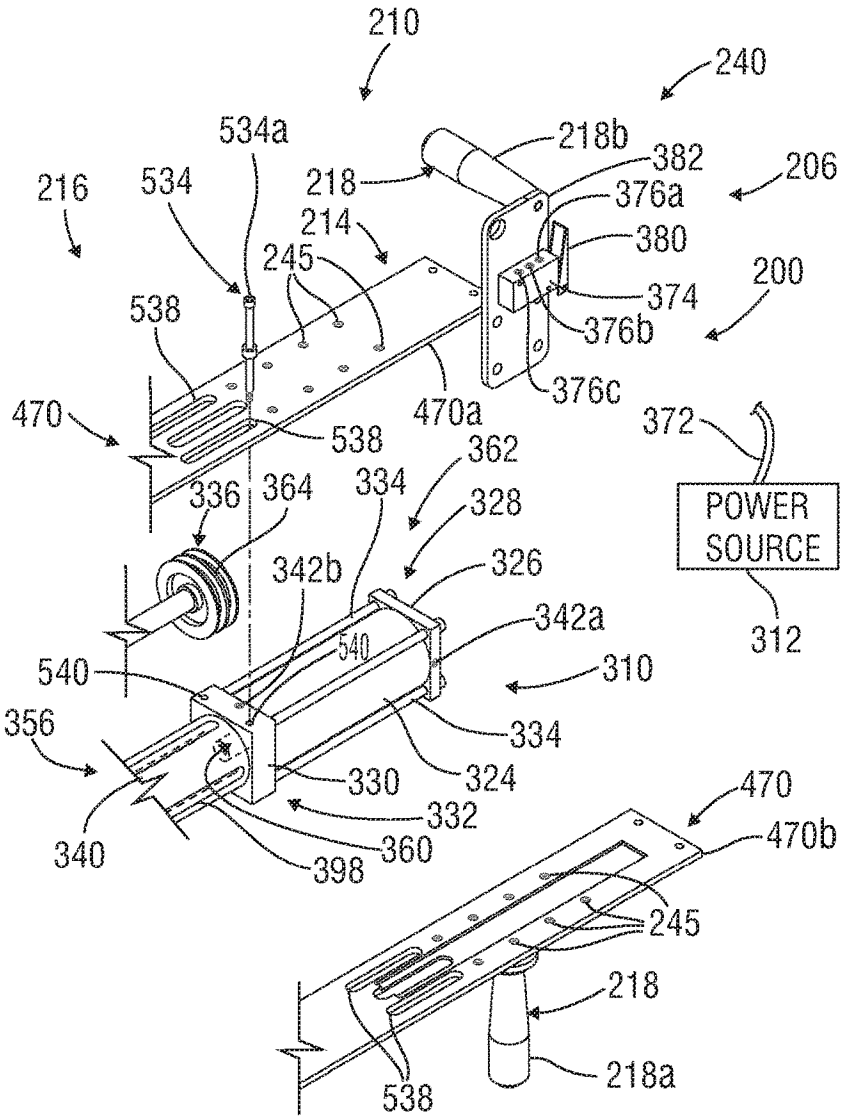
Figure 40:
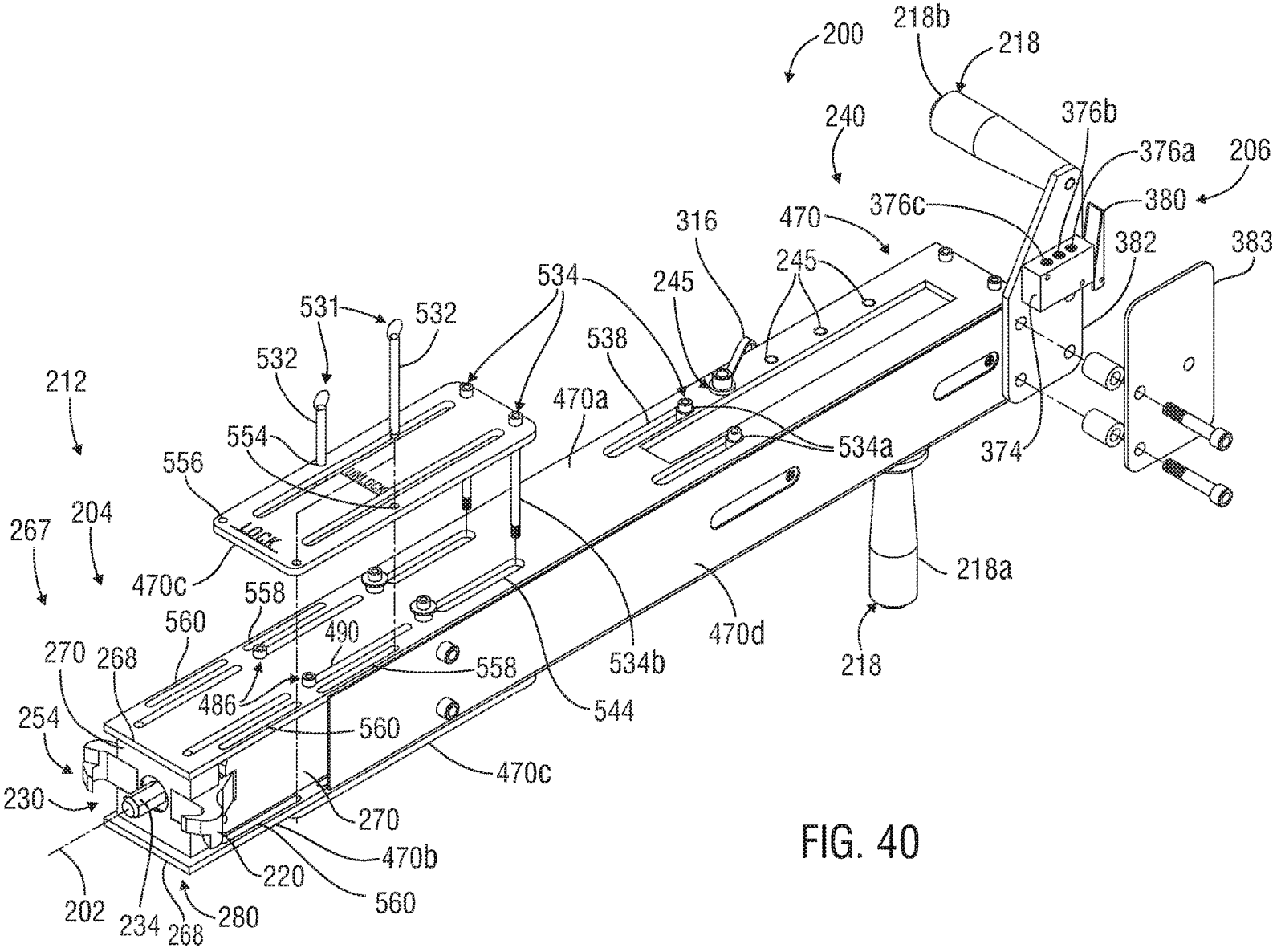
FIG. 40 is a perspective, partial plan view of the exemplary power tool shown in FIGS. 39A-B.

Referring initially to FIGS. 39A-40, the main body 216 of the illustrated carrier 210 has a rectangular shape and includes multiple side plates 470. In this embodiment, at least one elongated upper side plate 470*a* is coupled to at least one elongated lower side plate 470*b* with at least one connector 480. For example, two connectors 480 (e.g. bolts) are shown extending through aligned holes 484 in the plates 470*a*, 470*b* for rigidly, releasably coupling them together. The main body may include one or more cover plates 470*d* (e.g. ⅛" thick plastic) on the sides between the side plates 470*a*, 470*b*.

The front edge(s) 268 of the main body 216 (e.g. on side plates 470*a*, 470*b*) are configured to be positioned over the attachment pin 34 during pin manipulation operations. In some instances, one or more front edges 268 may abut, or rest upon, the upper surface 27 of the uppermost ground cover 26*a* at least partially around the attachment pin 34 to orient the tool 200 at least substantially upright to initiate pin manipulation operations, and/or any other purpose. If desired, the tool 200 may be configured and the side plates 470*a*, 470*b* shaped so that such positioning of the front edges 268 on the ground cover 26*a* will align the gripper(s) 220 and rotator(s) 230 in desired positions over the respective corresponding parts of the pin 34. In some embodiments, the front edges 268 may essentially straddle the opposing long sides 86, 88 of the head 36 of the first portion 64 of the attachment pin 34 (e.g. FIGS. 8A-9B).

Still referring to FIGS. 39A-40, the handle 218 on the exemplary carrier 210 (the fixed position handle 218*a*) rigidly, releasably coupled to one or more of the side plates 470. In this embodiment, the handle 218*a* is coupled to the lower side plate 470*b*. The position of the exemplary handle 218*a* is "fixed" relative to the main body 216 so that the handle 218*a* and main body 216 move together. If desired, one or more of the exemplary side plates 470 may include at least one coupling point 245 for releasably securing the handle 218*a* thereto (e.g. with one or more bolts or other connectors). For example, each side plate 470*a*, 470*b* may include one or more set of four (or more or less) alternate spaced-apart coupling points 245 so that the handle 218*a* may be positioned in any among multiple alternate positions at different heights on the carrier 210 on either side of the carrier 210 (e.g. for the operator's convenience or other purpose(s)). If desired, one or more of the coupling points 245 may be used for one or more additional or different purpose. For example, a lanyard 316 (strap, bridle, etc.) may be releasably coupled (e.g. with one or more bolts or other connectors) to one or more side plates 470*a*, 470*b* to support a tool-carrier sling, webbing or other component (not shown).

Referring specifically to FIG. 39A, in this embodiment, the nose 270 is generally rectangular in shape and is coupled to and axially slideable within the main body 216 of the carrier 210. For example, the nose 270 may be coupled and axially slideable relative to main body 216 with one or more connectors 486. In this embodiment, two releasable connectors 486 (e.g. bolts, pins, etc.) are shown extending through inner longitudinally-extending slots 490 in the plates 470*a*, 470*b* and respective holes 488 in the nose 270. The illustrated connectors 486 are secured over the slots 490 and thus to the plates 470*a*, 470*b*, such as by one or more protrusions 487 (e.g. bolt head, nut, clip, etc.) extending therefrom. The exemplary slots 490 are configured to allow the desired relative axial movement between the nose 270 and main body 216. In this configuration, the illustrated nose 270 is allowed to move axially relative to the main body 216 within a range of motion defined by the length of the slots 490, but is not rotatable relative to the main body 216. For example, the length of the slots 490 and thus distance of linear axial movement of the nose 270 relative to the side plates 470*a*, 470*b* may be coincident with the length of the linear portion 398 of the slots 344 in the helically-slotted body 340.

In this embodiment, the mating portion 234 of the illustrated rotator 230 is releasably coupled to the front end 236 of rotatable rod 232 for concurrent rotational and axial movement therebetween via at least one connector sleeve 496. The connector sleeve 496 may have any suitable form, components, configuration and operation. For example, the sleeve 496 may have a bore 497 configured to engage the mating portion 234 at its front end 498 and the rotatable rod 232 at its rear end 499. The rear end 237 of the exemplary mating portion 234 extends into the bore 497 of the sleeve 496 at its front end 498 and is captured therein.

Still referring to FIG. 39A, to secure the exemplary mating portion 234 to the sleeve 496, the mating portion 234 may include one or more raised portions 296 at or proximate to its rear end 293 and retained in the bore 497 of the sleeve 496. In this embodiment, the raised portion is a lock collar 297 releasably snapped, or locked, onto a reduced diameter portion of the rear end 237 of the mating portion 234. One or more couplers 298 (e.g. set screws) are shown extending laterally into the exemplary connector sleeve 496 (and into the bore 497 therein) to retain the rear end 237 of the mating portion 234 within the bore 497. For example, each coupler 298 may be releasably coupled to a lateral orifice formed in the sleeve 496 forward of the raised portion 296 of the mating portion 234 when the tool 200 is assembled. The exemplary coupler(s) 298 will thus allow the mating portion 234 to move axially within the bore 497 of the sleeve 496 within a limited range of motion while preventing the raised portion 296 from exiting the sleeve 496 at its front end 498.

Removal of the illustrated coupler(s) 298, such as via an access drilling in the nose 270, will allow the mating portion 234 to be easily reset, such as described below, or removed from the tool 200 for replacement, maintenance or any other desired purpose(s). However, the mating portion 234 may be coupled to the connector sleeve 496 in any other manner, and in some embodiment, the mating portion 234 and connector sleeve 496 may be integrally formed.

The exemplary connector sleeve 496 may be coupled to the rotatable rod 232 in any suitable manner. In this embodiment, the sleeve 496 and rotatable rod 232 are releasably rigidly coupled together for concurrent rotation and axial movement therebetween. For example, the front end 236 of the rotatable rod 232 may be configured to extend into the bore 497 of the sleeve 496. One or more lock pins 530 (or other suitable component) may extend laterally into and through the illustrated sleeve 496 and rotatable rod 232 to retain them in locking engagement. The illustrated connector sleeve 496 is easily removable by removing the lock pin(s) 530, such as to allow easy removal of the mating portion 234 of the rotator 230 for replacement, and/or other desired purpose. However, the sleeve 496 and rotatable rod 232 may be coupled together in any other manner and with any other suitable components.

Still referring to FIG. 39A, if desired, the mating portion 234 of the exemplary rotator 230 may be axially moveable relative to the connector sleeve 496 and/or rotatable rod 232. The mating portion 234 may be axially moveable relative to the connector sleeve 496 and/or rotatable rod 232 in any suitable manner. In this embodiment, the mating portion 234 is spring-loaded in the front end 498 of the sleeve 496. At least one spring 300 or other biasing member biases the illustrated mating portion 234 outwardly (downwardly) relative to the front end 498 of the sleeve 496. For example, one end of the spring 300 (e.g. coil spring) may bear upon the rear end 237 of the mating portion 234 (e.g. on the collar 297), while the other end of the spring 300 may bear upon a ledge of a counterbore (or other surface) inside the bore 497 of the sleeve 496, the lock pin 530 or a surface inside the bore 288 of the rotatable rod 232. However, any other arrangement of components or techniques may be used to allow the mating portion 234 to move axially relative to the sleeve 496, rotatable rod 232 or other component(s), or the tool 200 may be configured without this feature.

The mating portion 234 of the exemplary rotator 230 may be configured to rotationally engage the connector sleeve 496, such as to ensure the mating portion 234, sleeve 496 and rotatable rod 232 rotate concurrently when the mating portion 234 engages the attachment pin 34, to assist the rotator 230 in withstanding high torque/rotational forces during rotation of the attachment pin 34, for any other suitable purpose(s) or a combination thereof. The mating portion 234 may be rotationally lockable to the sleeve 496 in any suitable manner. For example, at least part of the mating portion 234 may be shaped and configured to mate with a female splined portion 287 of the interior wall of the bore 497 of the sleeve 496 to prevent relative rotation therebetween. However, any other configuration may be used to rotationally (torsionally) lock the mating portion 234 to the sleeve 496 (and/or rotatable rod 232 or other component). In other embodiments, this feature may not be included.

Still referring to FIG. 39A, if desired, the rotatable rod 232 and/or mating portion 234 may be adjustable to provide alternate positions of the mating portion 234 relative to the rotatable rod 232 and attachment pin 34 (to be manipulated). This sort of arrangement may be useful, for example, when the mateable portion 68 of the second portion 66 of the exemplary attachment pin 34 (e.g. FIG. 11) includes a hex-shaped socket-like recess 78 and is rotated ninety degrees (90°) (or other non-60° divisible increments (e.g. 30°, 150°, etc.)) between locked and unlocked positions, leaving a flat 83 of the recess 78 at the "twelve o-clock" position at the end of locking or unlocking the pin 34. If the mating portion 234 of the rotator 230 is a hex bit 284 having six (6 ea.) corners 289*a* (e.g. FIGS. 22B-C) spaced apart sixty degrees (60°) between six flats 289*b*, the orientation of the mating portion 234 will be off by thirty (30°) degrees when switching the use of the exemplary tool 200 between attachment pin locking and unlocking operations, or vice versa. Thus, between attachment pin manipulation operations, it may be desirable or beneficial to reset the mating portion 234 of the illustrated rotator 230 by thirty degrees (30°) to properly align it with the socket-like recess 78 of the attachment pin 34 for the next operation. Of course, other embodiments may warrant resetting the mating portion 234 by a different amount (e.g. 10°, 15°, 20°, 45°, 60°, 90°, etc.) to provide a different variety if alternate position of the mating portion 234.

Any suitable configuration of components and techniques may be used to provide alternate positions of the mating portion 234 relative to the rotatable rod 232 and attachment pin 34, if this feature is included. For example, the splined portion 287 of the interior wall of the bore 497 of the sleeve 496 may be configured to provide alternate positions of the illustrated mating portion 234 of the rotator 230. In the present embodiment, since the mating portion 234 is a hex bit 284 having six (6 ea.) corners 289*a* spaced apart sixty degrees (60°) between six flats 289*b*, the splined portion 287 in the bore 497 may be formed with a 12-point spline to provide alternate positions (thirty degrees (30°) apart) for the mating portion 234 relative to the rotatable rod 232 and attachment pin 34. To reset the exemplary mating portion 234, the mating portion 234 may be disengaged from the splined portion 287, rotated the desired amount (e.g. thirty degrees) (30°)) and then reengaged with the splined portion 287. Since the illustrated mating portion 234 is spring-biased outwardly (downwardly) in the front end 236 of the bore 288 (such as described above), the exemplary coupler(s) 298 may be removed and the mating portion 234 pushed up into the bore 288 against the spring-biasing forces and rearward of the splined portion 287 to allow it to be freely rotated to adjust its position as desired. For example, the mating portion 234 may be rotated to more precisely align with the socket-like recess 78 of the attachment pin 34 (e.g. aligning the respective flats and corners of the mating portion 234 and the mateable portion 68) before the next operation. However, when this capability is included, the position of the mating portion 234 may be adjusted any desired amount in any other suitable manner.

Still referring to FIG. 39A, the exemplary connector sleeve 496 is free to rotate in the nose 270, while the nose 270 follows the sleeve 496 and rotatable rod 232 in axial motion. In this embodiment, the sleeve 496 is secured within and restrained from coming out of the bore 278 at the front end 280 of the nose 270 by one or more retainers 466, and at the rear end 282 by one or more shoulders formed or extending in the bore 278. For example, the retainer 466 may be a releasable retaining (e.g. snap) ring engageable in a groove formed in the nose 270 around the bore 278. If desired, the exemplary retainer 466 may be removable to allow the mating portion 234 to be removed from the tool 200 and/or for any other desired purposes(s). Thus, the longitudinal position of exemplary sleeve 496 is at least substantially fixed inside the nose 270, coupling the rotator 230 and nose 270 together for concurrent, linear, axial movement. However, any other arrangement of components may be used to secure the sleeve 496 (and/or other components) inside the nose 270 and allow the desired concurrent and relative movement of the parts.

If desired, one or more bleed holes 303 (e.g. FIG. 43) may be formed in the rotatable rod 232 in fluid communication with the bore 288 to supply pressurized air into the rod 232 to blow out or purge the bore 288 of the rod 232 and/or one or more other components (e.g. the collar 350, protrusions 347, connector rod 290, spring 300, mating portion 234, nose 270, connector sleeve 496 (e.g. FIG. 39A) and related parts) of dirt, mud or other debris or material that may pack, or enter, the tool 200 (e.g. proximate to its front end 204), to distribute lubricated air through the bore 288 and/or to other components of the tool 200 to assist in lubricating them, for any other purpose(s) or a combination thereof. When included, the bleed holes 303 may be formed in the rod 232 at any desired location and orientation. In this embodiment, one or more bleed holes 303, extending laterally into the rod 232 at or near the upper end of the rod 232, are configured to allow pressurized air into the bore 288 of the rod 232 from the front portion 360 of the cylinder tube 324 at full retraction of the piston 336 (e.g. FIG. 43). The pressurized air may be ejected around the exemplary protrusions 347 (e.g. track rollers 348) and/or the mating portion 234 to purge or blow debris collecting or attempting to collect around them. If lubricant is present (e.g. included in the pressurized air or in the bore 288 of the rod 232), the lubricant may be distributed to some or all of the components associated with to the rotatable rod 232.

Referring now to FIGS. 39A-B, the exemplary floating cylinder assembly 310 may be coupled and, axially slideably moveable, relative to the main body 216 (e.g. between the upper and lower side plates 470*a*, 470*b*) of the carrier 210 in any suitable manner. For example, one or more releasable connectors 534 (e.g. bolts, pins, etc.) may be used to slideably couple the cylinder assembly 310 and main body 216. In this embodiments, two connectors 534*a* extend through (outer, rear) longitudinally-extending slots 538 in the side plates 470*a*, 470*b* and respective holes 540 in the cylinder assembly 310 (e.g. rod end cap 330) and/or two connectors 534*b* extend through (outer, median) longitudinally-extending slots 544 in the side plates 470*a*, 470*b* and respective holes 546 in the cylinder assembly 310 (e.g. helically-slotted body 340). The illustrated connectors 534 are secured over the slots 538, 544 and thus to the plates 470*a*, 470*b*, such as by one or more protrusions 536 (e.g. bolt head, nut, clip, etc.) extending therefrom or coupled thereto.

The exemplary slots 538, 544 are designed to allow the desired axial movement of the helically-slotted body 340 relative to the main body 216. For example, the illustrated connector/slot arrangement generally allows linear axial movement of the cylinder assembly 310 through a distance generally coincident with the length of the helical portion 358 of the slots 344 in the helically-slotted body 340. While the illustrated helically-slotted body 340 is moveable axially relative to the carrier 210 and within a range defined by the length of the slots 538, 544, the helically-slotted body 340 is typically not rotatable relative to the carrier 210, which may assist in substantially inhibiting or preventing rotation of the entire cylinder assembly 310 during attachment pin manipulation operations. Thus, during rotation of the rotator 230 (in locking and unlocking operations) the axial, linear movement of the exemplary helically-slotted body 340 is guided and limited by the connectors 534*a* moving in the slots 538 of the plates 470*a*, 470*b* and/or the connectors 534*b* moving in the slots 544 of the plates 470*a*, 470*b*. However, any other configuration of components and techniques may be used to slideably couple the exemplary cylinder assembly 310 to the carrier 210 and/or assist in preventing rotation of the cylinder assembly 310 during attachment pin 34 manipulation operations.

Referring back to FIGS. 39A-40, when it is desired to disengage the grippers 220 from an attachment pin 34 after locking or unlocking the pin 34 with this embodiment of the tool 200, any suitable arrangement of components and techniques may be used. In this embodiment, at least one sliding coupler, or side plate, 470*c* is useful to allow the grippers 220 to disengage the pin 34 after locking or unlocking operations. The sliding side plate(s) 470*c* may have any suitable form, configuration and operation. In this embodiment, opposing sliding side plates 470*c* are rigidly coupled to the cylinder assembly 310 and axially slideably coupled to the side plates 470*a*, 470*b*. For example, the connectors 534*b* that slideably couple the cylinder assembly 310 to the plates 470*a*, 470*b* may be rigidly coupled to the sliding side plates 470*c* outside the respective side plates 470*a*, 470*b*, such as through holes 550. Thus, the illustrated sliding side plates 470*c* move along with the cylinder assembly 310 relative to the side plates 470*a*, 470*b*.

To disengage the illustrated grippers 220 from the attachment pin 34 after locking or unlocking operations, one or more selectively positionable protrusions 531 extend from one or more sliding side plates 470*c* at least partially into the main body 216 of the carrier 210 (between the side plates 470*a*, 470*b*) at desired locations. The exemplary protrusions 531 are releasably, rigidly secured to the sliding side plate 470*c* and axially slideable relative to the side plates 470*a*, 470*b*. The illustrated sliding side plate 470*c* (moving with the cylinder assembly 310) will position the protrusions 531 proximate to the gripper(s) 220 at the desired time during locking or unlocking operations to bias them open. For example, the protrusion(s) 531 may be selectively oriented (e.g. manually, robotically, via automated mechanism, etc.) in a first (upper) position for use during the unlocking sequence and in a second (lower) positioned for use during the locking sequence. The concurrent movement of the sliding side plate 470*c* with the exemplary floating cylinder assembly 310 allows the protrusions 531 to move into position to disengage the grippers 220 and either curtail (for locking operations), or allow (for unlocking operations), upward movement of the nose 270.

Still referring to FIGS. 39A-40, the protrusions 531 may have any suitable form, configuration and operation. In this embodiment, the protrusions 531 are detent pins 532. The detent pins 532 thus move with the sliding side plate 470*c* and cylinder assembly 310 relative to the side plates 470*a*, 470*b*. For example, in the first position, two detent pins 532 may be selectively positioned (e.g. manually, robotically, etc.) to extend through respective upper holes 554 in the sliding side plate 470*c* and respective median, outer slots 558 in the side plates 470*a*, 470*b* for pin unlocking operations, and through respective lower holes 556 in the sliding side plate 470*c* and respective front, outer slots 560 in the side plates 470*a*, 470*b* in the second position for pin locking operations. The exemplary detent pins 532 are typically inserted or otherwise placed into the desired first or second positions before initiation of the subject pin manipulation operation (locking or unlocking).

In this embodiment, after rotating (and, if included, counter-rotating) the exemplary rotatable rod 232 during normal pin unlocking operating conditions, as the trigger 380 continues to be depressed and the front portion 360 of the cylinder tube 324 continues to be pressurized, the connectors 534*a*, 534*b* (rigidly coupled to and moving axially with the helically-slotted body 340 and sliding side plate 470*c*) will bottom-out at the front end of the corresponding respective slot(s) 538, 544 in the plates 470*a*, 470*b*, stopping downward movement of the body 340 and forcing the rotatable rod 232 to then move up. The track roller(s) 348 of the exemplary rotatable rod 232 will travel along the linear portions 398 of the respective associated slot(s) 344 in the helically-slotted body 340, drawing the nose 270 and grippers 220 (with pin 34) up and away from the support surface 16 a desired distance (e.g. 4.0") to extract the pin 34 from the support surface 16.

Still referring to FIGS. 39A-40, after unlocking the pin 34 and extracting it from the support surface 16 with the illustrated tool 200 (such as described above), as the trigger 380 continues to be depressed, the track rollers 348 of the rotatable rod 232 will continue to move up in the linear portions 398 of the tracks 344 of the body 340. The exemplary nose 270 and grippers 220 will continue to be drawn up thereby until the outer face 261 of the rear end 258 of each exemplary gripper 220 engages (e.g. wedges under) one of the respective protrusions 531 (e.g. detent pins 532) to lever the grippers 220 open (into a disengaged position). The illustrated protrusions 531 in the first (upper) position thus bias the grippers 220 open after unlocking and extracting the attachment pin 34.

To open one or more grippers 220 and disengage the tool 200 from the attachment pin 34 after the pin 34 has been moved into locking engagement with the support surface 16, the exemplary protrusions 531 are placed in the second (lower) position. In this position, the illustrated protrusions 531 are positioned to essentially make-up for the linear travel the grippers 220 would otherwise undergo (as described above) for extraction of the pin 34 from the support surface 16, which travel is not applicable or desired after locking operations. Thus, in this embodiment, after locking the pin 34, as the trigger 380 continues to be depressed and the track rollers 348 of the rotatable rod 232 enter the linear portions 398 of the tracks 344 of the body 340, the exemplary nose 270 and grippers 220 will be drawn up and the outer face 261 of the rear end 258 of each exemplary gripper 220 will promptly engage (e.g. wedge under) one of the respective protrusions 531 (e.g. detent pins 532) to lever the grippers 220 open (into a disengaged position). The illustrated protrusions 531 in the second (lower) positions thus bias the grippers 220 open after locking the attachment pin 34. In the second position, the exemplary protrusions 531 may also be configured to inhibit upward motion of the nose 270 so that the attachment pin 34 release completes the locking cycle.

Figure 41:
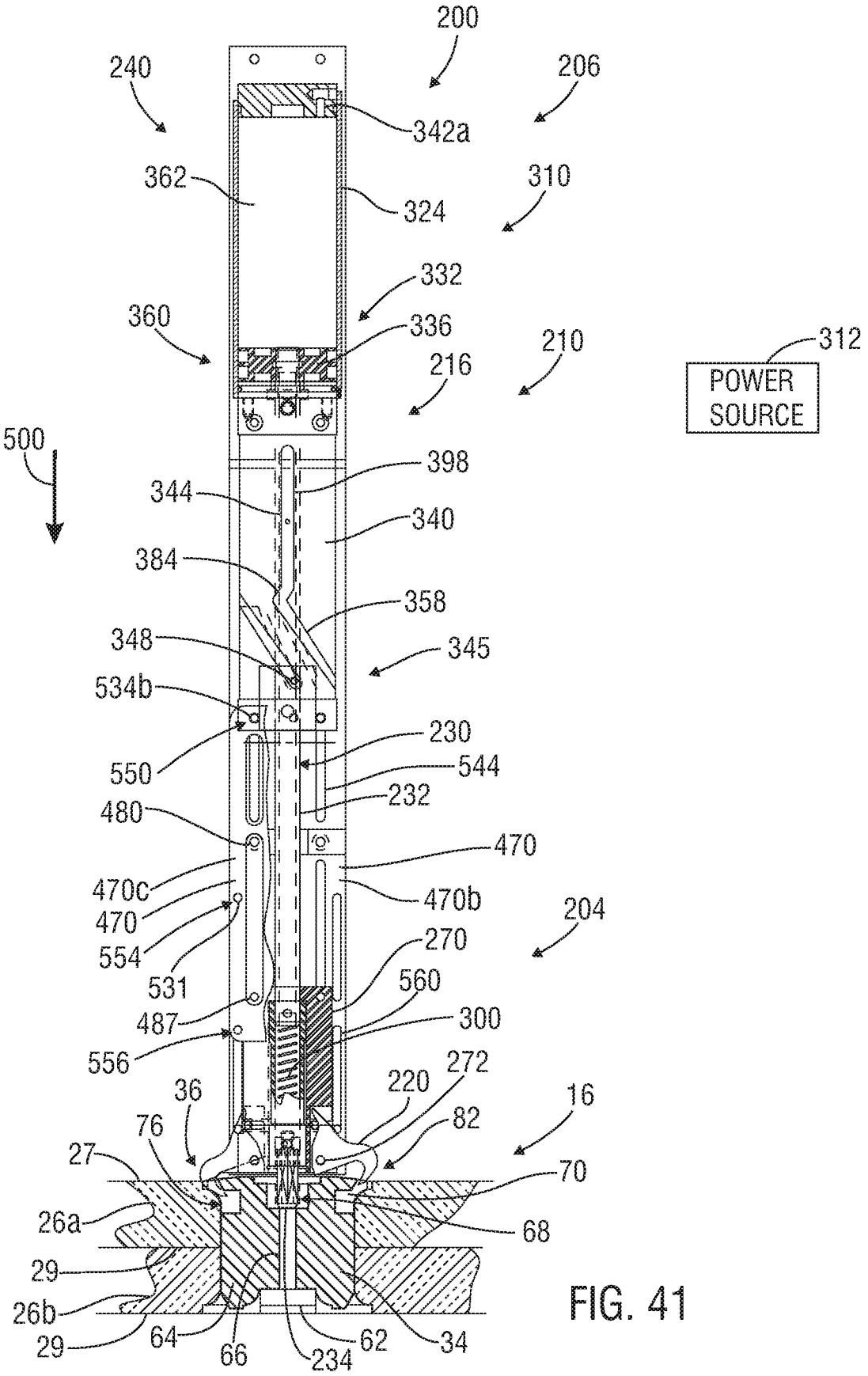
FIG. 41 is a front, partial cross-sectional view of the exemplary power tool of FIGS. 39A-40 showing the exemplary grippers and rotator engaging the illustrated attachment pin prior to unlocking an exemplary attachment pin from an exemplary support surface in accordance with one or more embodiments of the present disclosure.

Now referring to FIGS. 41-43, an exemplary method of unlocking, extracting and disengaging an exemplary attachment pin 34 from a support surface 16 with this embodiment of the tool 200 will be described. (In these drawings, the upper plate 470*a* has been removed.) Referring initially to FIG. 41, the exemplary protrusions 531 (e.g. detent pins 532) have been positioned in their first position (extended through the upper holes 554 in the sliding side plate 470*c* and respective median, outer slots 558 in the side plates 470*a*, 470*b*, FIG. 39A). The power-driven actuator 240 of the illustrated tool 200 is connected to a power source 312, such as described above, supplying pressurized fluid into the rear portion 362 of the cylinder tube 324 and allowing fluid to escape from the front portion 360. This represents the first position of the exemplary control valve and the start position of the illustrated tool 200. In this position, the piston 336 of the rotatable rod 232 is near the front end 332 of the cylinder tube 324 and the track roller(s) 348 of the rotatable rod 232 are at or proximate to the front end 345 of the respective associated slot(s) 344 of the helically-slotted body 340.

The exemplary grippers 220 start in a disengaged, or extended, position and as the tool 200 is being lowered (arrow 500), will typically contact the head 36 (or upper end) of the attachment pin 34, pushing the front end of the gripper(s) 220 further outwardly. Since the illustrated grippers 220 are spring-loaded inwardly, they will typically stay engaged or pressed against the pin head 34 (e.g. at the flange 82). At or near the end of the downward movement of the exemplary tool 200, the illustrated grippers 220 will move back inwardly and snap or settled into gripping engagement with the attachment pin 34 (e.g. around the flange 82 of the head 36 thereof). The mating portion 234 of the exemplary rotator 230 should align over the mateable portion 68 of the attachment pin 34. If the mating portion 234 of the exemplary rotator 230 is not perfectly indexed with the mateable portion 68 of the attachment pin 34 and, since it is spring-biased downwardly, it may be pushed up into the rotatable rod 232 (e.g. rather than jamming the tool 200 or preventing the tool 200 from descending into the proper position), allowing the tool 200 to continue descending over the attachment pin 34.

Figure 42:
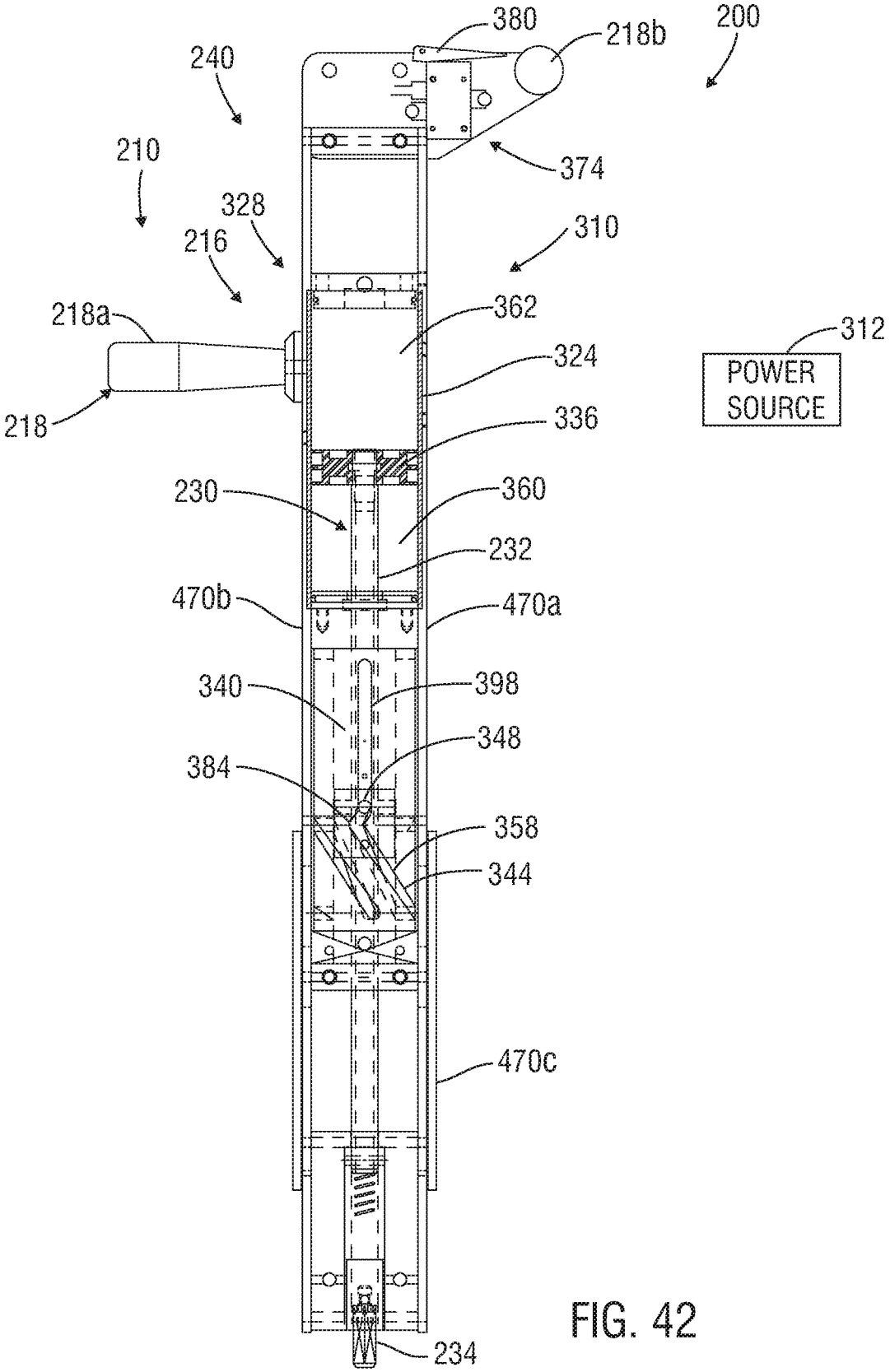
FIG. 42 is a side, partial cross-sectional view of the exemplary power tool of FIG. 41 showing the tool in position after rotating the exemplary rotator to unlock the attachment pin and counter-rotating the attachment pin in accordance with one or more embodiments of the present disclosure.

In FIG. 42, the exemplary trigger 380 has been depressed, moving the control valve 374 to its second position, which supplies pressurized fluid into the rod side, or front portion, 360 of the cylinder tube 324 and opens the rear portion 362 to atmosphere. The pressure in the exemplary front portion 360 typically pushes the helically-slotted body 340 linearly down toward the support surface, forcing the track roller(s) 348 of the rotatable rod 232 to travel through the helical portion 358 of their respective associated slot(s) 344 in the helically-slotted body 340, rotating the rotatable rod 232 (e.g. 90°) in a clockwise direction. Since the exemplary helically-slotted body 340 is restrained from rotation by the pins 534*a*, 534*b* (e.g. FIGS. 39A-B) riding in the corresponding slots 538, 544 of the side plates 470*a*, 470*b*, the rotation of the mating portion 234 of the rotator 230 and the attachment pin 34 pin is typically assured.

If the exemplary mating portion 234 of the rotator 230 had been pushed up into the rotatable rod 232, it should instantaneously or nearly instantaneously rotate into proper index with the mateable portion 68 (not shown) of the second portion 66 of the attachment pin 34 and then axially slide into engagement with the mateable portion 68 and rotate the second portion 66 of the pin 34 into an unlocked position. After rotating the exemplary rotator 320 and attachment pin 34 (and, if included, counter-rotating the rotator 320), the pins 534*a*, 534*b* (e.g. FIGS. 39A-B) will typically have reached the end of the slots 538, 544 in the side plates 470*a*, 470*b* and, consequently, the cylinder assembly 310 can travel down no further.

Still referring to FIG. 42, once the attachment pin 34 has been unlocked from the support surface 16, continued pressurization of the exemplary front portion 360 of the cylinder tube 324 and linear downward movement of the helically-slotted body 340 will force each track roller 348 of the rotatable rod 232 to travel through a short reverse-direction portion 384 of the associated slot 344 in the helically-slotted body 340 rearwards of the helical portion 358. Thus, at the end of rotation of the exemplary rotator 230 in one direction (e.g. 90° clockwise), the rotator 230 reverses direction (e.g. counterclockwise, arrow 516).

Figure 43:
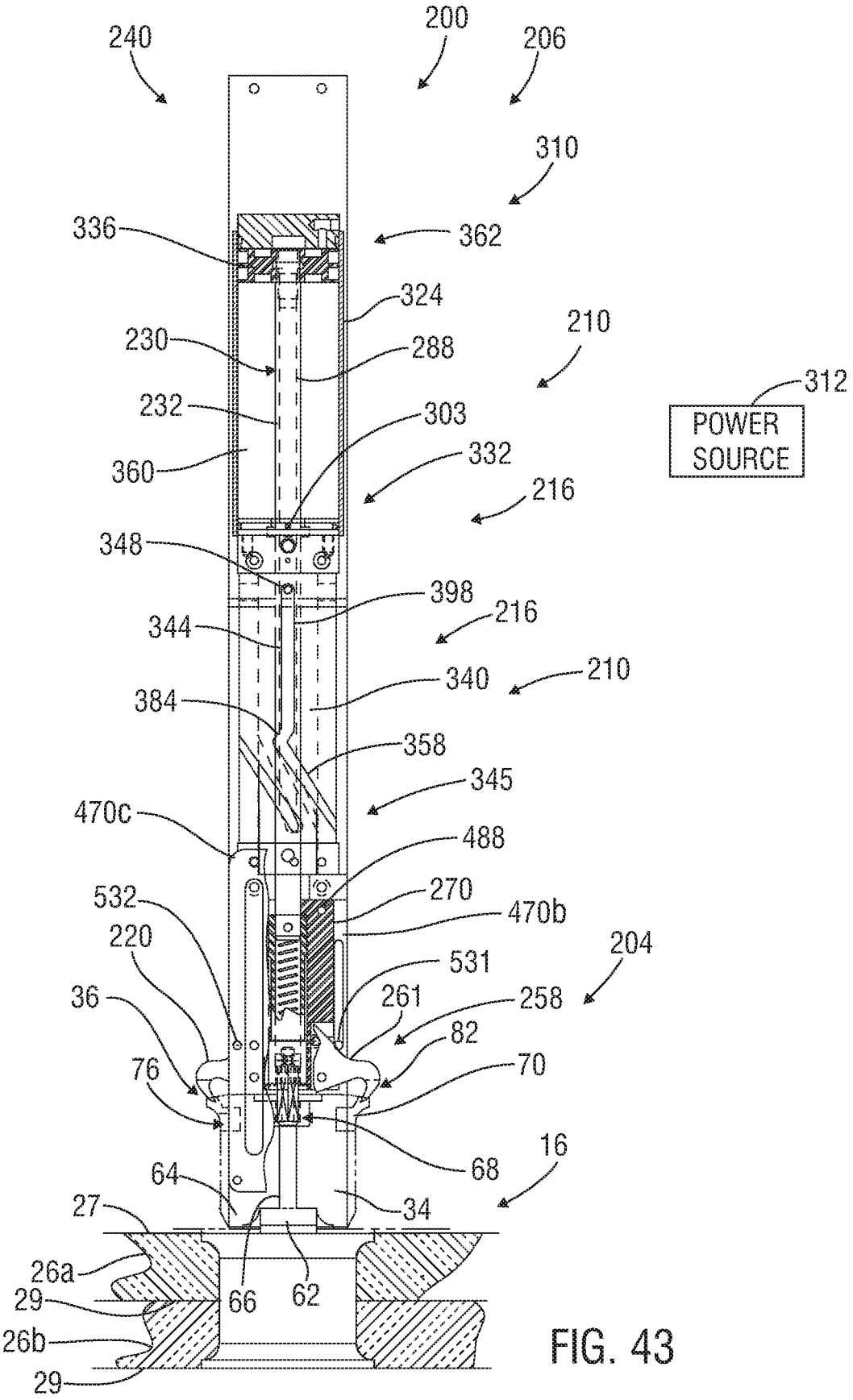
FIG. 43 is a front, partial cross-sectional view of the exemplary power tool of FIG. 41 showing the tool extracting and disengaging from the illustrated unlocked attachment pin in accordance with one or more embodiments of the present disclosure.

Referring now to FIG. 43, if desired, the exemplary tool 200 may be capable of drawing the attachment pin 34 away from the support surface 16 and/or disengaging from the pin 34. In this embodiment, the exemplary rotator 230 is coupled to one or more grippers 220 to allow for their concurrent rearward movement relative to the carrier 210. After rotating (and, if included, counter-rotating) the exemplary rotatable rod 232, as the trigger continues to be depressed and the front portion 360 of the cylinder tube 324 continues to be pressurized, the track roller(s) 348 of the rotatable rod 232 will be forced to travel through the linear portions 398 of the respective associated slot(s) 344 in the helically-slotted body 340, drawing the grippers 220 and attachment pin 34 up away from the support surface 16 the desired distance. As indicated above, the illustrated nose 270 will be able to move up the desired distance through the main body 216 until the outer face 261 of the rear end 258 of each exemplary gripper 220 engages (e.g. wedges under) one of the respective protrusions 531 (e.g. detent pins 532) to lever the grippers 220 open and drop the pin 26.

Thereafter, if desired, the operator may release the exemplary trigger 380 (e.g. FIGS. 39A-B) to switch the control valve 374 back to its default/start position, returning the piston 336 of the rotatable rod 232 to near the front end 332 of the cylinder tube 324 and the track roller(s) 348 of the rotatable rod 232 at or proximate to the front end 345 of their respective associated slot(s) 344 of the helically-slotted body 340.

Figure 44:
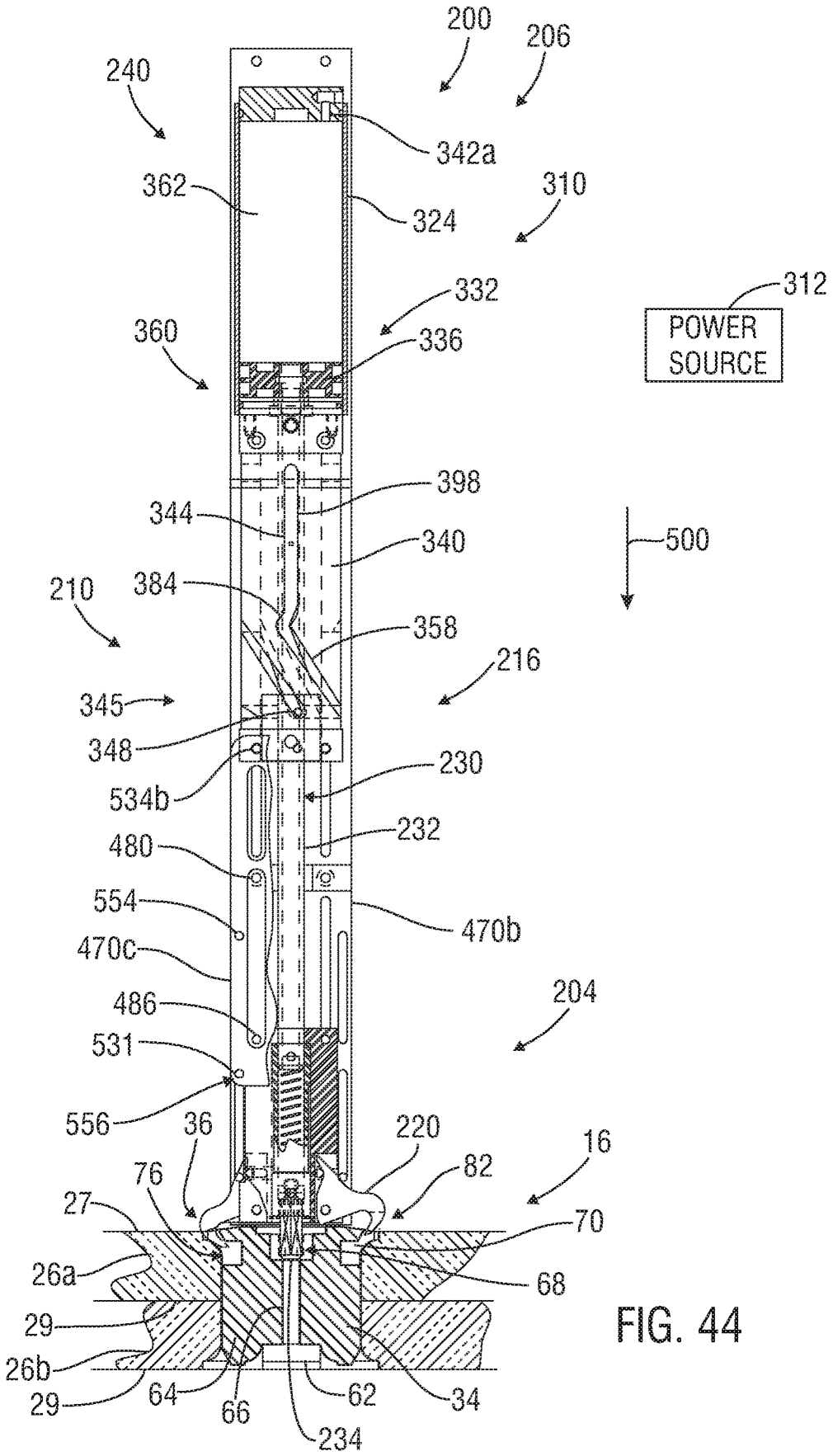
FIG. 44 is a front, partial cross-sectional view of the exemplary power tool of FIGS. 39A-40 showing the exemplary grippers and rotator engaging the illustrated attachment pin prior to locking an exemplary attachment pin to an exemplary support surface in accordance with one or more embodiments of the present disclosure.

Now referring to FIGS. 44-45, an exemplary method of locking and disengaging an exemplary attachment pin 34 from a support surface 16 with this embodiment of the tool 200 will be described. (In these drawings, the upper plate 470*a* has been removed.) Referring initially to FIG. 44, the exemplary protrusions 531 (e.g. detent pins 532) have been positioned in their second position (extended through the lower holes 556 in the sliding side plate 470*c* and respective front, outer slots 560 in the side plates 470*a*, 470*b*, FIG. 39A). If desired, the exemplary tool 200 may be used to first pick up the attachment pin 34 and/or insert it into the desired attachment pin holes 32 before locking the attachment pin 34.

The exemplary power-driven actuator 240 of the tool 200 is connected to a power source 312, such as described above, supplying pressurized fluid into the rear portion 362 of the cylinder tube 324 and allowing fluid to escape from the front portion 360. This represents the first position of the exemplary control valve and the start position of the illustrated tool 200. In this position, the piston 336 of the rotatable rod 232 is near the front end 332 of the cylinder tube 324 and the track roller(s) 348 of the rotatable rod 232 are at or proximate to the front end 345 of the respective associated slot(s) 344 of the helically-slotted body 340.

The exemplary grippers 220 start in a disengaged, or extended, position and as the tool 200 is being lowered (arrow 500), will typically contact the head 36 (or upper end) of the attachment pin 34, pushing the front end of the gripper(s) 220 further outwardly. Since the illustrated grippers 220 are spring-loaded inwardly, they will typically stay engaged or pressed against the pin head 34 (e.g. at the flange 82). At or near the end of the downward movement of the exemplary tool 200, the illustrated grippers 220 will move back inwardly and snap or settled into gripping engagement with the attachment pin 34 (e.g. around the flange 82 of the head 36 thereof). The mating portion 234 of the exemplary rotator 230 should align over the mateable portion 68 of the attachment pin 34. If the mating portion 234 of the exemplary rotator 230 is not perfectly indexed with the mateable portion 68 of the attachment pin 34 and, since it is spring-biased downwardly, it may be pushed up into the rotatable rod 232 (e.g. rather than jamming the tool 200 or preventing the tool 200 from descending into the proper position), allowing the tool 200 to continue descending over the attachment pin 34.

Figure 45:
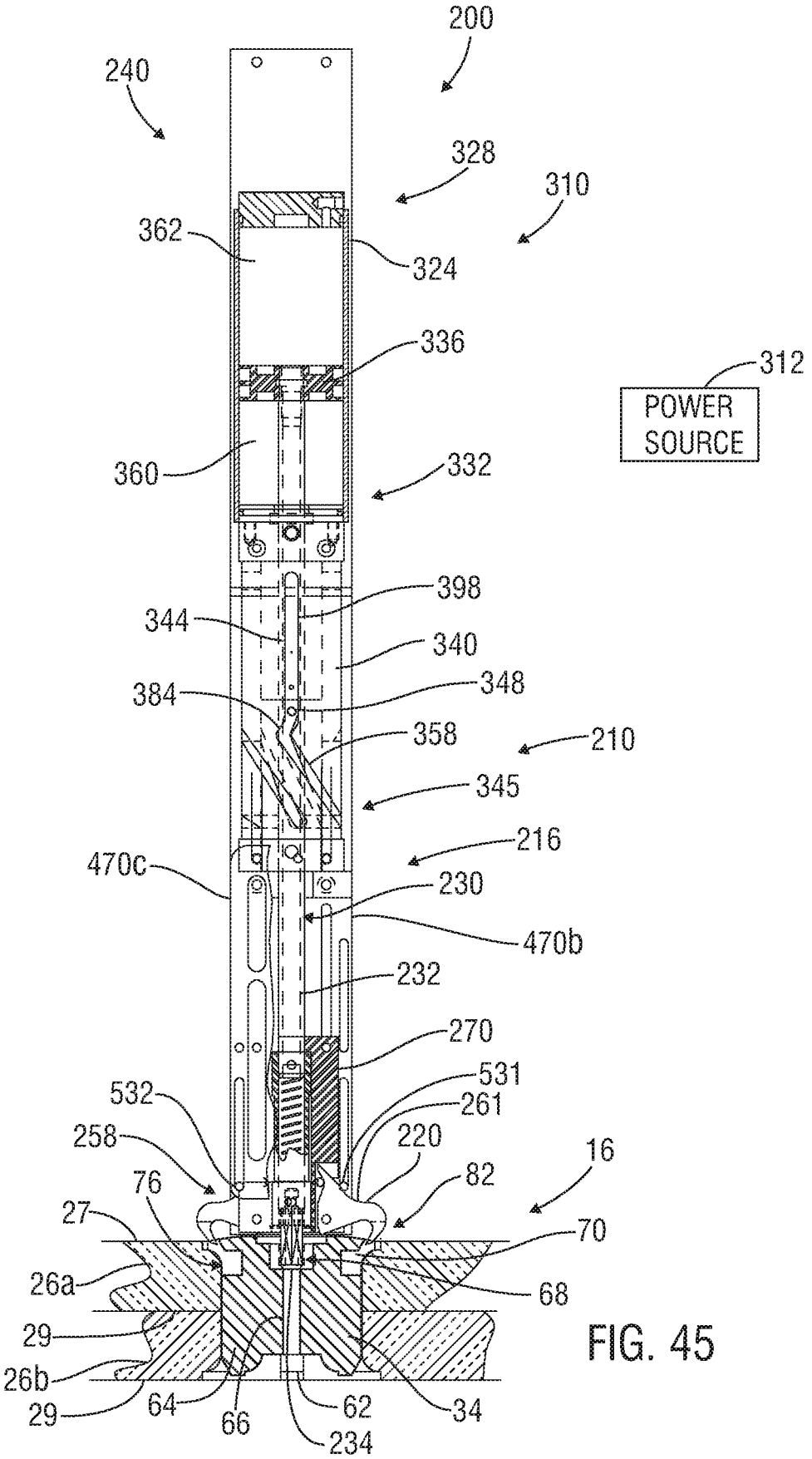
FIG. 45 is a front, partial cross-sectional view of the exemplary power tool of FIG. 41 showing the tool in position after rotating the exemplary rotator to lock the attachment pin to the support surface, counter-rotating and disengaging from the attachment pin in accordance with one or more embodiments of the present disclosure.

In FIG. 45, the exemplary trigger 380 has been depressed, moving the control valve 374 (e.g. FIG. 39B) to its second position, which supplies pressurized fluid into the rod side, or front portion, 360 of the cylinder tube 324 and opens the rear portion 362 to atmosphere. The pressure in the exemplary front portion 360 typically pushes the helically-slotted body 340 linearly down toward the support surface, forcing the track roller(s) 348 of the rotatable rod 232 to travel through the helical portion 358 of their respective associated slot(s) 344 in the helically-slotted body 340, rotating the rotatable rod 232 (e.g. 90°) in a clockwise direction. Since the exemplary helically-slotted body 340 is restrained from rotation by the pins 534*a*, 534*b* (e.g. FIGS. 39A-B) riding in the corresponding slots 538, 544 of the side plates 470*a*, 470*b*, the rotation of the mating portion 234 of the rotator 230 and the attachment pin 34 pin is typically assured.

If the exemplary mating portion 234 of the rotator 230 had been pushed up into the rotatable rod 232, it should instantaneously or nearly instantaneously rotate into proper index with the mateable portion 68 of the second portion 66 of the attachment pin 34 and then axially slide into engagement with the mateable portion 68 and rotate the second portion 66 of the pin 34 into a locked position. After rotating the exemplary rotator 320 and attachment pin 34 (and, if included, counter-rotating the rotator 320), the pins 534*a*, 534*b* (e.g. FIGS. 39A-B) will typically have reached the end of the slots 538, 544 in the side plates 470*a*, 470*b* and, consequently, the cylinder assembly 310 can travel down no further.

Still referring to FIG. 45, once the attachment pin 34 has been locked to the support surface 16, continued pressurization of the exemplary front portion 360 of the cylinder tube 324 and linear downward movement of the helically-slotted body 340 will force each track roller 348 of the rotatable rod 232 to travel through a short reverse-direction portion 384 of the associated slot 344 in the helically-slotted body 340 rearwards of the helical portion 358. Thus, at the end of rotation of the exemplary rotator 230 in one direction (e.g. 90° clockwise), the rotator 230 reverses direction (e.g. counterclockwise, arrow 516).

If desired, the exemplary tool 200 may be capable of disengaging one or more grippers 220 from the pin 34. In this embodiment, the exemplary rotator 230 is coupled to one or more grippers 220 to allow for their concurrent rearward movement relative to the carrier 210. After rotating (and, if included, counter-rotating) the exemplary rotatable rod 232, as the trigger continues to be depressed and the front portion 360 of the cylinder tube 324 continues to be pressurized, the track roller(s) 348 of the rotatable rod 232 will enter the linear portions 398 of the respective associated slot(s) 344 in the helically-slotted body 340. As (or before) the exemplary nose 270 and grippers 220 are drawn up, the outer face 261 of the rear end 258 of each exemplary gripper 220 will promptly engage (e.g. wedge under) one of the respective protrusions 531 (e.g. detent pins 532) to lever the grippers 220 open (into a disengaged position). The illustrated protrusions 531 will also inhibit upward motion of the nose 270 so that the release of the attachment pin 34 will complete the locking sequence.

Thereafter, if desired, the operator may release the exemplary trigger 380 (e.g. FIG. 39B) to switch the control valve 374 back to its default/start position, returning the piston 336 of the rotatable rod 232 to near the front end 332 of the cylinder tube 324 and the track roller(s) 348 of the rotatable rod 232 at or proximate to the front end 345 of their respective associated slot(s) 344 of the helically-slotted body 340.

The exemplary attachment pin manipulation power tools 200 and methods for manipulating an attachment pin 34 as described above and shown in the corresponding figures, or as may be apparent therefrom, provide one or more advantages over the prior art. Many embodiments of the tool 200 are easy to maintain and require less maintenance than prior art systems. For example, various components of the tool 200 may be at least partially, largely, or entirely self-lubricated. Various parts of the exemplary tool 200 may be constructed at least partially of lubricating material (e.g. the exemplary cover 388 and/or key-retention sleeve 450) and/or contain and retain lubricant (e.g. the exemplary track rollers 348 and stud rollers 315, 352 may be "sealed" rollers containing and retaining lubricant therein), thus reducing the need and time for maintenance (e.g. lubrication) of the tool 200. In various embodiments, major components of the tool 200 may be completely, or nearly completely, enclosed, enabling and enhancing the retention of lubricants therein, preventing debris from entering the tool 200, shielding various moving parts and pinch points from mistaken, or inadvertent, entry of (and consequential potential damage to) external objects, for any other purpose(s) or a combination thereof.

In the above and other embodiments of the tool 200, the attachment pin 34 manipulation actions of the tool 200 (e.g. locking, unlocking, extracting, disengaging) may be fully or near-fully automated and require minimal operator involvement (e.g. positioning of keys 430 or protrusions 531, positioning, holding and lifting the tool 200, actuating the trigger 380) during typical or normal operating conditions. Various embodiments of the tool 200 have weight-saving features. For example, in the embodiment of FIG. 12A-16B, the moving handle 218*b* is coupled directly to the blind end cap 326 (e.g. FIGS. 16A-B), eliminating the need for long side plates or like member(s). In many embodiments, the floating cylinder assembly 310 and other features of the tool 200 provide for both locking and unlocking attachment pins 34 sequentially and without the need for additional sequence valves, interlocks or distinct systems.

Some embodiments of the exemplary tool 200 and attachment pin manipulation techniques of the present disclosure provide increased capacity to lock, unlock or otherwise manipulate attachment pins 34 in situations that require significant torque (e.g. frozen attachment pins 34 due to temperature, dirt, mud, jammed, deformed or damaged attachment pins 34, uneven underlying surfaces, warping, imperfect, uneven or differing geometries of connected ground covers 26 and/or other components, misaligned attachment pin holes), as compared to prior art systems and techniques. For example, various components (e.g. the exemplary main body 216) may be configured with a stiff and/or cylindrical shape to withstand significant rotational torsional forces. For another example, various components (e.g. the exemplary main body 216, nose 270, protrusions 314 on the nose 270) may be constructed of steel strong enough to withstand significant rotational torsional forces places thereupon. For yet another example, direct connection of the exemplary mating portion 234 of the rotator 230 to the rotatable rod 332 may withstand greater torque than other known systems.

Preferred embodiments of the present disclosure thus offer advantages over the prior art and are well adapted to carry out one or more of the objects of this disclosure. However, the present invention does not require each of the components and acts described above and is in no way limited to the above-described embodiments or methods of operation. Any one or more of the above components, features and processes may be employed in any suitable configuration without inclusion of other such components, features and processes. Moreover, the present invention includes additional features, capabilities, functions, methods, uses and applications that have not been specifically addressed herein but are, or will become, apparent from the description herein, the appended drawings and/or claims.

The methods described above or claimed herein and any other methods which may fall within the scope of the appended claims can be performed in any desired or suitable order and are not necessarily limited to any sequence described herein or as may be listed in the appended claims. Further, the methods of the present disclosure do not necessarily require use of the particular embodiments shown and described herein, but are equally applicable with any other suitable structure, form and configuration of components.

While exemplary embodiments have been shown and described, many variations, modifications and/or changes of the system, apparatus and methods of the present disclosure, such as in the components, details of construction and operation, arrangement of parts and/or methods of use, are possible, contemplated by the patent applicant(s) hereof, within the scope of any appended claims, and may be made and used by one of ordinary skill in the art without departing from the spirit, teachings and scope of this disclosure and any appended claims. Thus, all matter herein set forth or shown in the accompanying drawings should be interpreted as illustrative, and the scope of the disclosure and any appended claims should not be limited to the embodiments described and shown herein.

The invention claimed is:

1. A power tool comprising:

a carrier having an upper end and a lower end and being selectively positionable over an attachment pin that secures a first ground cover and a second ground cover;

at least one gripper carried by the carrier and positioned proximate to the lower end of the carrier, the at least one gripper being selectively moveable relative to the carrier between at least one engaged position and at least one disengaged position, the at least one gripper selectively gripping the attachment pin in the engaged position and the at least one gripper not gripping the attachment pin in the disengaged position;

at least one rotator operatively connected to the carrier and positioned proximate to the lower end, the at least one rotator being, engageable with the attachment pin the at least one rotator being configured to rotate the attachment pin from at least one unlocked position to at least one locked position to releasably couple the first and second ground covers together and from at least one locked position to at least one unlocked position to unlock the attachment pin from the first and second ground covers; and at least one power-driven actuator associated with the carrier and operatively coupled to the at least one rotator and the at least one gripper to selectively rotate the at least one rotator and cause the at least one gripper to move between the engaged and disengaged positions.

2. The power tool of claim 1 wherein the at least one rotator is rotatable in the same direction to lock and unlock the attachment pin from the first and second ground covers.

3. The power tool of claim 1 wherein the at least one gripper in at least one engaged position anchors the carrier to the attachment pin and assists in preventing at least substantial rotation of the carrier and a first portion of the attachment pin during rotation of a second portion of the attachment pin by the at least one rotator.

4. The power tool of claim 1 wherein the at least one gripper is pivotably moveable inwardly relative to the carrier into the engaged position and pivotably moveable outwardly relative to the carrier into the disengaged position.

5. The power tool of claim 4 wherein the at least one gripper is spring-biased into the engaged position.

6. The power tool of claim 1 wherein the at least one gripper includes first and second spaced-apart claws that grip opposite sides of the attachment pin.

7. The power tool of claim 1 wherein the attachment pin includes a first portion and a second portion, the second portion of the attachment pin being selectively rotatable relative to the first portion and includes at least one mateable portion accessible from above, further wherein the at least one rotator includes at least one mating portion that mates with the at least one mateable portion of the attachment pin to facilitate rotation of the second portion of the attachment pin upon rotation of the at least one rotator.

8. A power tool useful for unlocking a releasable attachment pin from at least first and second ground covers, the power tool comprising:

a carrier having an upper end and a lower end and being selectively positionable over the attachment pin and first and second ground covers;

at least one gripper carried by the carrier and positioned proximate to the lower end of the carrier, the at least one gripper being selectively moveable relative to the carrier between at least one engaged position and at least one disengaged position, the at least one gripper in at least one engaged position gripping the attachment pin and the at least one gripper in the disengaged position not gripping the attachment pin, wherein the at least one gripper is selectively moveable axially toward the upper end of the carrier to extract the attachment pin from the first and second ground covers when the at least one gripper is in an engaged position and gripping the attachment pin and the attachment pin is in an unlocked position;

at least one rotator carried by the carrier and positioned proximate to the lower end of the carrier, the at least one rotator being distinct from the at least one gripper, engageable with the attachment pin and selectively rotatable relative to the carrier, the at least one gripper, the attachment pin, and the first and second ground covers to rotate the attachment pin from at least one locked position to at least one unlocked position to unlock the attachment pin from the first and second ground covers;

and at least one power-driven actuator associated with the carrier and operatively coupled to the at least one rotator to selectively rotate the at least one rotator.

9. The power tool of claim 8 wherein the attachment pin includes a first portion and a second portion rotatable relative to the first portion, the at least one gripper anchors the carrier to the first portion of the attachment pin and assists in preventing at least substantial rotation of the carrier when the at least one gripper is in at least one engaged position and grips at least the first portion of the attachment pin and the at least one rotator rotates the second portion of the attachment pin.

10. The power tool of claim 9 wherein the carrier is elongated and configured to be in an at least substantially upright position when the at least one gripper is in an engaged position and engages the attachment pin and the at least one rotator rotates the second portion of the attachment pin.

11. The power tool of claim 9 wherein the second portion of the attachment pin includes at least one mateable portion accessible from above, further wherein the at least one rotator includes at least one mating portion that mates with the at least one mateable portion of the attachment pin to facilitate rotation of the second portion of the attachment pin by rotation of the at least one rotator.

12. The power tool of claim 11 wherein the at least one mating portion of the rotator is spring-biased downwardly relative to the carrier.

13. The power tool of claim 12 wherein the mateable portion of the second portion of the attachment pin includes a hexagonal socket and the mating portion of the at least one rotator includes a hexagonal protrusion.

14. The power tool of claim 12 wherein the mateable portion of the second portion of the attachment pin includes a hexagonally-shaped protrusion and the mating portion of the at least one rotator includes a hexagonal socket.

15. The power tool of claim 9 wherein the at least one rotator is selectively rotatable relative to the carrier, the first portion of the attachment pin and the first and second ground covers to rotate the second portion of the attachment pin from at least one unlocked position to at least one locked position relative to the first and second ground covers and releasably couple the first and second ground covers together.

16. The power tool of claim 9 wherein the at least one gripper engages with at least the first portion of the attachment pin retains the first portion of the attachment pin in a substantially fixed position relative to the second portion of the attachment pin during rotation of the second portion of the attachment pin by the at least one rotator.

17. The power tool of claim 8 wherein the at least one gripper is pivotably moveable inwardly relative to the carrier into at least one engaged position and pivotably moveable outwardly relative to the carrier into at least one disengaged position.

18. The power tool of claim 17 wherein the at least one gripper is spring-biased into the at least one engaged position.

19. The power tool of claim 8 wherein the power-driven actuator is operatively coupled to the at least one gripper to cause the at least one gripper to move between the engaged and disengaged positions.

20. The power tool of claim 8 wherein the power-driven actuator is operatively coupled to the at least one gripper to cause axial movement of the at least one gripper relative to the carrier toward the upper end of the carrier.

21. The power tool of claim 20 wherein the power-driven actuator is operatively coupled to at least one gripper to cause the at least one gripper to move into at least one disengaged position and release the attachment pin.

22. The power tool of claim 8 wherein the at least one gripper includes at least one claw.

23. The power tool of claim 22 wherein the at least one gripper includes first and second spaced-apart claws that grip opposite sides of the attachment pin.

24. The power tool of claim 23 wherein a first portion of the attachment pin includes at least first and second opposing sides that are at least partially accessible from above and each of which includes at least one shoulder formed therein, wherein each of the first and second claws in at least one engaged position grips the attachment pin adjacent to one of the shoulders and abuts the associated shoulder when the rotator rotates a second portion of the attachment pin.

25. A power tool for operating an attachment pin that selectively joins a first ground cover to a second ground cover, the power tool comprising:

a carrier;

first and second grippers carried by the carrier, the first and second grippers being selectively axially and selectively radially shiftable relative to the carrier;

a rotator extending axially outwardly of the carrier between the first and second grippers, the rotator being extendable through a first portion of the attachment pin into engagement with a second portion of the attachment pin, the rotator being configured to rotate the second portion of the attachment pin relative to the first portion of the attachment pin to releasably couple the first and second ground covers; and at least one power-driven actuator associated with the carrier and operatively coupled to the rotator.

26. The power tool of claim 25 wherein the at least one power-driven actuator includes at least one pneumatic cylinder which provides applied air pressure of at least 10 psi to drive the rotator(s) and at least 5 ft-lbs of rotational torque to rotate the rotator(s).

27. The power tool of claim 25 wherein the at least one power-driven actuator includes at least one hydraulic cylinder which provides applied pressure of at least 10 psi to drive the rotator and at least 5 ft-lbs of rotational torque to rotate the rotator(s).

28. The power tool of claim 25 wherein the at least one power-driven actuator includes at least one electric motor having a horsepower rating not less than ¼ HP and which provides at least 5 ft-lbs of rotational torque to rotate the rotator.

29. The power tool of claim 25 wherein the rotator is engageable with the second portion of the attachment pin and selectively rotatable relative to the carrier, the first portion of the attachment pin, and the first and second ground covers to rotate the second portion of the attachment pin from at least one unlocked position to at least one locked position, wherein the rotator is distinct from the first and second grippers.

30. A power tool useful for securing an attachment pin into and out of locking engagement with at least first and second ground covers and extracting the attachment pin from the first and second ground covers, the attachment pin extending at least partially through aligned holes in the first and second ground covers and being selectively rotatable relative to the first and second ground covers between at least one locked position and at least one unlocked position to respectively couple and uncouple the first and second ground covers together, the power tool comprising:

a carrier having an upper end and a lower end and being selectively positionable over the attachment pin;

at least one gripper carried by the carrier and positioned proximate to the lower end of the carrier, the at least one gripper being selectively moveable into and out of gripping engagement with the attachment pin, rotatable relative to the first and second ground covers and moveable away from the first and second ground covers, whereby when the at least one gripper is in gripping engagement with the attachment pin, the at least one gripper is rotatable to rotate the attachment pin between locked and unlocked positions and when the at least one gripper is in gripping engagement with the attachment pin and the attachment pin is in an unlocked position, the at least one gripper is moveable axially away from the first and second ground covers to remove the attachment pin therefrom; and at least one power-driven actuator carried by the carrier and operatively coupled to the at least one of gripper to selectively rotate the at least one gripper relative to the first and second ground covers and selectively move the at least one gripper up and away from the first and second ground covers.

* * * * *